United States Patent [19]

Schroeder

[11] Patent Number: 4,548,519

[45] Date of Patent: Oct. 22, 1985

[54] MARKING MACHINE CONTROL SYSTEM

[75] Inventor: Jeffrey L. Schroeder, Lake Zurich, Ill.

[73] Assignee: Product Identification Corporation, Glenview, Ill.

[21] Appl. No.: 504,721

[22] Filed: Jun. 15, 1983

Related U.S. Application Data

[63] Continuation-in-part of Ser. No. 183,175, Sep. 2, 1980, abandoned.

[51] Int. Cl.[4] ..... B41J 5/30

[52] U.S. Cl. ..... 400/61; 400/76; 400/130; 400/134.1

[58] Field of Search ..... 400/127, 128, 129, 130, 400/131, 132, 134, 134.1, 134.2, 134.3, 134.6, 61, 76; 101/18, 19

[56] References Cited

U.S. PATENT DOCUMENTS

| | | | |
|---|---|---|---|
| 3,227,258 | 1/1966 | Pannier et al. | 400/131 |
| 3,282,389 | 11/1966 | Rudisch et al. | 400/130 |
| 3,924,720 | 12/1975 | Wuetig | 400/131 X |
| 3,945,479 | 3/1976 | Wuetig | 400/131 |
| 4,031,993 | 6/1977 | Gurgens et al. | 400/130 X |
| 4,050,565 | 9/1977 | Heider et al. | 400/130 |
| 4,071,131 | 1/1978 | Turek et al. | 400/131 X |
| 4,180,338 | 12/1979 | LaManna et al. | 400/130 X |
| 4,233,661 | 11/1980 | Bolton et al. | 400/127 X |

*Primary Examiner*—Edgar S. Burr
*Assistant Examiner*—Charles A. Pearson
*Attorney, Agent, or Firm*—Dressler, Goldsmith, Shore, Sutker & Milnamow, Ltd.

[57] ABSTRACT

An electronic control system for apparatus of the type used for imprinting or marking nameplates and other similar workpieces. The control system of the present invention has particular application for use with electrically operated marking machines of the type which utilize a keyboard and a marking member which may be displaced to imprint or mark characters or symbols carried by the marking member on metal or plastic nameplates or other similar workpieces. The control system may be operated in a number of modes selectable by the operator including a mode in which the selection of the character or symbol to be printed is followed immediately by marking or printing of that character on the work-piece, other operational modes in which a number of characters can be selected or inputted without printing, and entire lines of characters and multiple lines of characters can be imprinted without interruption, and modes in which the entire label can be pre-formatted on a display prior to marking or printing and the formatted display can be saved for later use.

14 Claims, 19 Drawing Figures

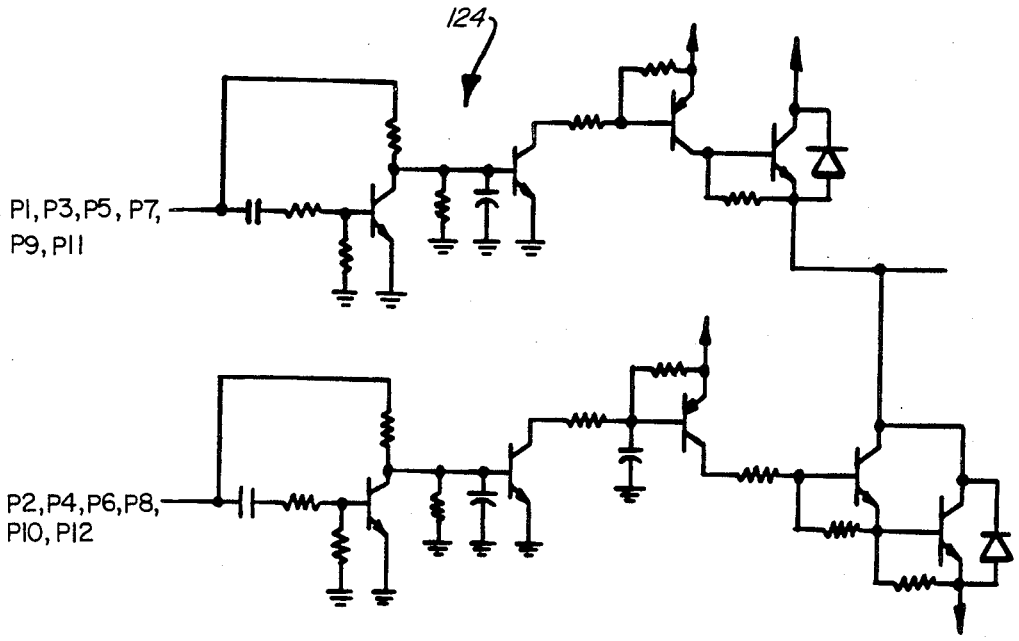
FIG. 8
FIG. 9
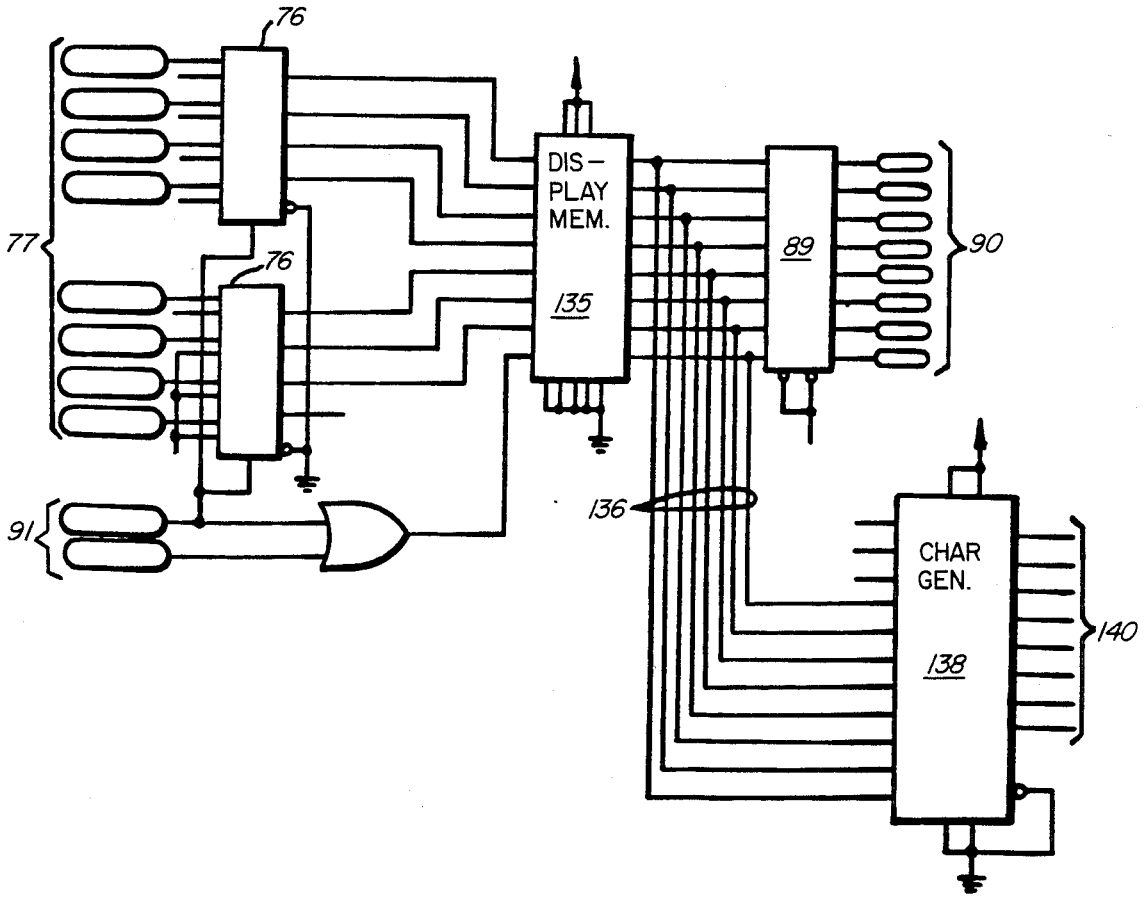

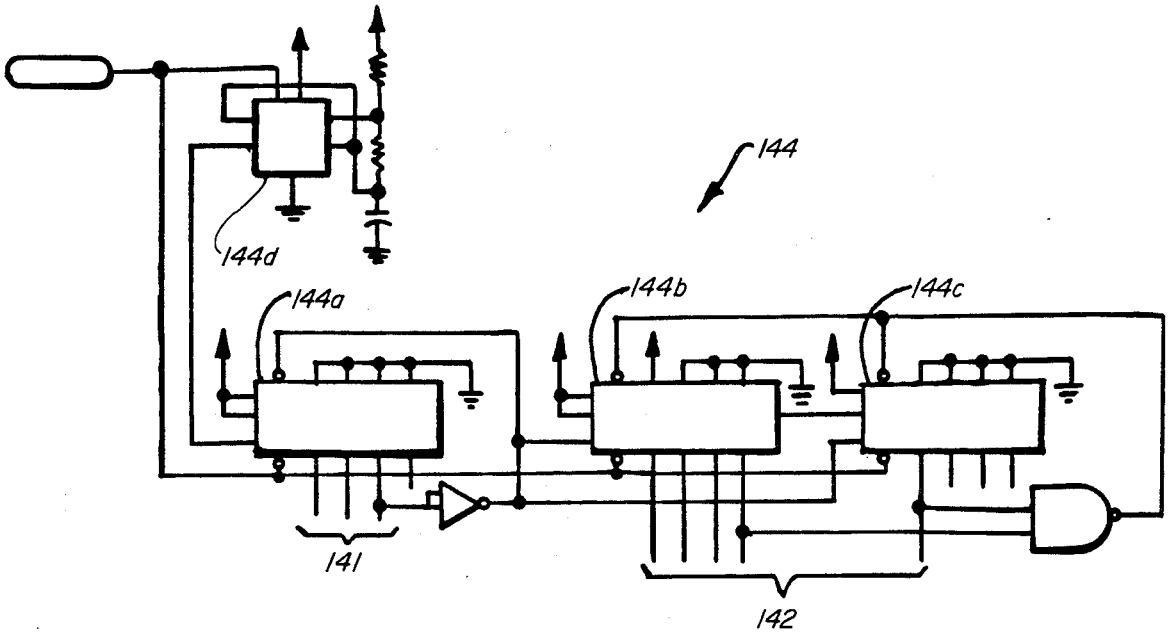
FIG. 10
FIG. 11
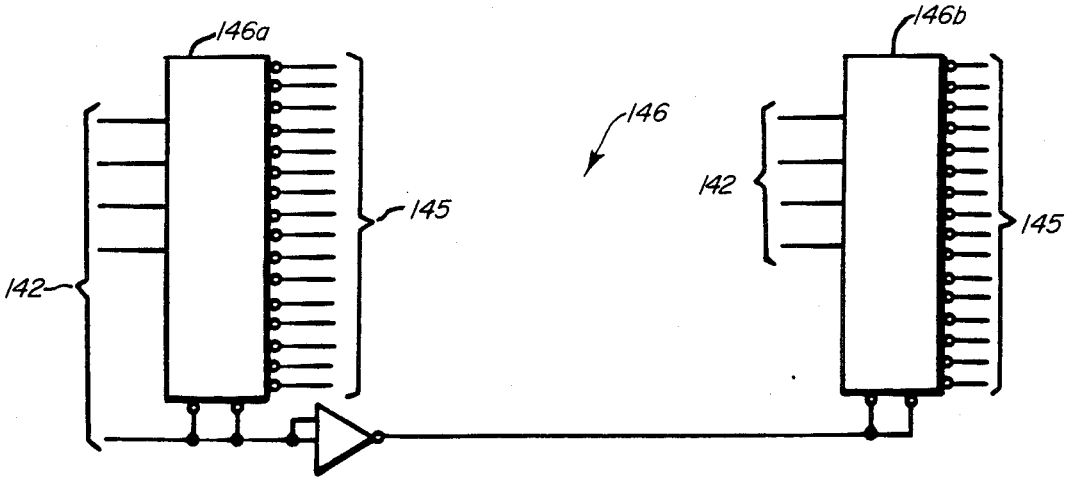

START UP

PRINT CHECK

MARKING MACHINE CONTROL SYSTEM

CROSS REFERENCE TO RELATED APPLICATION

This application is a continuation-in-part of application Ser. No. 183,175, filed Sept. 2, 1980, now abandoned.

TECHNICAL FIELD

This invention relates to electronic control systems and in particular to such control systems for apparatus of the type used for imprinting or marking nameplates and other similar workpieces. The control system of the present invention has particular application for use with electrically operated marking machines of the type which utilize a keyboard and a marking member which may be displaced to imprint or mark characters or symbols carried by the marking member on metal or plastic nameplates or labels, or other similar workpieces.

BACKGROUND OF THE INVENTION

Marking machines of the type with which the control system of the present invention is particularly useful typically includes a surface or table to hold and position a workpiece to be imprinted, and a marking member having a plurality of symbols thereon which can be positioned to mark the workpiece in a sequential pattern of selected symbols. Typically, this marking member may be changed to provide different desired combinations and sizes of characters or symbols.

In such marking machines, the marking member has been operated in response to actuation of a typewriter-like keyboard and electromechanical devices associated therewith. In operation, a character or symbol is selected by actuating or depressing one of the keys on the keyboard which corresponds to the character or symbol desired to be marked. The marking member then is indexed to locate the selected character or symbol in a marking position. The marking member is subsequently displaced into engagement with the workpiece to thereby mark or print onto the workpiece the selected character or symbol. Typically, the workpiece is then advanced a selected distance to locate the workpiece in position to be imprinted or marked with the next selected character or symbol.

In U.S. Pat. Nos. 3,924,720 and 3,945,479, assigned to the assignee of this application, there is disclosed such an electromechanically controlled marking machine designed for imprinting at relatively high speeds. The machine disclosed in the above-referenced patents includes a frame and a marking ram carrying a marking member or wheel which is slidably mounted on the frame and driven by an electric motor. This marking wheel is rotated to position the characters or symbols on the periphery thereof in position for marking a workpiece disposed therebelow and is transversely displaced to effect the desired marking of the workpiece.

In U.S. Pat. No. 4,071,131, also assigned to the assignee of this application, there is disclosed an electronic control system for the type of marking machines disclosed in the first cited patents which improve the reliability, performance and operational control of those machines and replaced electromechanical devices which limit the speed and reliability of operation with an electronic control circuit. All of the above cited patents and the disclosures therein are incorporated herein by reference in order to minimize the necessity of describing in detail what is contained therein.

While the marking machines and the operation thereof under control of the electronic control system disclosed in said U.S. Pat. No. 4,071,131, did in fact result in improved reliability and less electromechanical wear, there still were a number of mechanical components necessary in order to operate the machine. In addition, while the control system in the aforementioned U.S. Pat. No. 4,071,131 did improve the operational speed of such marking machines significantly, the need for faster operation remained as well as additional operational flexibility and even better reliability.

SUMMARY OF THE INVENTION

In accordance with the present invention there is provided an improved control system for use with marking machines such as disclosed in the aforementioned U.S. Pat. Nos. 3,924,720, 3,945,479 and 4,071,131 which would simplify the mechanical components in marking machines while simultaneously improving the operational speed and providing greater flexibility in operating the machine.

Thus, in accordance with the present invention, the marking member which contains the symbols or characters to be marked on a workpiece is selectively incremented to rapidly locate the selected character thereon in position for marking. Simultaneously, a number of the mechanical control mechanisms previously required to position the marking member and to stop it in the selected location are eliminated.

Furthermore, a system in accordance with the present invention may be operated in a number of modes selectable by the operator. In one mode, the selection of the character or symbol to be printed is followed immediately by marking or printing of that character on the workpiece. In other operational modes, a number of characters can be selected or inputted without printing. As a result, once the data is inputted entire lines of characters, multiple lines, and entire labels can be imprinted without interruption.

In addition, the control system of the present invention is capable of effecting automatic return of the marking table to its starting position, the automatic selection of the trailing margin position defining the maximum length of a line, the selectable bidirectional incrementing of the table in the lateral character increment direction and the transverse line increment direction, the selection of the magnitude of each increment of table movement in both directions to accommodate characters of different sizes and marking at different spacing, the selectable incrementing of the table to the next line, formatting, as well as other selectable control functions which may be desirable in the operation of such marking machines. The control system is also capable of utilizing input data representing the characters to be selected from remote sources, as well as from the keyboard associated with the marking machine. Such data may include prestored formats with preentered data, both constant and variable, and both characters to be marked and those not to be marked.

The movement of the marking table on which the workpiece is located is controlled by the control system of the present invention. This simplifies another area where mechanical components and mechanisms have previously been required and improves the reliability and flexibility of the marking machine.

More specifically, the control system of the present invention is responsive to signals from a keyboard or a remote source which can be representative either of a character to be marked or alternately of certain control operations to be performed. The system determines whether the input signals are symbol data signals or control signals. If a control signal, the necessary control operation is implemented.

If a symbol or character data signal, the system stores the identity of the character. If in a simultaneous input and print mode of operation, the printing operation is initiated. After a character is marked on the workpiece, the system increments the position of the table by the selected increment.

If an input signal is a control signal, the control system implements that control operation. Typical controls and modes include fixed field data entry—for displaying characters that are preprinted on the workpiece to be marked and therefore are not to be marked by the machine, auto increment start and stop, set entry, request switch settings for formatting, and multiple entry in which the system accepts plural input data representing a plurality of characters without initiating the print or marking cycle. In the latter mode, each of the characters is stored and retained for later use in printing. A number of lines of characters can be so retained for use in multiple line printing mode when that mode is initiated to print lines of characters at a time or entire labels without repetitive data entry.

Furthermore, the trailing margin can be preselected. This preselected margin position can be cleared to eliminate any such limitations or to enable a new margin selection.

With the control system of the present invention, it is possible to control both lateral, i.e. character advance, and transverse, i.e., line advance, movement of the table from the keyboard thereby eliminating a number of mechanical linkages and facilitating operation of the overall printing system.

At the end of a line of characters, when a keyboard return signal is produced, either automatically or when a return key is actuated, the system automatically returns the table to its starting position, advances the table to the next line, and automatically indexes the marking member to a reference position.

Furthermore the system incorporating the present invention is capable of interfacing with a CRT display to display the entire label to be marked, including fixed field characters that are to be printed repetitively or are not to be marked. This is useful in formatting the marking operation. The display is altered as a function of the increment switch settings to conform to the number of characters and lines that can be marked at the character and line spacing represented by the switch settings. This allows the operator to pre-format the data on the screen to know in advance the appearance of the marked label.

These and other capabilities of the system for controlling a marking machine result from the highly reliable marking control system of the present invention and permit high-speed operation of the marking machine in a variety of operational modes to improve the efficiency, effectiveness and flexibility of the marking operations for which the machine is designed. Furthermore, the control system of the present invention can be utilized with remote sources of information to permit marking of labels under remote control.

Numerous other advantages and features of the present invention will become readily apparent from the foregoing detailed description of the invention and one embodiment thereof, from the claims and from the accompanying drawing.

BRIEF DESCRIPTION OF THE DRAWING

FIGS. 4–12 are circuit diagrams showing the control system of the present invention;

DETAILED DESCRIPTION

Figure 1:
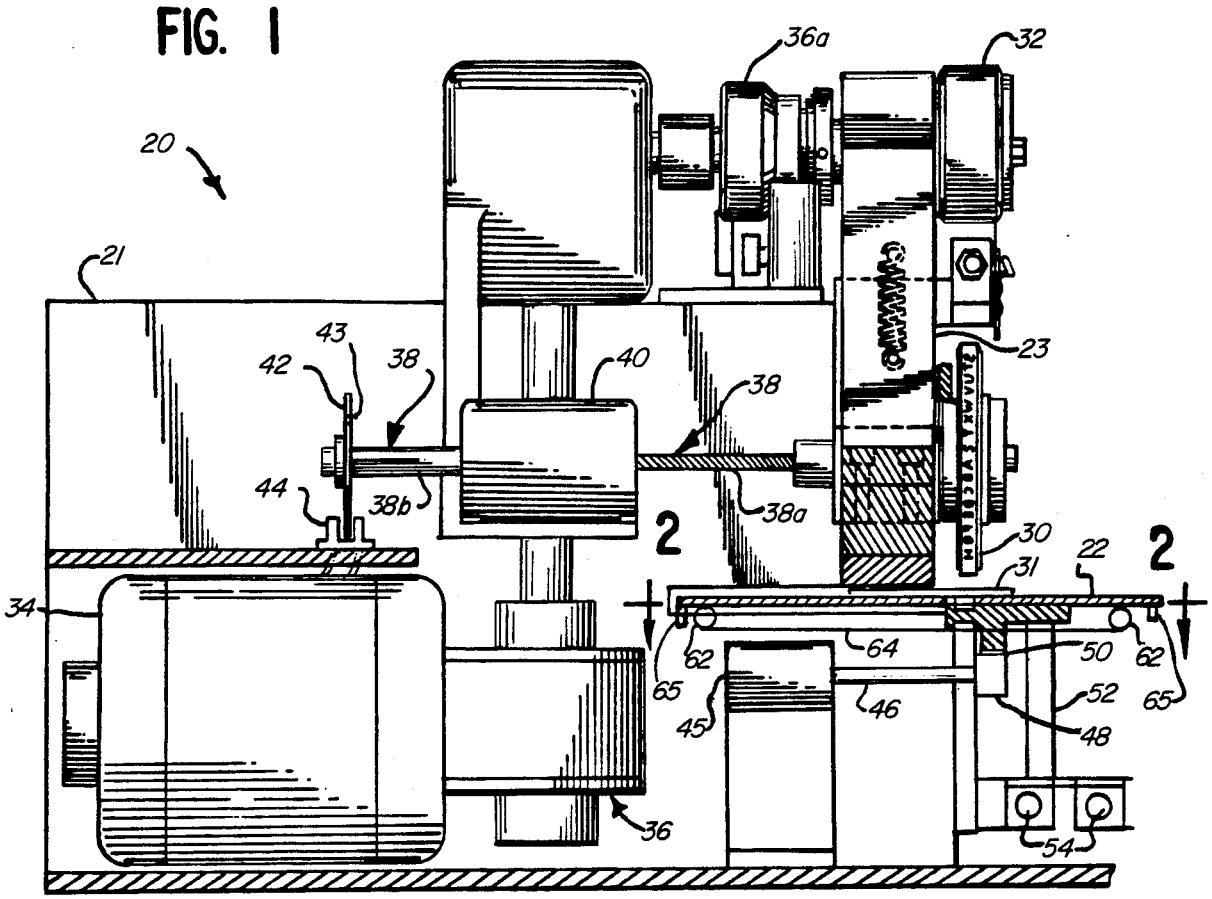
FIG. 1 is a fragmentary side elevational view, partly in section, of a marking machine with which the control system of the present invention may be used.

While this invention is susceptible of embodiment in many forms, there is shown in the drawing and will be described herein in detail preferred alternative embodiments of the invention. It should be understood, however, that the present disclosure is to be considered as an exemplification of the principles of the invention and is not intended to limit the invention to the embodiment illustrated and/or described.

The precise shapes and sizes of the components described herein are not necessarily essential to the operation of the disclosed apparatus and control system unless otherwise indicated.

Much of the apparatus disclosed herein has certain conventional components and support structures the details of which, though not fully illustrated or described, will be apparent to those having skill in the art and understanding of the functions of such mechanisms.

A control system incorporating the present invention is utilized for controlling operation of apparatus such as the marking machine disclosed in the above-cited U.S. Pat. Nos. 3,924,720, 3,945,479 and 4,071,131, the disclosures of which are incorporated herein by reference. Briefly, such a marking machine is shown in FIGS. 1, 2 and 3 of the drawing and will be described briefly hereinbelow, although a detailed understanding of the marking machine can be obtained by reference to the above cited patents.

Figure 2:
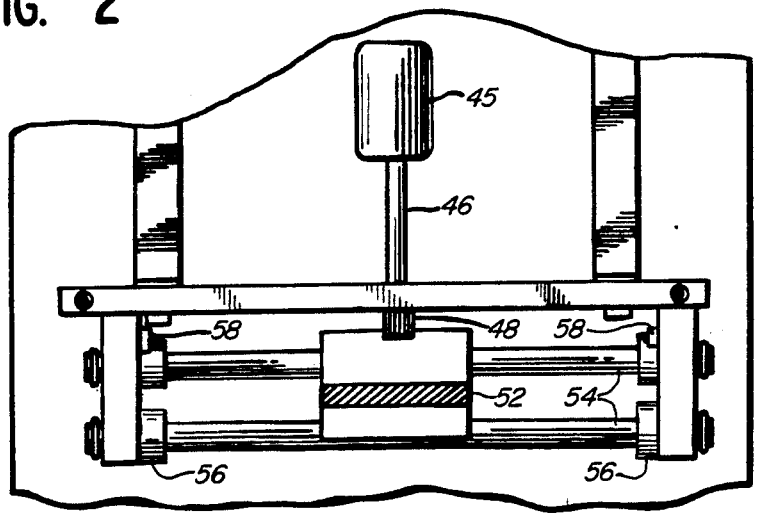
FIG. 2 is a fragmentary view, partly in section, taken along line 2—2 of FIG. 1, with the table omitted.
Figure 3:
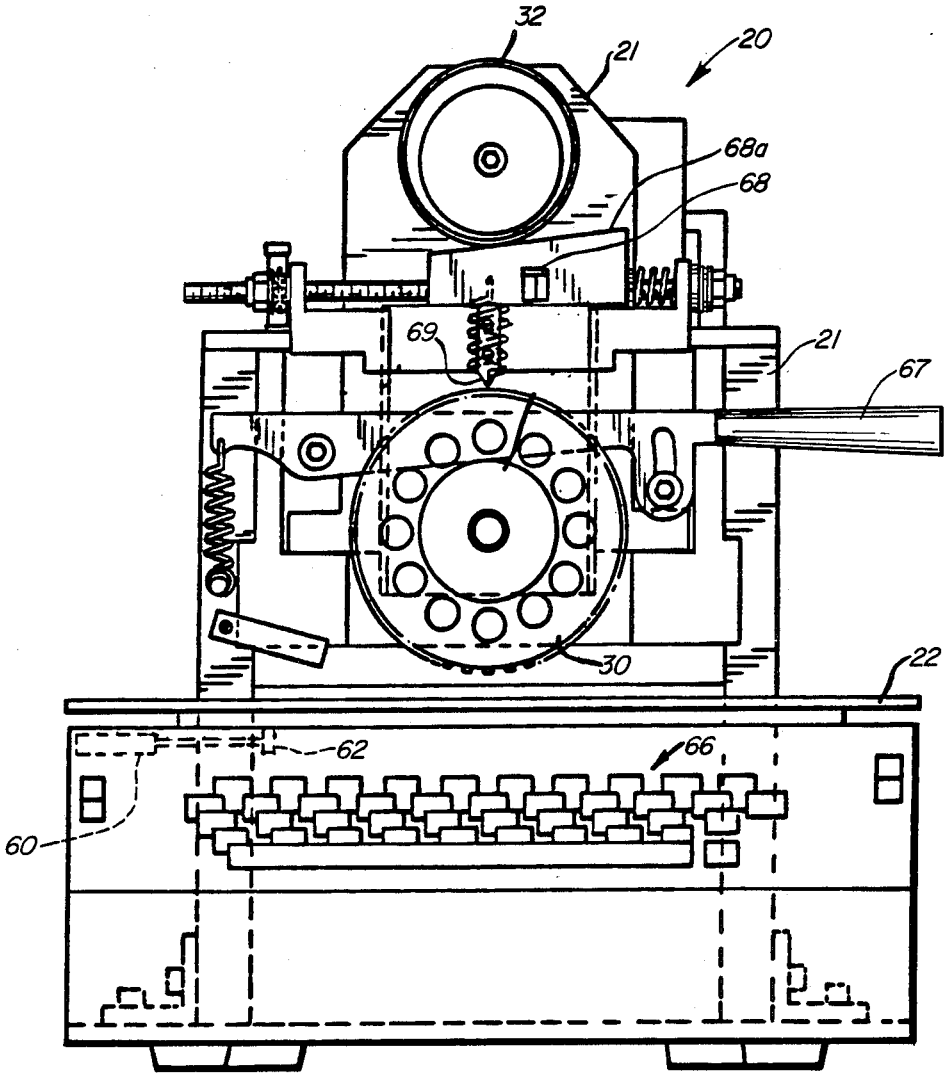
FIG. 3 is a front view of a marking machine with which the control system of the present invention may be used.

In general, the marking machine 20 includes a frame 21 in which an indexing table 22 is slidably mounted for reciprocal lateral or character incrementing movement (to the left and right in FIG. 3 and forward and rearward line incrementing movement (to the left and right in FIG. 1). A marking ram 23 is provided above the indexing table 22 and carries a marking member shown as a marking dial or wheel 30.

The actual marking or imprinting of a workpiece 31, e.g., a nameplate or label, which is supported on the table 22 takes place when the marking ram 23 is displaced downwardly. This causes the marking dial 30 to make contact with the surface of the workpiece 31 disposed on the table 22. The marking ram 23 is actuated by an eccentric cam 32 driven by an electric motor 34 through an appropriate drive train 36, including single revolution clutch 36*a* as described in the above-referenced patents.

The rotatable marking dial or wheel 30 is carried by the marking ram 23 and is supported therein on a shaft 38 having a flexible portion 38*a* interconnecting the marking wheel 30 with a stepping motor 40, and a rigid portion 38*b* connecting stepping motor 40 to a reference disk 42. The disk 42 has an aperture 43 therein which is sensed by an optical sensor 44 located at the reference position. When the reference aperture 43 in the disk 42 is sensed by the sensor 44, the disk 42, and therefore the wheel 30, are at the reference position.

The workpiece 31, e.g., a nameplate or label, to be marked is positioned on the indexing table 22 and is suitably clamped or otherwise positioned thereon so that the nameplate 31 is advanced when the indexing table 22 is incremented as described below. The mechanism for incrementing the indexing table 22 for each character comprises a first or character table stepping motor 45 having a shaft 46 connected to a pinion 48 which engages a rack 50 formed as a part of a support or carriage 52 for the indexing table 22.

The carriage 52 slidably supports the indexing table 22 for transverse line incrementing movement relative thereto, and itself is slidably mounted on a pair of carriage shafts 54 which in turn are mounted on and traverse the forward end of the marking machine 20 as shown in FIGS. 1 and 2. Carriage stops 56 may be provided at the opposite ends of the carriage shafts 54 and limit switches 58 can be located at those respective locations to indicate that the carriage 52, and therefore the table 22, has reached the extreme positions of permissible travel or movement.

The table 22 is line incremented, i.e., moved in the forward and backward direction (to the right and left in FIG. 1) by a second or line table stepping motor 60 connected to one of a pair of pulleys 62 about which extends a flexible belt 64 affixed to the underside of table 22. Suitable limit switches 65 similar to limit switches 58 can be appropriately located to define the limits of line incrementing movement of the table 22.

The marking machine 20 may be provided with other components such as keyboard 66 a manually operable push-down lever 67, a pointer 68 on wedge block 68*a* for indicating the depth of the ram stroke to assist in calibration, as well as other components such as dial alignment indicator 69, all as described in the above referenced patents. (See e.g., above cited U.S. Pat. No. 3,924,720).

The reference position for the table 22 occurs when the carriage 52 actuates limit switches 58, while the reference position of the wheel 30 is defined as the position where the aperture 43 in disk 42 is being sensed by optical sensor 44. When first turned on, the electronic circuitry performs a self-check test to insure that it is in operating condition, and a ready message is displayed on an optical display 72 (see FIG. 12) or a CRT display 300 (see FIGS. 14 and 15). The keyboard 66 is used as a manual input device to select the characters to be marked or printed as well as control functions implementing the various operational modes possible with the marking machine 20 controlled by the control system of the present invention.

Figure 4:
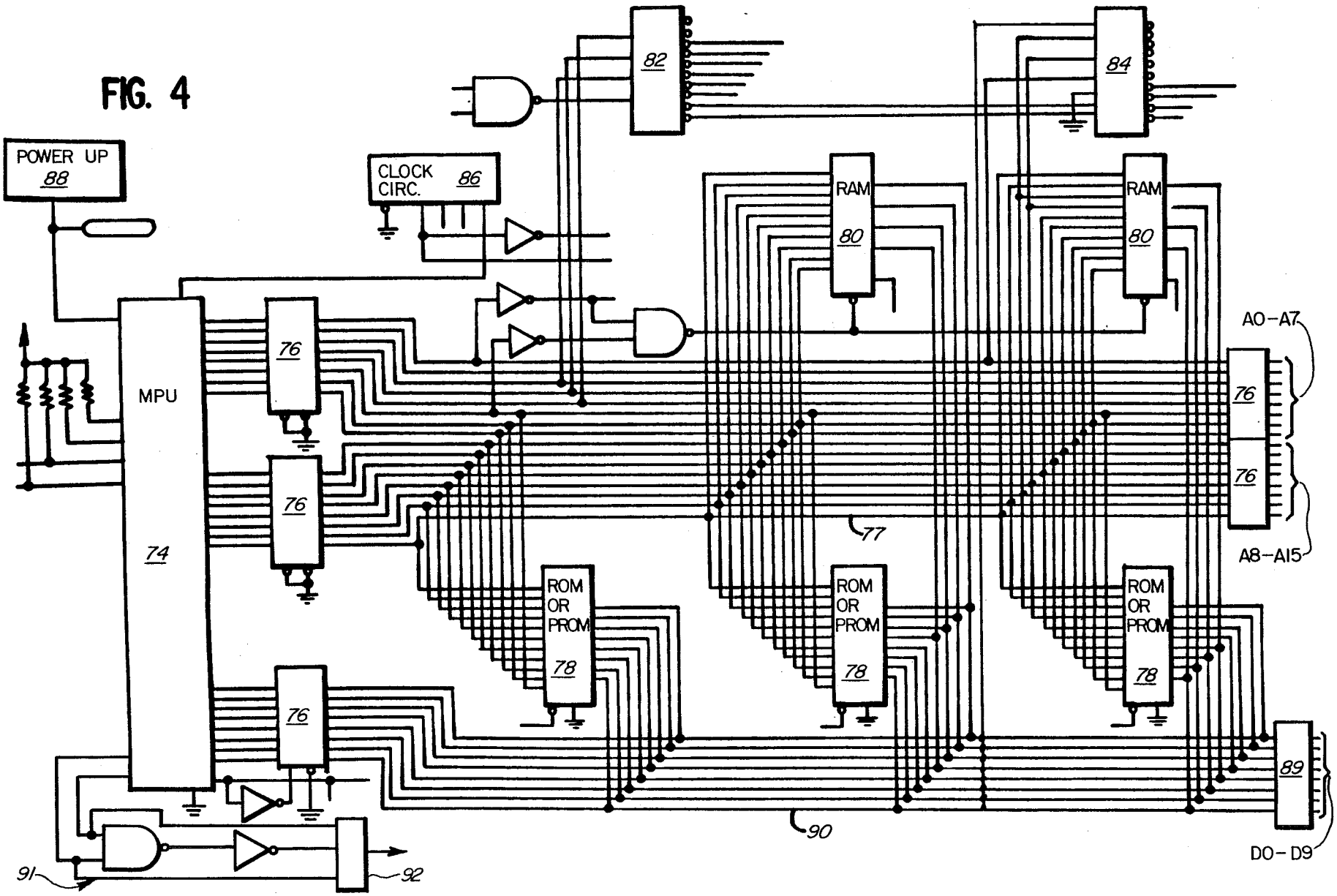

One embodiment of a control system of the present invention is shown in FIGS. 4–12 and incorporates a microprocessor system. The system is based on a Motorola 6802 microprocessor unit (MPU) 74, and includes buffers 76 for connecting the MPU 74 to a plurality of address lines 77, a plurality of program read only memories (PROM's or ROM's) 78, random access memories (RAM's) 80, baud selection circuit 82 connected to an RS232 communications interface circuit 84, a clock circuit 86 and a power-up initializing circuit 88. The MPU 74 is connected through a bidirectional buffer 89 to a plurality of data lines 90, and is connected to control lines 91 through a control decoder 92 for use with external circuits as described below. These and the various control gates shown in FIG. 4 are all well known components of microprocessor control systems.

The address lines 77 and data lines 90 are connected through buffers 76, 89, respectively, to peripheral circuits described below, such as the three input-output circuits which in the Motorola 6802 based systems disclosed are peripheral interface adaptors (PIA's) 94, 96, 98 shown in FIGS. 5 and 6. These circuits are used to interface external components to the microprocessor system. PIA 94 is for the keyboard 66. PIA 96 is for an external source of data such as a communication link, through, as shown, a serial-to-parallel interface circuit 100, if the circuits 82 and 84 are not used as shown.

Figure 7:
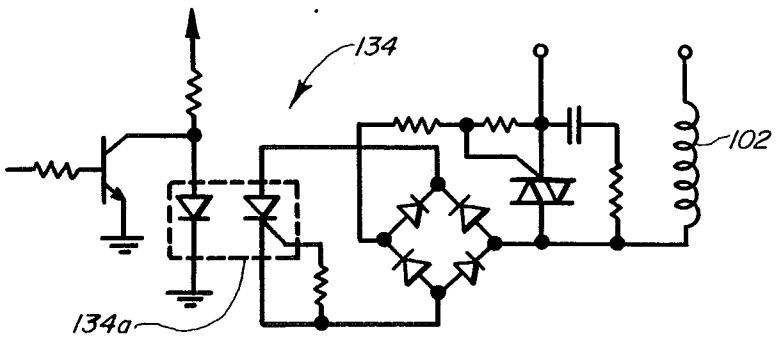

The third PIA 98 is used to control the stepping motors 40, 45, 60 as well as a solenoid 102 for the clutch 36*a* in a marking or print drive circuit 134 (FIG. 7). The solenoid 102 is energized to operate the clutch 36*a* and effect rotation of cam 32 to drive the ram 23 as described in the above-cited patents. (See the description of clutch solenoid therein, e.g., U.S. Pat. No. 3,924,720, col. 2, lines 43 et seq.). PIA 98 also senses input signals from the table limit switches 58, 65, from the marking wheel reference sensor 44 and from manually settable switches 104, 105 which select the desired number of steps per movement, i.e., spacing, of table movement.

Figure 5:
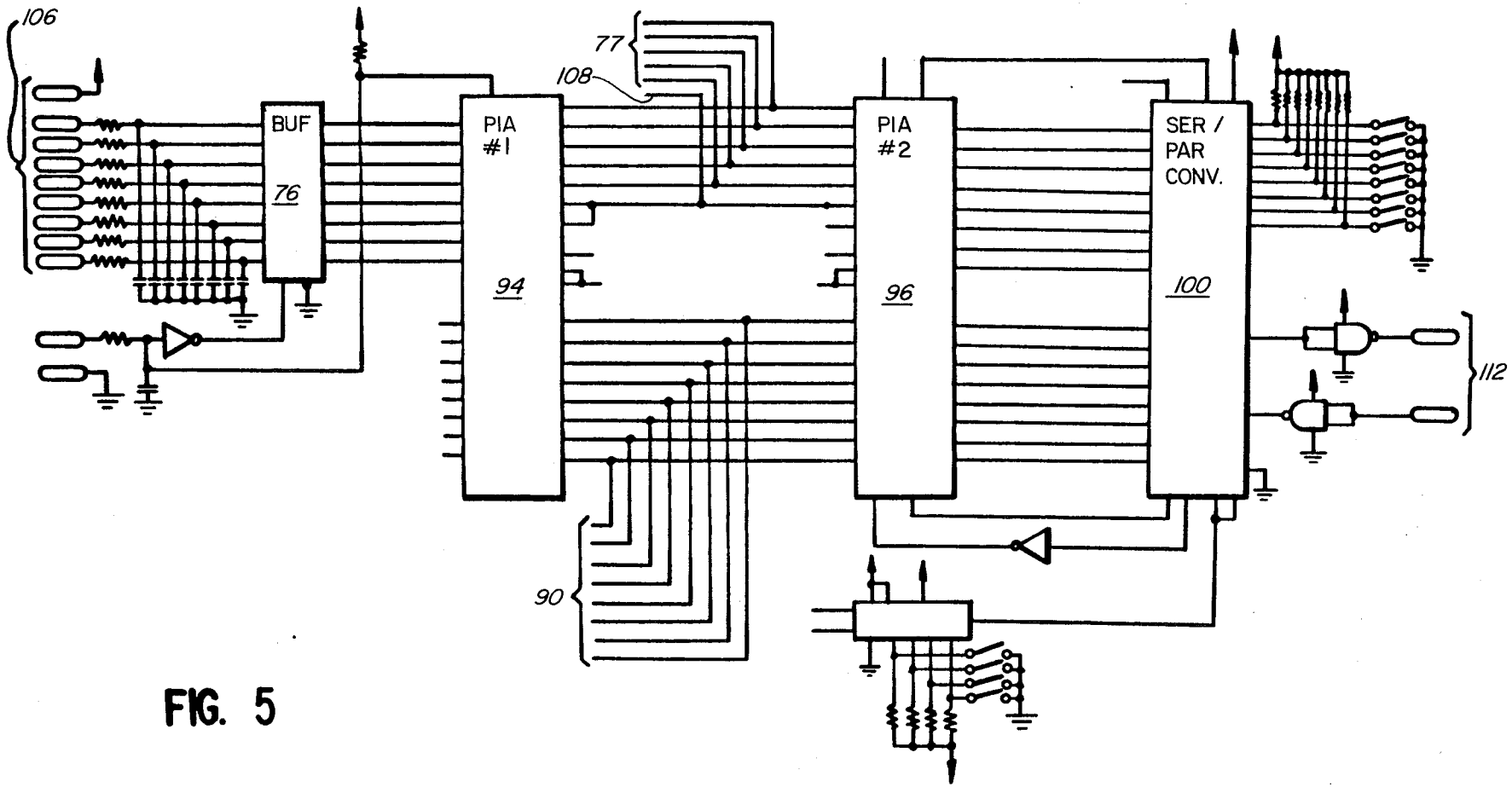

As shown in FIG. 5, coded outputs 106 from keyboard 66 are connected to the keyboard PIA 94 through a buffer 76. The keyboard PIA 94 produces an interrupt signal 108 when actuation of a key on the keyboard 66 is sensed and produces data signals on the data lines 90 connected to the microprocessor 74 through a buffer 89.

The communications PIA 96 is connected to the serial-to-parallel interface circuit 100 which in turn receives serial pulses over a communications line 112 representative of data similar to the data received from the keyboard 66. Circuit 100 converts serial data to parallel data for input to the PIA 96 which produces an interrupt signal 108 and data signals 90 connected to the microprocessor 74 as described above with respect to the keyboard PIA 94. Data output from the microprocessor 74 can be connected through PIA 96 and through the serial-to-parallel interface circuit 100 to the communications line 112 if desired.

Figure 6:
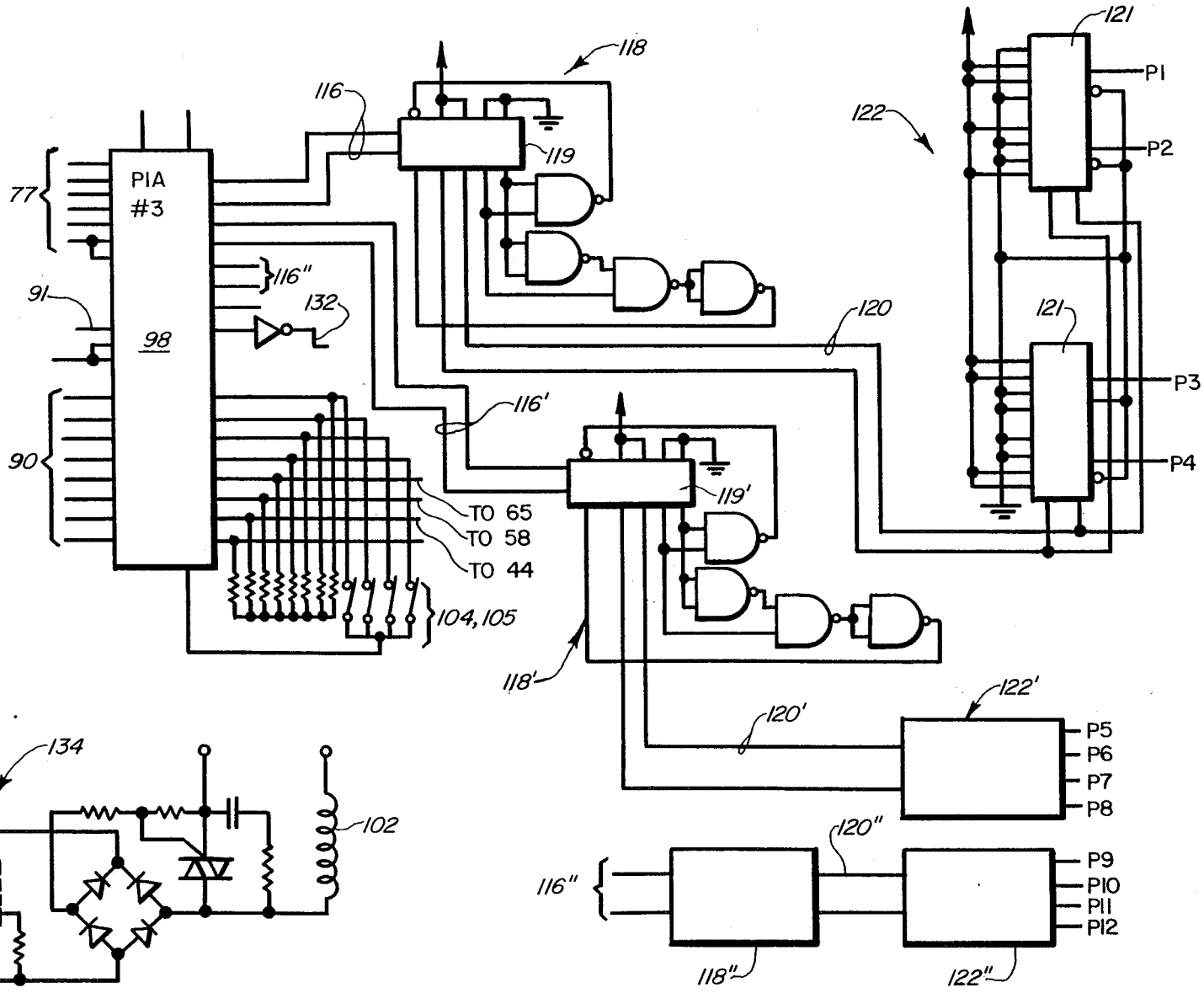

The circuit of FIG. 6 shows the motor and print control PIA 98 which receives data signals 90, address signals 77 and control signals 91 to produce control pulses at its output to energize either the wheel stepping motor 40, the table stepping motor 45, or the solenoid 102.

The wheel motor 40 is energized with a sequence of pulses to rotate the printing wheel 30 until a selected character is located in the marking position. The print wheel control outputs 116 from PIA 98 are applied to a motor decode circuit 118. Motor decode circuit 118 includes a count to 4 counter 119 which repetitively counts up from zero to three in response to one of the outputs 116 from PIA 98 and repetitively counts down from three to zero in response to the other of the outputs 116 from PIA 98.

The outputs 120 of motor decode circuit 118 are coded signals, such as binary coded signals, indicative of the value of the count in counter 119, and are applied to a motor control circuit 122. Motor control circuit 122 includes a pair of decoders or multiplexers 121 which produce the motor control pulses P1 through P4 in preselected sequence to motor drive circuits 124 (FIG. 8) as a function of the value of the coded signals 120 applied thereto.

Thus, for example, for each coded signal 120, a predetermined pattern of pulses or signals P1–P4 is produced. One sequence of these patterns is produced when the counter 119 is counting up and another sequence of these pulses is produced when the counter 119 is counting down.

FIG. 8 shows one of the motor drive circuits 124 utilized to energize the stepping motors 40, 45, 60 and cause them to rotate either clockwise or counterclockwise. There are two such motor drive circuits 124 for each motor, one for each phase. Thus the motor control circuit 124 for one phase of motor 40 has applied thereto pulses P1 and P2 as shown. A second identical circuit 124 for the other phase of motor 40 would have applied thereto pulses P3 and P4 as shown.

Similarly, table wheel control outputs 116' of PIA 98 are applied to table motor decoder circuit 118' which includes counter 119' and which produces outputs 120' applied to another control circuit 122' identical to circuit 122. The second control circuit 122' produces motor control pulses P5 through P8 applied to a pair of motor drive circuits 124 identical to the ones shown in FIG. 8 to increment table stepping motor 45 and cause it to rotate in either of the two directions and move the table 22 either forward or backward.

When stepping motor 60 is to be operated to increment a line, two additional outputs 116" from PIA 98 are applied to yet another motor decoder circuit 118". The outputs 120" of circuit 118" are applied to yet another control circuit 122", like circuit 122, to produce motor control pulses P9, P10, P11, P12 which are applied to another pair of motor drive circuits 124 to increment line stepping motor 60, as described above.

Depending upon the sequence of motor control pulses P1–P4, P5–P8, P9–P12, the wheel motor 40, table motor 45 and table motor 60, respectively, are turned either in a clockwise or in a counterclockwise direction.

In addition, PIA 98 also produces an output signal 132 to energize a solenoid drive circuit 134 (FIG. 7) when it is desired to energize the solenoid 102 to displace the marking wheel 30 and effect marking or imprinting of the workpiece 31. Circuit 134 includes isolator **134*a* to isolate the solenoid 102 from the PIA 98**.

The motor control PIA 98 is also responsive to certain input data from the table limit switches, 58, 65, from the wheel reference sensor 44 and from the manually set switches 104, 105 which select the distance the table 22 is to be incremented, i.e., the number of steps per each increment and therefore the spacing between characters and between lines printed on the label or workpiece 31.

The control system of the present invention is provided with a display 72 (FIG. 12) so that the operator can observe that the correct characters have been selected, i.e., that the proper key in the keyboard 66 has been activated and also displays the line of characters to be printed when entire lines are printed automatically in the automatic print mode.

The display control circuit is shown in FIGS. 9–11 in which address signals 77 and character data 90 are stored in a display memory 135. The outputs 136 of display memory 135 are applied to a character generator or decoder 138. The outputs of the character generator or decoder 138 are, as is well known, a plurality of row drive signals 140 which in conjunction with the outputs 141, 142 of the column select generator 144 (FIG. 10) and the outputs 145 of digit select generator 146 (FIG. 11) to produce the necessary information to selectively energize each of a plurality of matrices 147 of light-emitting diodes, i.e., the display 72, for displaying each alpha-numeric symbol.

The operation of such circuitry is well known. Thus the output of memory 135 is data representative of a particular character to be displayed in one of the matrices 147. This data for each character is applied sequentially to the input of character generator or decoder 138 which converts that data to signals on selected ones of the row drive signal lines 140 to enable energization of the appropriate LEDs in each of the matrices 147.

Column and digit select generator 144 consists of a plurality of counters **144*a*, 144*b*, 144*c*. Counters 144*a*, 144*b*, 144*c* are continuously incremented by a clock or timing circuit 144*d* which applies count pulses to the inputs of the first counter 144*a*. The first counter generates the column select signals 141. When the first counter 144*a* has completely cycled, it resets and produces a pulse applied to the input of the second and third counters 144*b*, 144*c* which produce coded, digit select signals 142**.

The digit select signals 142 are applied to the inputs of a pair of 4 to 16 decoders **146*a*, 146*b*. For each coded digit select signal 142 applied to the input of the coders 146*a*, 146*b*, there is produced a single output of one of the digit select lines 145. The colunn select signals 141 are applied to the decoders 148 which produce an output on one of the output lines connected thereto in response to each unique coded input 141** to select one of the columns in each of the matrices.

Figure 12:
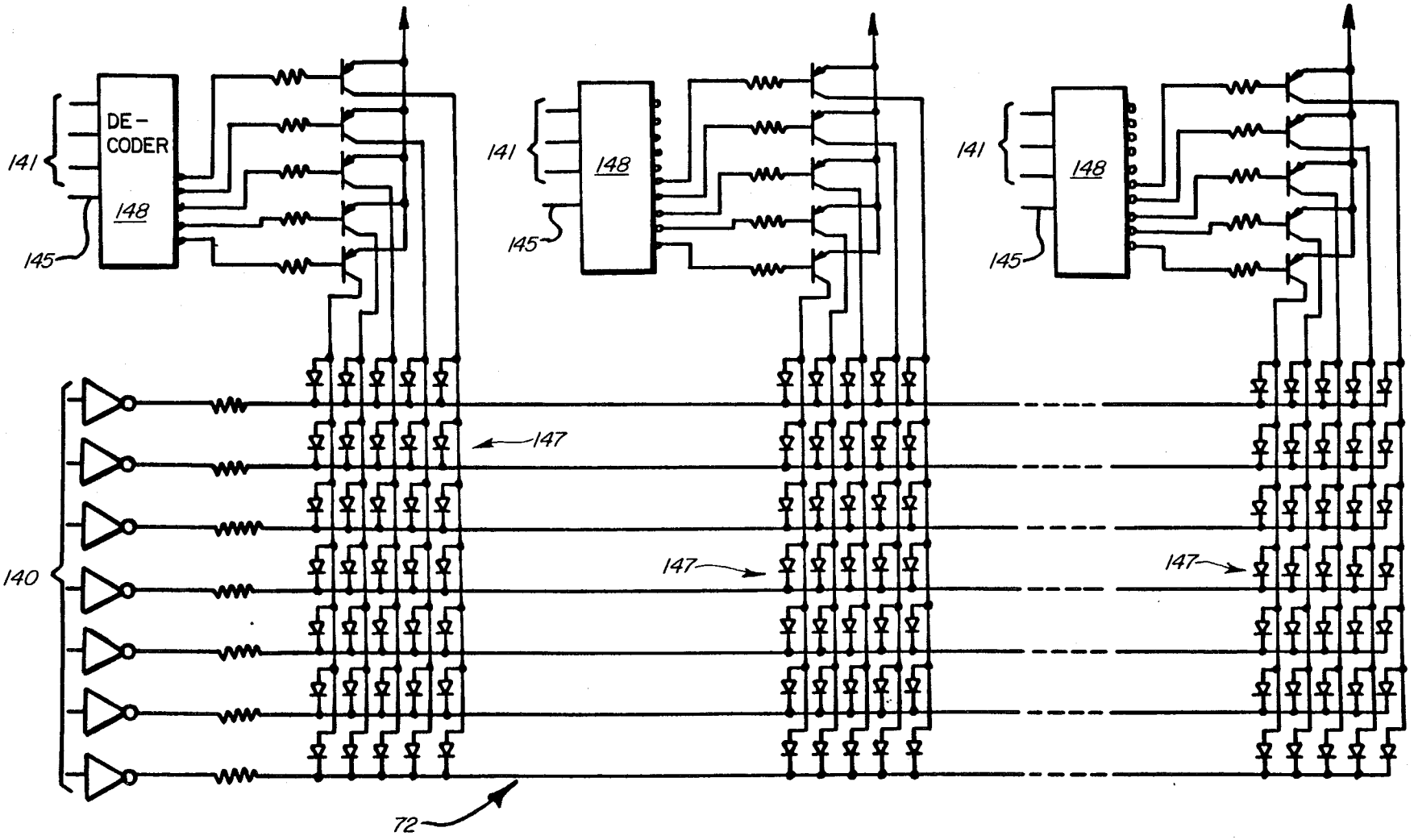

Thus, if a digit is to be displayed in the left hand most matrix 147 shown in FIG. 12, the row select signals 140 will be enabled for those elements in the first column of the left hand matrix 147 which are to be energized. Simultaneously, the column select signals 141 will enable each decoder 148 to energize the first column and the output 145 from the digit select decoder circuitry shown in FIG. 10 will be energized only for the first digit decoder 148. The result is that those light emitting diodes in the first column connected to the rows enabled by the signals 140 will be energized. The data on lines 140 and 141 are then changed to energize selected diodes in the second column and the process is repeated. This method of displaying characters in a multiplexed sequence is, of course, well known.

Thus, the row data signals 140 are applied to the matrices, and the column signals 141 and the digit address signals 145 are applied to decoders 148 which select the digit to be energized and the series of columns to be energized sequentially. As a result, each of the columns of each digit is energized sequentially in a multiplexed fashion to display the character selected by operation of the keyboard 106 or other message in accordance with the data produced by the microprocessor 74.

Figure 13:
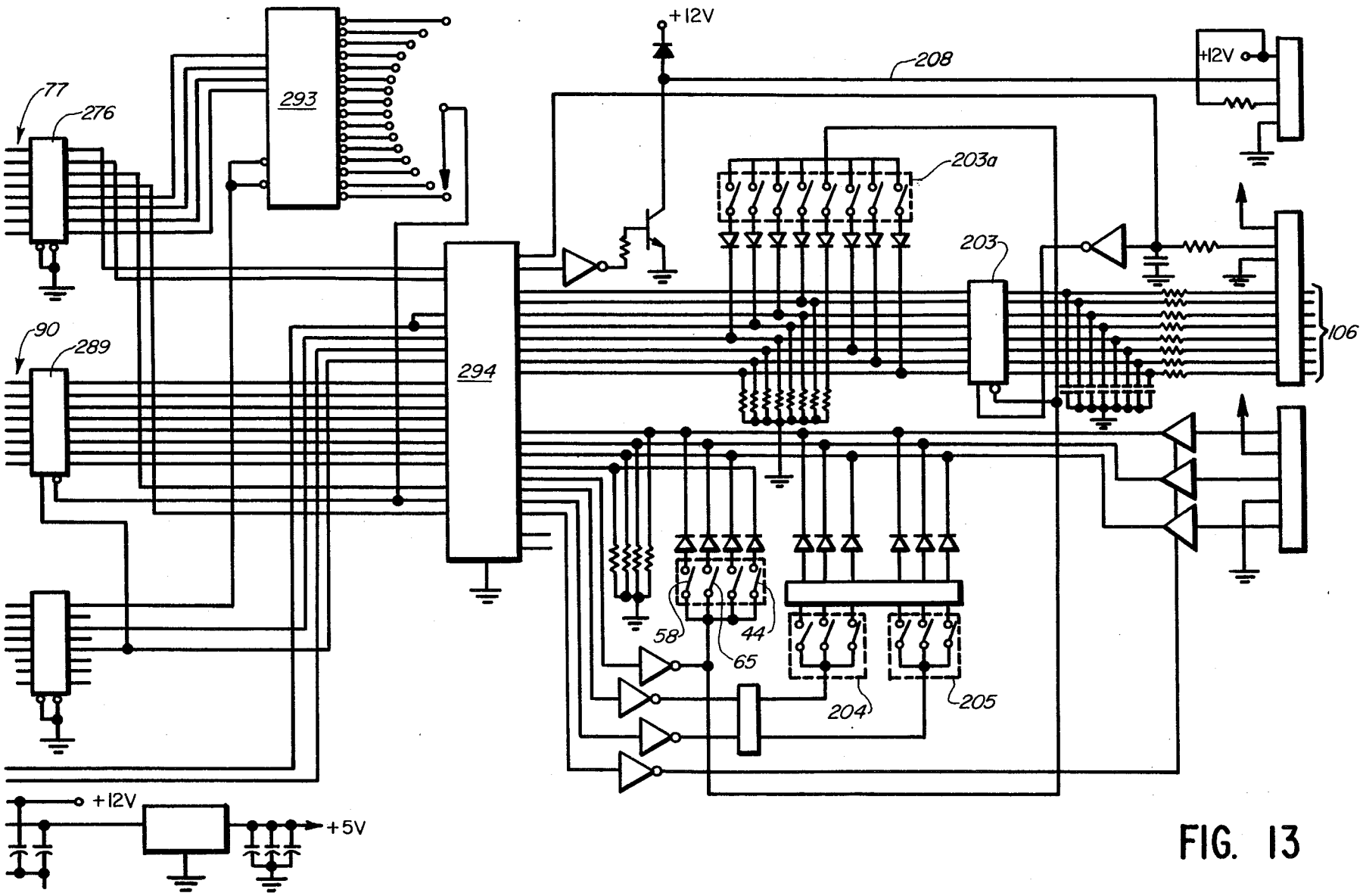
FIG. 13 is a circuit diagram of an alternative embodiment of a portion of the circuits shown in FIGS. 5 and 6.

In the alternative embodiment of the interface circuitry shown in FIG. 13, the address signals 77 are connected through a buffer 276 to a 4–16 decoder 293. The 4–6 decoder 293 produces an output on one of its output lines in response to each unique coded signal on the four address lines 277 applied to its inputs. Each output of decoder 293 is applied to a control input of a PIA 294 to select that PIA. Thus decoder 293 is capable of selecting sixteen different PIA's in response to four address signals applied to the input thereof. Two address signals 277 are also applied to the PIA 294. Since these address signals are common to all of the PIA's the use of the decoder 293 and the circuit select outputs therefrom is utilized to select each PIA. The circuitry shown in FIG. 13 is utilized to sense inputs 106 from keyboard 66 applied to the data inputs of the PIA through a latch 203. Also connected to the inputs of the PIA are a plurality of manually settable option select switchs 203*a* and the step selection switches 204 and 205 for selecting, respectively, the character incrementing steps and the line incrementing steps for controlling movement of the table by the stepping motors 45, 60. In this embodiment, signals from the optical sensor 44, and the table limit switches 58, 65 are also applied to the inputs of the PIA 294. Data is read out of the PIA through buffer 289 which is connected to the data lines 90 described above. When keyboard data is sensed by the PIA, an interrupt 208 is produced causing the microprocessor system to read data from the keyboard before the keys are released and the data lost.

Figure 14:
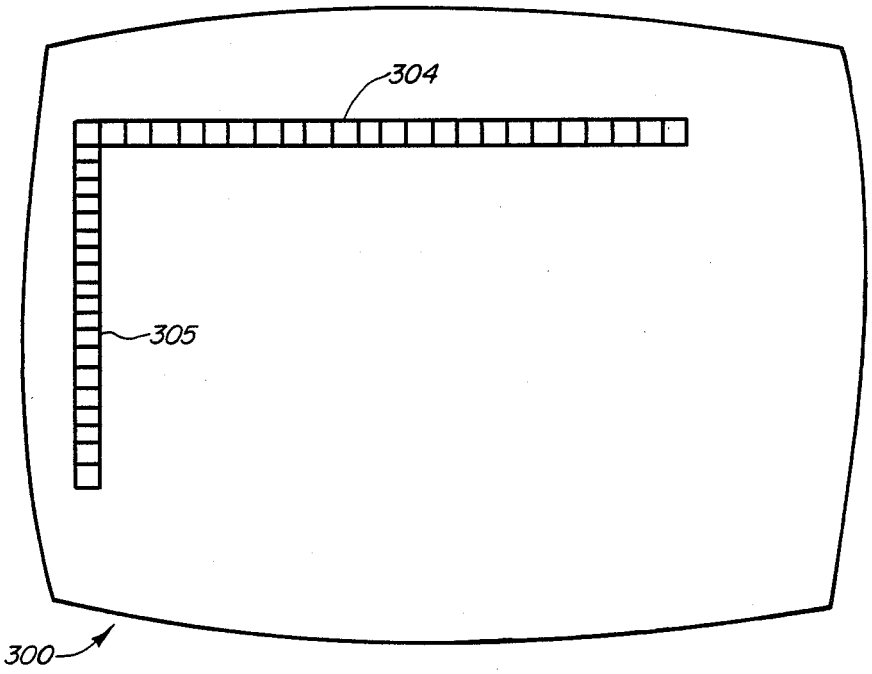
FIGS. 14 and 15 are diagrammatic views of CRT displays useful for pre-formatting data to be imprinted by the marking machine.
Figure 15:
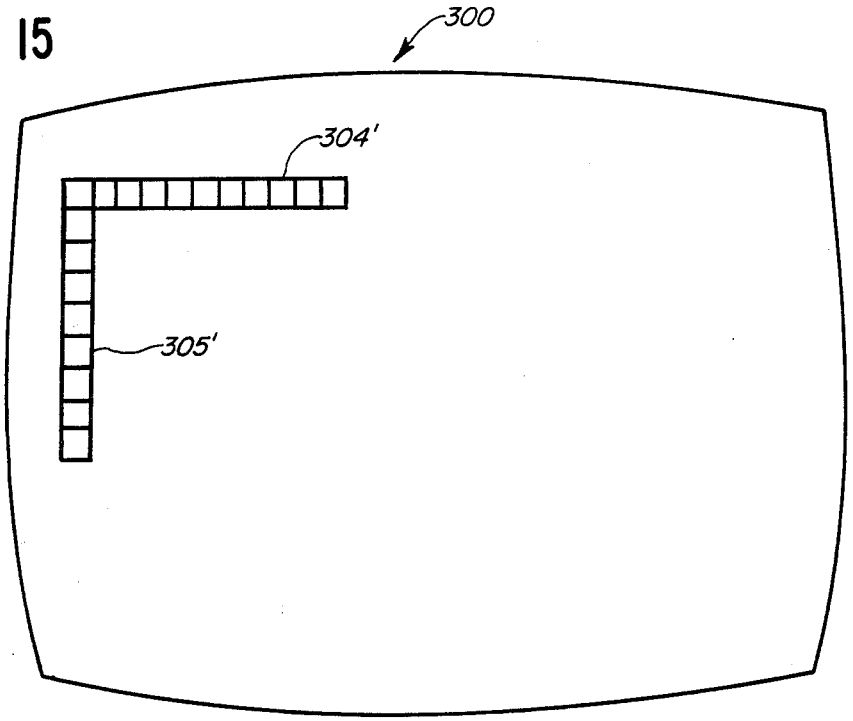
Figure 16:
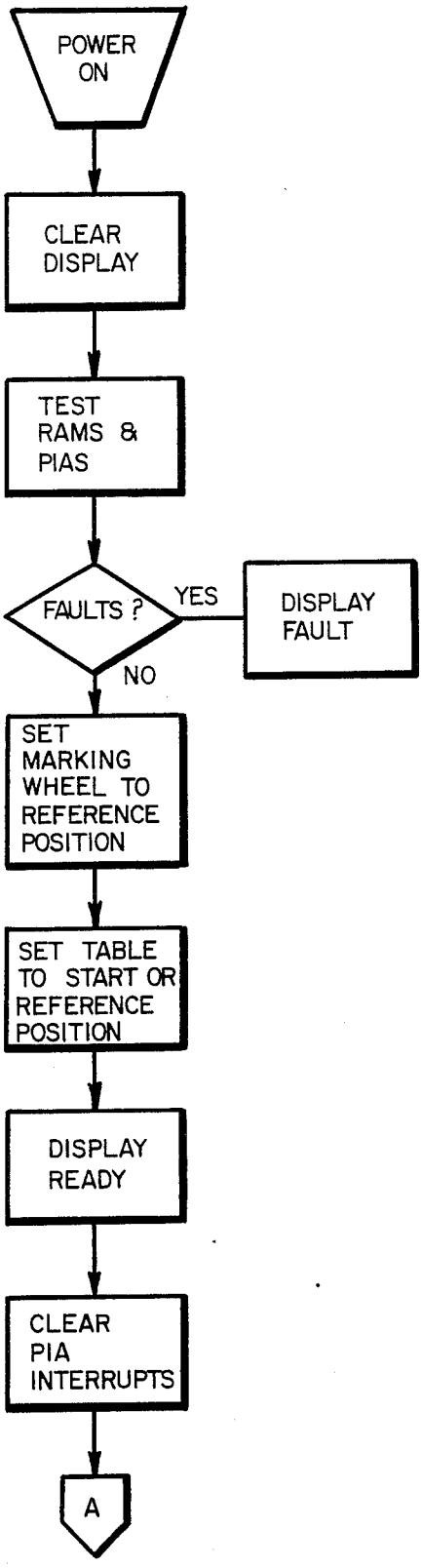
FIGS. 16–19 are flow diagrams helpful in understanding the operation of the control system.

Turning to FIGS. 14 and 15, there is shown a representation of a cathode rate tube (CRT) display 300 for the data to be imprinted on the label. Across the top of the display there is a character margin 304 which indicates the number of characters that can be imprinted on a label for the particular setting of the character incrementing switches 104 or 204, and along the left side of the display there is a margin 305 indicating the number of lines that can be imprinted on the label for the selected setting of the line incrementing switches 205. Thus, depending upon the size of the label to be imprinted, and the size of the characters which are to be utilized, the table setting switches are operated to select a desired number of characters per row or line and the desired number of lines that are to be imprinted. The setting of the switches also controls the spacing between characters and lines since these settings control the number of steps each of the stepping motors are incremented each time a incrementing signal is produced. Thus, the display on the CRT is altered as a function of the setting of these switches so that only a selected number of characters can be displayed and only a selected number of lines can be displayed to allow for complete formatting of the data to be imprinted or marked prior to the marking operation.

In addition, data that is not to be marked, such as data that is preprinted or screened on the label can be displayed in reverse video. This is a well known technique and can be achieved by utilization of an extra data bit. The extra data bit also indicates to the system that this data is not to be printed. Thus the nonprintable data may be displayed on the CRT in a mode different from the data to be printed, and this display indicates that the data so displayed will not in fact be printed on the label.

In operation, when the system is energized, the power up circuit 88 produces an initializing signal which causes the system to initialize and self-check the RAMs 80 and the PIAs 94, 96, 98 (FIG. 6). In summary, the display 70 is cleared, and the RAMs 80 and the PIAs 94, 96, 98 are tested. If faults are detected, a fault message is displayed.

If there are no faults, the marking wheel 30 is returned to its reference position and the table 22 is returned to its start position. Finally, a number of other initializing functions are performed, such as, setting up the various PIA ports as inputs or outputs, storing the various initial addresses for data, and setting the trailing margin at its maximum value. The message "READY" is then displayed to inform the operator that the system is in condition to accept input data, and all interrupt flags are cleared.

Figure 17:
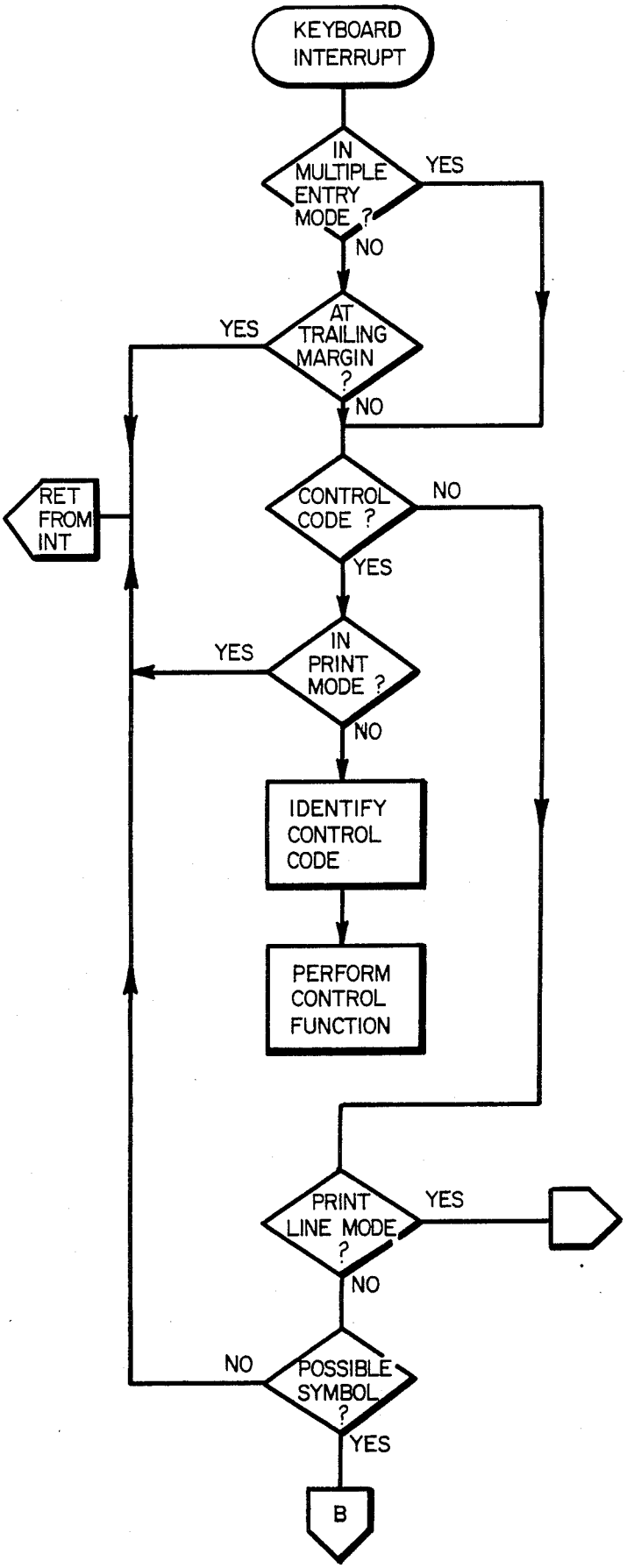

When a key on the keyboard is actuated, the coded signal 106 from keyboard 66 is produced and sensed by PIA 94 or 294, which produces an interrupt signal 108 or 208. When an interrupt signal 108 or 208 is produced, an interrupt routine is initiated. FIG. 17 is a keyboard interrupt flowchart for the first disclosed embodiment.

As shown, the system checks to determine if the multiple entry mode has been selected. If not, characters are being printed as entered. Therefore, the position of the table 22 is checked to determine whether it is at the trailing margin position, i.e., at the end of a line. If it is, the keyboard character is not immediately accepted. When the table 22 is not at the end of a line, or when the system is in the multiple entry mode (no printing), the keyboard data is processed.

If that data is a control code, the control function is identified and implemented unless the system is in a print mode, in which case the printing or marking operation is first completed. If the data is not a control code, the system determines if it is a print line control. If so it initiates that function. If not, it checks to determine if it is a possible character. If not a possible character, the data is ignored, and the system returns to perform the functions it was doing before receiving the interrupt signal 108.

If the keyboard data is a possible character, the system checks to see if the data represents a character or symbol on the marking wheel 30 being used (FIG. 8). Before checking the character, it is necessary to determine if the system is in the print cycle, if the available memory is full, and if the line is full. If any of those conditions exist, nothing further is done.

Otherwise, the system compares the input data with a table of symbols representing those on the wheel 30 being used. If a symbol corresponding to the input data is not located, the data is ignored. if a symbol corresponding to the input data is identified, it is stored and displayed. Once again a determination is made if the memory and the line are full, and if so, a corresponding flag is set for use during later cycles of the system. When the data is accepted, a print flag is set unless the system is in the multiple entry mode.

Figure 19:
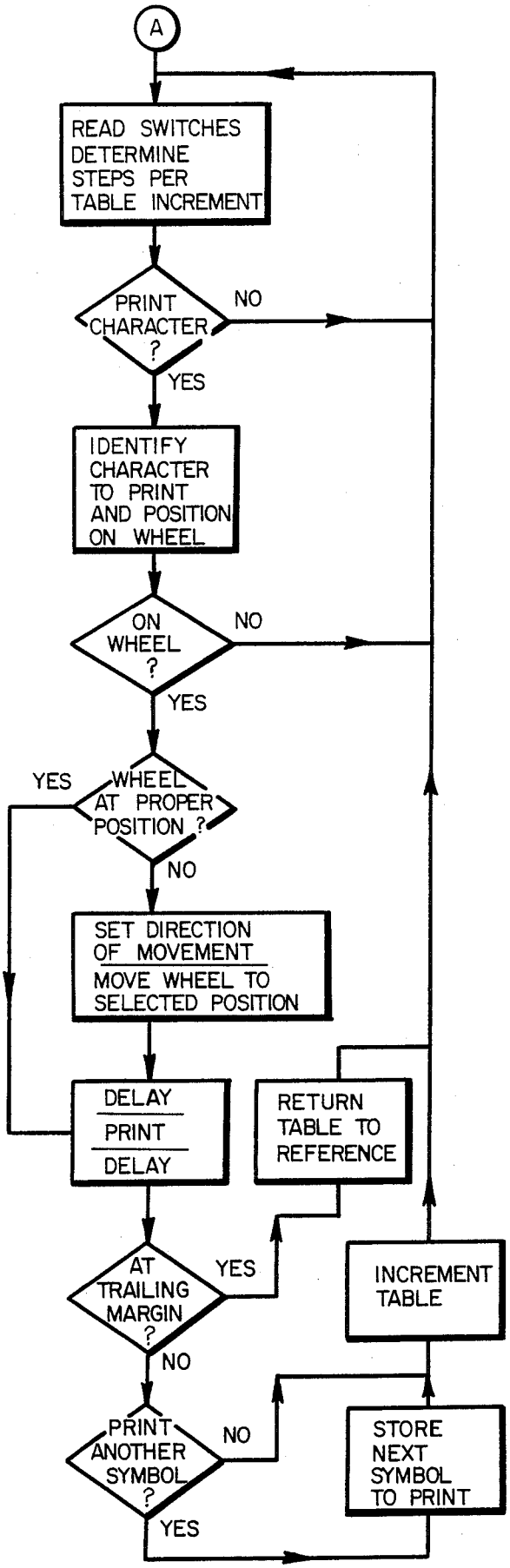

As shown in FIG. 19, when the interrupt routine is completed, when there is no keyboard data, the system is in its print check operation. In this condition, the increment switches 104 are sensed and the number of steps per table increment are determined. If a character is to be printed, it is identified, and its position on the marking wheel 30 is determined. If it is on the wheel 30, its position is compared to the present wheel position to determine whether the wheel must be moved to another position.

If the wheel 30 is to be moved, the shortest direction of rotation is identified, and the wheel 30 is rotated until it is in proper position. This determination is made internally of the system which continuously stores data representing the present position of the wheel 30, and compares that data with the desired position of the wheel 30. The only time the sensing aperture on disk 42 is used is when the wheel 30 is returned to its reference position, e.g., at the end of each line. The use of the output from optical sensor 44 at this time is to minimize the possibility of accumulated error in the wheel position data, since it is reset every time the wheel 30 is returned to its reference position.

When the wheel 30 is in proper position, the solenoid 102 is energized, after an initial delay to insure the wheel 30 has stopped. After marking, there is another delay to preclude the table 22 from being incremented until after marking is completed. The table 22 is then incremented, unless it is at the end of the line, in which case it is returned to its reference or start position. If another character is to be printed, that information is stored so the next time through the print check cycle printing will occur.

As indicated above, when control data is identified, the control function is implemented. The system of the present invention incorporates a number of such control functions, including multiple entry mode, clear trailing margin code, set trailing margin mode, backspace table mode, print entire line enable mode, advance the table one increment mode, return the table to start position mode, clear the memory of all data mode, and print an entire line mode.

When the multiple entry mode is selected, the system sets the multiple entry flag. This allows the entry of a whole line of characters, and even a number of lines, without printing or marking. When all the data is entered, the print entire line enable mode clears the multiple entry flag and sets the print flag. The print entire line mode causes the system to print the characters previously entered, a line at a time. This function also clears the print flag when all symbols have been printed, returning the system to its normal mode in which it prints a single character at a time as the keyboard is operated. The other operational codes perform the operations as indicated.

A program implementing the functions of the control system incorporating the present invention is set forth below.

```
LOCATION OBJECT CODE LINE     SOURCE LINE

                     224
                     225
                     226
                     227 ;*********** POWER UP START OF PROGRAM ******************************************
                     228         ORG       0E000H
     E000 0F         229 PWRUP   SEI
     E001 8638       230         LDA A     #38H
     E003 B7B04D     231         STA A     PAC              ;PIA  CA2 HIGH-INT OFF-DATA DIR REG
     E006 8638       232         LDA A     #38H
     E008 B7B04F     233         STA A     PBC              ;PIA  CB2-HIGH-INT OFF-DATA DIR REG
     E00B 8613       234         LDA A     #13H
     E00D B79000     235         STA A     RS232C           ;ACIA T INT OFF-R INT OFF-8BITS 2STOP-RESET
     E010 8E8FFF     236         LDS       #0FFFH           ;SET  STACK
                     237
                     238
                     239 ;************ TEST RAM ***********************************************************
                     240 ;                                  RAM IS TESTED BY SHIFTING A SINGLE HIGH BIT
                     241 ;                                  THROUGH EVERY RAM ADDRESS. AFTER EACH ADDRESS
                     242 ;                                  HAS BEEN TESTED IT IS THEN CLEARED.
                     243
     E013 8601       244         LDA A     #01H             ;FIRST TEST VALUE
     E015 CE8000     245         LDX       #RAM             ;INDEX=STARTING ADDRESS OF RAM
     E018 A700       246 NEXPOS  STA A     00H,X
     E01A C602       247         LDA B     #02H             ;DATA SETTLING TIME
     E01C 5A         248         DEC B
     E01D 26FD       249         BNE       *-1
     E01F E600       250         LDA B     00H,X            ;B=RETRIEVED DATA FROM RAM
     E021 11         251         CBA                        ;CHECK IF STORED AND RETRIEVED DATA SAME
     E022 26DC       252         BNE       PWRUP            ;Z=0 IF NOT SAME
     E024 48         253         ASL A                      ;SHIFT TEST BIT
     E025 24F1       254         BCC       NEXPOS           ;CHECK IF BIT SHIFTED THROUGH ENTIRE BYTE
     E027 A700       255         STA A     00H,X            ;CLEAR ADDRESS
     E029 4C         256         INC A                      ;STARTING TEST VALUE
     E02A 08         257         INX                        ;NEXT ADDRESS
     E02B 8C9000     258         CPX       #RAM+1000H       ;CHECK IF ENTIRE RAM TESTED
     E02E 26E8       259         BNE       NEXPOS           ;Z=0 IF NOT ALL TESTED
     E030 BDE197     260         JSR       CLRBUF           ;SET BUFFER TO ASCII SPACES
     E033 7EE040     261         JMP       CONTIN
                     262
                     263
     E036 CEB04C     264 PIATST  LDX       #PAD             ;TEST PIA-A
     E039 BDE144     265         JSR       TEST1            ;CONTROL REG TEST
     E03C BDE173     266         JSR       TEST2            ;DATA DIRECTION REG TEST
     E03F CEB04E     267         LDX       #PBD
     E042 BDE144     268         JSR       TEST1
     E045 BDE173     269         JSR       TEST2
     E048 8691       270 CONTIN  LDA A     #91H
     E04A B79000     271         STA A     RS232C           ;R INT ON-T INT OFF-8BIT 2STOP-DIV 16
     E040 4F         272         CLR A
     E04E B7B04C     273         STA A     PAD              ;PIA-A SET AS INPUTS
```

```
E051 86F0        274        LDA A    #0F0H
E053 B7B04E      275        STA A    PBD          ;PIA-B SET AS b0-b3 INPUTS AND b4-b7 OUTPUTS
E056 8634        276        LDA A    #34H
E058 B7B04F      277        STA A    PBC          ;PIA CB2 LOW-INT OFF-OUT REG
E05B 863D        278        LDA A    #3DH
E05D B7B04D      279        STA A    PAC          ;PIA CA2 HIGH-INT ON H/L-OUT REG
E060 8670        280        LDA A    #70H
E062 B7B04E      281        STA A    PBD          ;SET OUTPUT LINES
                 282
                 283
                 284 ;************ READ PC SWITCH SETTINGS ******************************************
E065 8660        285        LDA A    #60H
E067 B7B04E      286        STA A    PBD          ;PC SWITCH STROBE SET HIGH
E06A C606        287        LDA B    #06H         ;SETTLING TIME
E06C 5A          288        DEC B
E06D 26FD        289        BNE      *-1
E06F B6B04C      290        LDA A    PAD          ;READ 8 SELECTION SWITCH SETTINGS
E072 B78003      291        STA A    SB1
E075 B6B04E      292        LDA A    PBD          ;READ 4 SELECTION SWITCH SETTINGS
E078 840F        293        AND A    #0FH         ;MASK OUT UNUSED BITS
E07A B78004      294        STA A    SB2
E07D 86F0        295        LDA A    #0F0H
E07F B7B04E      296        STA A    PBD          ;TURN PC SWITCH STROBE OFF
                 297
                 298
E082 8603        299        LDA A    #03H         ;INITIALIZE MOTOR PHASES
E084 B78001      300        STA A    MOT1
E087 B78000      301        STA A    MOT2
E08A B78003      302        STA A    MOT3
E08D BDE1A5      303        JSR      ZERW         ;TO INDEX WHEEL MOTOR ROUTINE
E090 BDE1D5      304        JSR      ZERT         ;TO INDEX TABLE MOTOR ROUTINE
E093 B68003      305        LDA A    SB1          ;A=8 SELECTION PC SWITCH SETTINGS
E096 8401        306        AND A    #01H         ;ISOLATE BIT INDICATING IF HOLDER OPTION OPERATIONAL
E098 2703        307        BEQ      *+5          ;Z=0 IF NOT OPERATIONAL
E09A BDE236      308        JSR      ZERH         ;TO INDEX HOLDER MOTOR ROUTINE
E09D CE8040      309        LDX      #8040H
E0A0 FF8008      310        STX      NCTP         ;INITIALIZE "NEXT CHARACTER TO PRINT" POINTER
E0A3 CE8040      311        LDX      #8040H
E0A6 FF800A      312        STX      NCE          ;INITIALIZE "NEXT CHARACTER ENTRY" POINTER
E0A9 CE0000      313        LDX      #0000H
E0AC FF800C      314        STX      NUMCP        ;INITIALIZE "NUMBER OF CHARACTERS TO PRINT" VALUE
E0AF 860F        315        LDA A    #0FH
E0B1 B78005      316        STA A    RAM#5        ;INITIALIZE X MOTION SWITCH SETTING
E0B4 B78006      317        STA A    RAM#6        ;INITIALIZE Y MOTION SWITCH SETTING
E0B7 4F          318        CLR A
E0B8 B78024      319        STA A    SRNSRT
E0BB B78025      320        STA A    SRNLIN
                 321        JSR      MVSWIT       ;READ IN VARIABLE MOTION SWITCH SETTINGS
E0BE BDE18D      322        JSR      CLRINT       ;CLEAR ALL PENDING INTERUPTS
E0C1 0E          323        CLI
                 324
                 325
```

```
                326 ;************ CHECK TO SEE IF A CHARACTER NEEDS TO BE PRINTED **********************
E0C2 FE8F40     327 PNTCHK LDX      WDOGT          ;INDEX=WATCHDOG TIMER VALUE
E0C5 2706       328        BEQ      BPT75          ;Z=1 IF TIMER NOT ACTIVE
E0C7 09         329        DEX
E0C8 FF8F40     330        STX      WDOGT
E0CB 2093       331        BRA      $+5
E0CD 7F8035     332 BPT75  CLR      RAM+35H
E0D0 B6800F     333        LDA A    TPOS           ;A=TABLE POSITION VALUE
E0D3 8101       334        CMP A    #01H           ;CHECK IF AT LEFT MARGIN
E0D5 2611       335        BNE      BPT35          ;Z=0 IF NOT AT MARGIN
E0D7 B68003     336        LDA A    SW1            ;A=PC SWITCH BANK #1 SETTINGS
E0DA 8401       337        AND A    #01H           ;CHECK IF HOLDER OPTION ACTIVE
E0DC 2707       338        BEQ      $+9            ;Z=1 IF OPTION NOT ACTIVE
E0DE B68010     339        LDA A    HPOS           ;A=HOLDER POSITION VALUE
E0E1 8101       340        CMP A    #01H
E0E3 2603       341        BNE      BPT35          ;Z=0 IF NOT AT INDEXED POSITION
E0E5 BDE2A7     342        JSR      MVSWCF         ;READ VARIABLE MOTION SWITCH SETTINGS
E0E8 FE800C     343 BPT35  LDX      NUMCP          ;INDEX=NUMBER OF CHARACTERS TO PRINT
E0EB 2607       344        BNE      $+9            ;Z=0 IF CHARACTER TO PRINT
E0ED B68034     345        LDA A    RAM+34H        ;A=CONTROL CODE COMMAND FLAG
E0F0 2700       346        BEQ      PNTCHK         ;Z=1 IF NO CONTROL CODE ENTERED
E0F2 2030       347        BRA      BPT96
E0F4 868030     348        LDA A    ABORT          ;A=ABORT PRINT FLAG
E0F7 2701       349        BEQ      $+3            ;Z=1 IF NO ABORT COMMAND
E0F9 3F         350        SWI                     ;VECTOR TO ABORT ROUTINE
E0FA FE8008     351        LDX      NCTP           ;INDEX=ADDRESS OF NEXT CHARACTER TO PRINT
E0FD A600       352        LDA A    00H,X          ;A=CHARACTER CODE TO BE PRINTED
E0FF 08         353        INX
E100 FF8008     354        STX      NCTP           ;STORE NEW ADDRESS OF NEXT CHARACTER TO PRINT
E103 4D         355        TST A
E104 2A02       356        BPL      $+4            ;N=0 IF CODE THAT OF A PRINTABLE CHARACTER
E106 8620       357        LDA A    #20H           ;A=SPACE CODE
E108 8120       358        CMP A    #20H           ;CHECK IF CODE IS FOR A SPACE
E10A 270C       359        BEQ      BPT14          ;Z=1 IF CODE IS FOR A SPACE
E10C BDE5E9     360        JSR      DIRDET         ;TO DETERMINE MOTOR PULSES AND DIRECTION THEN MOVE WHEEL
E10F BDE712     361        JSR      TIM1           ;WHEEL SETTLING DELAY
E112 BDE6FB     362        JSR      PRNT           ;START PRINT SEQUENCE
E115 BDE719     363        JSR      TIM2           ;PRINT SEQUENCE TIME DELAY
E118 C6FF       364 BPT14  LDA B    #0FFH          ;CCW MOTION INCREMENTOR
E11A BDE665     365        JSR      MOVTAB         ;MOVE TABLE APPROPRIATE AMOUNT
E11D FE800C     366        LDX      NUMCP          ;INDEX=NUMBER OF CHARACTERS TO PRINT
E120 09         367        DEX
E121 FF800C     368        STX      NUMCP
E124 B68024     369 BPT96  LDA A    SRNSRT
E127 2605       370        BNE      BPT95
E129 868025     371        LDA A    SRNLIN
E12C 2710       372        BEQ      BPT98
E12E B68018     373 BPT95  LDA A    CXP
E131 B18021     374        CMP A    CURRHT
E134 2705       375        BEQ      BPT97
E136 B18020     376        CMP A    CURLFT
E139 2603       377        BNE      BPT98
```

```
E13B BDF7B0        378 BPT99  JSR      LDSRN
E13E 7F8033        379 BPT98  CLR      RAM+33H        ;CLEAR CHARACTER ENTERED FLAG
E141 7EF0C2        380        JMP      PNTCHK         ;Z=1 IF FLAG NOT SET
                   381
                   382
                   383 ;************ PIA CONTROL REG TEST ***********************************************
E144 A601          384 TEST1  LDA A    01H,X
E146 8A03          385        ORA A    #03H
E148 A701          386        STA A    01H,X
E14A C604          387        LDA B    #04H
E14C 5A            388        DEC B
E14D 26FD          389        BNE      $-1
E14F E601          390        LDA B    01H,X
E151 C4BF          391        AND B    #0BFH
E153 11            392        CBA
E154 2705          393        BEQ      $+7
E156 32            394        PUL A
E157 32            395        PUL A
E158 7EF036        396        JMP      PIATST         ;RETRY PIA TEST
E15B 84F0          397        AND A    #0F0H
E15D 8A06          398        ORA A    #06H
E15F A701          399        STA A    01H,X
E161 C604          400        LDA B    #04H
E163 5A            401        DEC B
E164 26FD          402        BNE      $-1
E166 E601          403        LDA B    01H,X
E168 C4BF          404        AND B    #0BFH
E16A 11            405        CBA
E16B 2705          406        BEQ      $+7
E16D 32            407        PUL A
E16E 32            408        PUL A
E16F 7EF036        409        JMP      PIATST         ;RETRY PIA TEST
E172 39            410        RTS
                   411
                   412
                   413 ;************ PIA DATA DIRECTION REG TEST ****************************************
E173 8630          414 TEST2  LDA A    #30H
E175 A701          415        STA A    01H,X
E177 4F            416        CLR A
E178 A700          417 BPT1   STA A    00H,X
E17A C604          418        LDA B    #04H           ;DATA SETTLING TIME
E17C 5A            419        DEC B
E17D 26FD          420        BNE      $-1
E17F E600          421        LDA B    00H,X          ;RETREIVE DATA
E181 11            422        CBA                     ;CHECK IF STORED AND RETREIVED DATA SAME
E182 2705          423        BEQ      $+7
E184 32            424        PUL A
E185 32            425        PUL A
E186 7EF036        426        JMP      PIATST         ;RETRY PIA TEST
E189 4C            427        INC A
E18A 26EC          428        BNE      BPT1
E18C 39            429        RTS
```

```
                 ;************ CLEAR ALL PENDING INTERUPTS ****************************************
E18D B6B04C      CLRINT LDA A    PA0          ;READ OUTPUT REG TO CLEAR FLAG
E190 B6B04F              LDA A    PB0          ;READ OUTPUT REG TO CLEAR FLAG
E193 B67001              LDA A    RS232I       ;READ REC DATA REG TO CLEAR FLAG
E196 39                  RTS

                 ;************ SET BUFFER WITH ALL-SPACES *****************************************
E197 CE8040      CLRBUF LDX       #8040H
E19A 8620                LDA A    #20H
E19C A700                STA A    00H,X
E19E 08                  INX
E19F 8C8F40              CPX      #8F40H
E1A2 26F8                BNE      $-6
E1A4 39                  RTS

                 ;************ INDEX WHEEL MOTOR ROUTINE ******************************************
E1A5 C605        ZERW   LDA B     #05H
E1A7 5A          ZERW1  DEC B
E1A8 2707                BEQ      ZERW2
E1AA 37                  PSH B
E1AB BDE1C3              JSR      BPT2
E1AE 33                  PUL B
E1AF 20F6                BRA      ZERW1
E1B1 B6B04E      ZERW2  LDA A     PB0          ;A=PIA-B OUTPUT REG
E1B4 8401                AND A    #01H         ;ISOLATE SENSOR BIT
E1B6 2705                BEQ      $+7          ;Z=1 IF INDEXED
E1B8 BDE1C3              JSR      BPT2
E1BB 20F4                BRA      ZERW2
E1BD 8601                LDA A    #01H
E1BF B78008              STA A    WPOS
E1C2 39                  RTS
E1C3 C601        BPT2   LDA B     #01H         ;CW MOTION INCREMENTOR
E1C5 CE8000              LDX      #RAM+0       ;INDEX=ADDRESS OF PULSE CODE
E1C8 BDE286              JSR      MOVMOT       ;TO DETERMINE MOTOR PHASE LEVELS
E1CB B78001              STA A    MOT1         ;OUTPUT TO MOTOR LATCH
E1CE CE0140              LDX      #0140H
E1D1 09                  DEX
E1D2 26FD                BNE      $-1
E1D4 39                  RTS

                 ;************ INDEX TABLE MOTOR ROUTINE ******************************************
E1D5 B6B04E      ZERT   LDA A     PB0          ;A=PIA-B OUTPUT REG
E1D8 8402                AND A    #02H         ;ISOLATE SENSOR BIT
E1DA 2647                BNE      BPT3         ;Z=1 IF INDEXED
E1DC 8603                LDA A    #03H
E1DE 36          BPT3A  PSH A
E1DF C6FF                LDA B    #0FFH        ;CCW MOTION INCREMENTOR
```

```
E1E1 CE8001        482          LDX      #RAM+1          ;INDEX=ADDRESS OF PULSE CODE
E1E4 BDE286        483          JSR      MOVMOT          ;TO DETERMINE MOTOR PHASE LEVELS
E1E7 B78000        484          STA A    MOT2            ;OUTPUT TO MOTOR LATCH
E1EA CE0B80        485          LDX      #0B80H
E1ED 09            486          DEX
E1EE 26FD          487          BNE      $-1
E1F0 32            488          PUL A
E1F1 4A            489          DEC A
E1F2 26EA          490          BNE      BPT3A
E1F4 B6B04E        491          LDA A    PB0             ;A=PIA-B OUTPUT REG
E1F7 8402          492          AND A    #02H            ;ISOLATE SENSOR BIT
E1F9 2604          493          BNE      BPT3B           ;Z=1 IF NOT UNINDEXED
E1FB 8601          494          LDA A    #01H
E1FD 20DF          495          BRA      BPT3A
E1FF C601          496 BPT3B    LDA B    #01H            ;CW MOTION INCREMENTOR
E201 CE8001        497          LDX      #RAM+1          ;INDEX=ADDRESS OF PULSE CODE
E204 BDE286        498          JSR      MOVMOT          ;TO DETERMINE MOTOR PHASE LEVELS
E207 B7B000        499          STA A    MOT2            ;OUTPUT TO MOTOR LATCH
E20A CE0B80        500          LDX      #0B80H
E20D 09            501          DEX
E20E 26FD          502          BNE      $-1
E210 B6B04E        503          LDA A    PB0             ;A=PIA-B OUTPUT REG
E213 8402          504          AND A    #02H            ;ISOLATE SENSOR BIT
E215 26FB          505          BNE      BPT3B           ;Z=1 IF INDEXED
E217 8601          506          LDA A    #01H
E219 B7800F        507          STA A    TPOS            ;INITIALIZE TABLE POSITION VALUE
E21C CE1000        508          LDX      #1000H
E21F 09            509          DEX
E220 26FD          510          BNE      $-1
E222 39            511          RTS
E223 C601          512 BPT3     LDA B    #01H            ;CW MOTION INCREMENTOR
E225 CE8001        513          LDX      #RAM+1          ;INDEX=ADDRESS OF PULSE CODE
E228 BDE286        514          JSR      MOVMOT          ;TO DETERMINE MOTOR PHASE LEVELS
E22B B78000        515          STA A    MOT2            ;OUTPUT TO MOTOR LATCH
E22E CE0200        516          LDX      #0200H
E231 09            517          DEX
E232 26FD          518          BNE      $-1
E234 209F          519          BRA      ZERT
                   520
                   521
                   522 ;************ INDEX HOLDER MOTOR ROUTINE ****************************************
E236 B6B04E        523 ZERH     LDA A    PB0             ;A=PIA-B OUTPUT REG
E239 8404          524          AND A    #04H            ;ISOLATE SENSOR BIT
E23B 2636          525          BNE      BPT4            ;Z=0 IF NOT INDEXED
E23D C6FF          526 BPT4A    LDA B    #0FFH           ;CCW MOTION INCREMENTOR
E23F CE8002        527          LDX      #RAM+2          ;INDEX=ADDRESS OF PULSE CODE
E242 BDE286        528          JSR      MOVMOT          ;TO DETERMINE MOTOR PHASE LEVELS
E245 B78003        529          STA A    MOT3            ;OUTPUT TO MOTOR LATCH
E248 CE0400        530          LDX      #0400H
E24B 09            531          DEX
E24C 26FD          532          BNE      $-1
E24E B6B04E        533          LDA A    PB0             ;A=PIA-B OUTPUT REG
```

```
E251 8404        534          AND A    #04H          ;ISOLATE SENSOR BIT
E253 27E8        535          BEQ      BPT4A         ;Z=1 IF NOT UNINDEXED
E255 C601        536 BPT4B    LDA B    #01H          ;CW MOTION INCREMENTOR
E257 CE8002      537          LDX      #RAM+2        ;INDEX=ADDRESS OF PULSE CODE
E25A BDE286      538          JSR      MOVMOT        ;TO DETERMINE MOTOR PHASE LEVELS
E250 B78003      539          STA A    MOT3          ;OUTPUT TO MOTOR LATCH
E260 CE0400      540          LDX      #0400H
E263 09          541          DEX
E264 26FD        542          BNE      $-1
E266 B6804E      543          LDA A    P80           ;A=PIA-8 OUTPUT REG
E269 8404        544          AND A    #04H          ;ISOLATE SENSOR BIT
E268 26E8        545          BNE      BPT4B         ;Z=0 IF NOT INDEXED
E26D 8601        546          LDA A    #01H
E26F B78010      547          STA A    HPOS          ;INITIALIZE HOLDER POSITION VALUE
E272 39          548          RTS
E273 C601        549 BPT4     LDA B    #01H          ;CW MOTION INCREMENTOR
E275 CE8002      550          LDX      #RAM+2        ;INDEX=ADDRESS OF PULSE CODE
E278 BDE286      551          JSR      MOVMOT        ;TO DETERMINE MOTOR PHASE LEVELS
E278 B78003      552          STA A    MOT3          ;OUTPUT TO MOTOR LATCH
E27F CE0300      553          LDX      #0300H
E281 09          554          DEX
E282 26FD        555          BNE      $-1
E284 2080        556          BRA      ZERH
                 557
                 558
                 559 ;************ DETERMINE PHASE LEVELS FROM PULSE CODES ****************************
E286 A600        560 MOVMOT LDA A      00H,X         ;B=MOTOR PULSE CODE
E288 1B          561          ABA                    ;COMBINE PULSE CODE WITH INCREMENTOR
E289 8104        562          CMP A    #04H          ;CHECK IF PULSE CODE WAS AT MAX VALUE
E28B 2601        563          BNE      $+3           ;Z=0 IF NOT AT MAX VALUE
E28D 4F          564          CLR A
E28E 81FF        565          CMP A    #0FFH         ;CHECK IF PULSE CODE WAS AT MIN VALUE
E290 2602        566          BNE      $+4           ;Z=0 IF NOT AT MIN VALUE
E292 8603        567          LDA A    #03H
E294 A700        568          STA A    00H,X         ;STORE NEW PULSE CODE
E296 CE2A3       569          LDX      #MSEQ         ;INDEX=ADDRESS OF MOTOR PHASE SEQUENCE TABLE
E299 4D          570          TST A
E29A 2704        571          BEQ      $+6           ;Z=1 IF A=0
E29C 08          572          INX
E29D 4A          573          DEC A
E29E 20F9        574          BRA      $-5
E2A0 A600        575          LDA A    00H,X         ;A=MOTOR PHASE LEVELS
E2A2 39          576          RTS
                 577
                 578
                 579 ;************ MOTOR PULSE SEQUENCE TABLE ****************************************
E2A3 03          580 MSEQ     FCB      03H           ;CORRESPONDS TO PULSE CODE 0
E2A4 01          581          FCB      01H           ;CORRESPONDS TO PULSE CODE 1
E2A5 00          582          FCB      00H           ;CORRESPONDS TO PULSE CODE 2
E2A6 02          583          FCB      02H           ;CORRESPONDS TO PULSE CODE 3
                 584
                 585
```

```
                ;************ READ VARIABLE MOTION SWITCHES ****************************************
E2A7 B68035     MVSWIT LDA A   RAM+35H        ;CHECK IF DETERMINATION ALREADY IN PROGRESS
E2AA 2640               BNE    BPT59          ;Z=0 IF ALREADY IN PROGRESS
E2AC 8650               LDA A  #50H
E2AE 5F                 CLR B
E2AF B7B04F             STA A  PBO            ;X POSITION SWITCH STROBE SET
E2B2 8604               LDA A  #04H           ;SETTLING TIME
E2B4 4A                 DEC A
E2B5 26FD               BNE    *-1
E2B7 B6B04E             LDA A  PBO            ;A=PIA-B OUTPUT REG
E2BA 8407               AND A  #07H           ;ISOLATE X POSITION SWITCH BITS
E2BC B18005             CMP A  RAM+5          ;CHECK IF NEW SWITCH READING IS SAME AS LAST READING
E2BF 2602               BNE    *+4            ;Z=0 IF NOT SAME
E2C1 C601               LDA B  #01H
E2C3 B78005             STA A  RAM+5          ;STORE SWITCH SETTING
E2C6 B7B02F             STA A  RAM+2FH
E2C9 8630               LDA A  #30H
E2CB B7B04F             STA A  PBO            ;Y POSITION SWITCH STROBE SET
E2CE 8604               LDA A  #04H           ;SETTLING TIME
E2D0 4A                 DEC A
E2D1 26FD               BNE    *-1
E2D3 B6B04E             LDA A  PBO            ;A=PIA-B OUTPUT REG
E2D6 8407               AND A  #07H           ;ISOLATE Y POSITION SWITCH BITS
E2D8 B18006             CMP A  RAM+6          ;CHECK IF NEW SWITCH READING IS SAME AS LAST READING
E2DB 2709               BEQ    *+11           ;Z=0 IF SAME
E2DD B78006             STA A  RAM+6          ;STORE SWITCH SETTING
E2E0 B7B02F             STA A  RAM+2FH
E2E3 7EE2F2             JMP    FINSET         ;DETERMINE FINAL SWITCH SETTING VALUE
E2E6 5D                 TST B
E2E7 2603               BNE    *+5            ;Z=0 IF BOTH READINGS THE SAME
E2E9 7EE2F2             JMP    FINSET
E2EC 86F0       BPT59   LDA A  #0F0H
E2EE B7B04E             STA A  PBO            ;ENABLE SENSOR INPUTS
E2F1 39                 RTS


                ;************ DETERMINE FINAL SWITCH SETTING VALUE ***********************************
E2F2 8601       FINSET  LDA A  #01H
E2F4 B78035             STA A  RAM+35H        ;SET SWITCH SETTINGS IN PROGRESS FLAG
E2F7 CEFF00             LDX    #0FF00H        ;WATCHDOG TIMER VALUE
E2FA FFBF40             STX    WDOGT
E2FD B68003             LDA A  S01            ;A=PC SWITCH BANK #1
E300 8404               AND A  #04H           ;CHECK ON FULL DUPLEX SWITCH SETTING
E302 2718               BEQ    BPT28          ;Z=1 IF NOT IN FULL DUPLEX MODE
E304 C618               LDA B  #18H           ;COMMAND CODE FOR TRANSMISSION OF SWITCH SETTINGS(CONTROL X)
E306 BDE77E             JSR    OT232
E309 B68005             LDA A  RAM+5          ;A=X SWITCH SETTING
E30C 840F               AND A  #0FH           ;ISOLATE SWITCH BITS
E30E F68006             LDA B  RAM+6
E311 58                 ASL B
E312 58                 ASL B
E313 58                 ASL B
```

```
E314 58          638          ASL B
E315 C4F0        639          AND B    #0F0H          ;ISOLATE SWITCH BITS
E317 18          640          ABA
E318 16          641          TAB
E319 7EE77E      642          JMP      0F232
E31C B6802E      643 BPT28    LDA A    RAM+2EH        ;FINAL X SWITCH SETTING VALUE
E31F CEE393      644          LDX      #INXVTAB       ;INDEX-TABLE ADDRESS OF X MOTION END VALUES
E322 4D          645          TST A
E323 2704        646          BEQ      $+6
E325 4A          647          DEC A
E326 08          648          INX
E327 20F9        649          BRA      $-5
E329 A600        650          LDA A    00H,X          ;B-TABLE END VALUE
E32B B78011      651          STA A    TEV
E32E B6802F      652          LDA A    RAM+2FH        ;FINAL Y SWITCH SETTING VALUE
E331 CEE39B      653          LDX      #INXVTAB       ;INDEX-TABLE ADDRESS OF Y MOTION END VALUES
E334 4D          654          TST A
E335 2704        655          BEQ      $+6
E337 4A          656          DEC A
E338 08          657          INX
E339 20F9        658          BRA      $-5
E33B E600        659          LDA B    00H,X          ;B-HOLDER END VALUE
E33D F78012      660          STA B    HEV
E340 CE0000      661          LDX      #0000H
E343 FF801C      662          STX      RAM+1CH
E346 B68003      663          LDA A    SB1            ;A=B SELECTION PC SWITCH SETTINGS
E349 8401        664          AND A    #01H           ;ISOLATE HOLDER OPTION BIT
E34B 2604        665          BNE      $+6            ;Z=0 IF OPTION ACTIVE
E34D C601        666          LDA B    #01H
E34F 2003        667          BRA      BPT27
E351 F68012      668          LDA B    HEV            ;B=HOLDER END VALUE(# OF LINES USABLE)
E354 B6801D      669 BPT27    LDA A    RAM+1DH
E357 0C          670          CLC
E358 BB8011      671          ADD A    TEV            ;ADD TABLE END VALUE
E35B 2403        672          BCC      $+5            ;IF CARRY CLEAR
E35D 7C801C      673          INC      RAM+1CH
E360 B7801D      674          STA A    RAM+1DH
E363 5A          675          DEC B
E364 26EE        676          BNE      BPT27
E366 B6801D      677          LDA A    RAM+1DH
E369 0C          678          CLC
E36A 8B40        679          ADD A    #40H
E36C 2403        680          BCC      $+5            ;IF CARRY CLEAR
E36E 7C801C      681          INC      RAM+1CH
E371 B7801D      682          STA A    RAM+1DH        ;RAM+1CH=MAXIMUM CHARACTERS THAT CAN BE ENTERED
E374 B6801C      683          LDA A    RAM+1CH
E377 8A80        684          ORA A    #80H
E379 B7801C      685          STA A    RAM+1CH
E37C B68003      686          LDA A    SB1
E37F 8404        687          AND A    #04H
E381 2603        688          BNE      $+5
E383 BDE775      689          JSR      CLRSRN         ;CLEAR SCREEN
```

```
E386 BDE197        690        JSR      CLRBUF          ;SET BUFFER MEMORY TO ASCII SPACES
E389 BDE720        691        JSR      CURLIM          ;DEFINE CURSOR LIMITS
E38C BDF912        692        JSR      CLRAT           ;CLEAR ALL TABS
E38F 7F8035        693        CLR      RAM+35H         ;RESET DETERMINATION IN PROGRESS FLAG
E392 39            694        RTS
                   695
                   696
                   697 ;************ TABLE MOTION END VALUES (1/16-9/32 BY 1/32'S) ************************
E393 60            698 TEVTA8 FCB      60H             ;96 CHARACTERS FOR A SWITCH SETTING OF 0
E394 40            699        FCB      40H             ;64 CHARACTERS FOR A SWITCH SETTING OF 1
E395 30            700        FCB      30H             ;48 CHARACTERS FOR A SWITCH SETTING OF 2
E396 26            701        FCB      26H             ;38 CHARACTERS FOR A SWITCH SETTING OF 3
E397 20            702        FCB      20H             ;32 CHARACTERS FOR A SWITCH SETTING OF 4
E398 1B            703        FCB      1BH             ;27 CHARACTERS FOR A SWITCH SETTING OF 5
E399 18            704        FCB      18H             ;24 CHARACTERS FOR A SWITCH SETTING OF 6
E39A 15            705        FCB      15H             ;21 CHARACTERS FOR A SWITCH SETTING OF 7
                   706
                   707
                   708 ;************ HOLDER MOTION END VALUES (1/16-9/32 BY 1/32'S) ************************
E39B 28            709 HEVTA8 FCB      28H             ;40 LINES FOR A SWITCH SETTING OF 0
E39C 1C            710        FCB      1CH             ;28 LINES FOR A SWITCH SETTING OF 1
E39D 15            711        FCB      15H             ;21 LINES FOR A SWITCH SETTING OF 2
E39E 11            712        FCB      11H             ;17 LINES FOR A SWITCH SETTING OF 3
E39F 0E            713        FCB      0EH             ;14 LINES FOR A SWITCH SETTING OF 4
E3A0 0C            714        FCB      0CH             ;12 LINES FOR A SWITCH SETTING OF 5
E3A1 0B            715        FCB      0BH             ;11 LINES FOR A SWITCH SETTING OF 6
E3A2 0A            716        FCB      0AH             ;10 LINES FOR A SWITCH SETTING OF 7
                   717
                   718
                   719 ;************ INTERUPT DETERMINATION ROUTINE ****************************************
E3A3 B6804E        720 IRQ    LDA A    PBO
E3A6 B78015        721        STA A    RAM+15H         ;SAVE PIA-B OUTPUT REG VALUE
E3A9 86F0          722        LDA A    #0F0H
E3AB B7804E        723        STA A    PBO             ;ENABLE SENSORS
E3AE B67000        724        LDA A    RS232S          ;READ ACIA STATUS REG
E3B1 8401          725        AND A    #01H            ;CHECK IF INTERUPT FROM RS232 PORT
E3B3 2706          726        BEQ      $+8             ;Z=1 IF NOT INTERUPT FROM RS232 PORT
E3B5 B69001        727        LDA A    RS232I          ;READ RECEIVED DATA BYTE
E3B8 7EE3D7        728        JMP      RSIN            ;TO RS232 INPUT ROUTINE
E3BB B6B04D        729        LDA A    PAC             ;A=PIA-A CONTROL REG
E3BE 2A08          730        BPL      $+10            ;N=0 IF NOT "A" SIDE INTERUPT
E3C0 B6B04C        731        LDA A    PAO             ;A=KEYBOARD CODE
E3C3 847F          732        AND A    #7FH            ;MASK OFF UNUSED BIT
E3C5 7EE3DA        733        JMP      KEYBD1          ;PIA-A INTERUPT ROUTINE
E3C8 B6804E        734        LDA A    PBO             ;A=PIA-B CONTROL REG
E3CB 2A03          735        BPL      $+5             ;N=0 IF NOT "B" SIDE INTERUPT
E3CD 7EE443        736        JMP      PINT8           ;PIA-B INTERUPT ROUTINE
E3D0 B68015        737        LDA A    RAM+15H
E3D3 B7804E        738        STA A    PBO
E3D6 3B            739        RTI
                   740
                   741
```

```
                 742 ;************ RS232 INPUT ROUTINE ***********************************************
E3D7 7EE3EC      743 RSIN   JMP      KEYBD2
                 744
                 745
                 746 ;************ PIA-A INTERUPT ROUTINE ********************************************
E3DA F68003      747 KEYBD1 LDA B    S01            ;B=PC SWITCH BANK #1
E3DD C404        748        AND B    #04H           ;CHECK IF DUPLEX SWITCH IS ON
E3DF 2700        749        BEQ      KEYBD2         ;Z=1 IF SWITCH OFF
E3E1 16          750        TAB
E3E2 BDF77E      751        JSR      OT232          ;TRANSMIT KEYBOARD CODE
E3E5 B68015      752        LDA A    RAM+15H
E3E8 B7804C      753        STA A    PRO
E3EB 3B          754        RTI
E3EC 16          755 KEYBD2 TAB
E3ED C460        756        AND B    #60H           ;CHECK IF INPUT IS A CONTROL CODE
E3EF 2702        757        BEQ      $+4            ;Z=1 IF CONTROL CODE
E3F1 2035        758        BRA      BPT5
E3F3 C601        759        LDA B    #01H
E3F5 F78034      760        STA B    RAM+34H        ;SET CONTROL CODE COMMAND FLAG
E3F8 8119        761        CMP A    #19H           ;CHECK IF ABORT PRINT CODE
E3FA 270C        762        BEQ      BPT5B          ;Z=1 IF ABORT CODE
E3FC FE800C      763        LDX      NUM2P          ;INDEX=NUMBER OF CHARACTERS TO PRINT
E3FF 2707        764        BEQ      BPT5B          ;Z=1 IF NO CHARACTERS LEFT TO PRINT SO CONTROL CODE ALLOWED
E401 B68015      765        LDA A    RAM+15H
E404 B7804F      766        STA A    PRO
                 767 ;      CLR      RAM+34H
E407 3B          768        RTI
E408 16          769 BPT5B  TAB
E409 C410        770        AND B    #10H           ;CHECK FOR FIRST OR SECOND BANK OF CONTROL CODES
E40B 2606        771        BNE      $+8            ;Z=0 IF PART OF SECOND BANK
E40D CEE44A      772        LDX      #CODE0         ;INDEX=ADDRESS OF FIRST 16 CONTROL CODE ROUTINE STORAGE
E410 5F          773        CLR B
E411 2005        774        BRA      $+7
E413 CEE46A      775        LDX      #CODE16        ;INDEX=ADDRESS OF SECOND 16 CONTROL CODE ROUTINE STORAGE
E416 C610        776        LDA B    #10H
E418 36          777        PSH A
E419 847F        778        AND A    #7FH           ;DROP UNUSED HIGH BIT
E41B 11          779        CBA                     ;COMPARE B TO A
E41C 2705        780        BEQ      $+7            ;Z=1 IF THEY COMPARE
E41E 08          781        INX
E41F 08          782        INX                     ;TO NEXT CONTROL CODE ROUTINE ADDRESS STORAGE
E420 5C          783        INC B
E421 20F8        784        BRA      $-6
E423 32          785        PUL A
E424 EE00        786        LDX      00H,X          ;INDEX=ADDRESS OF CONTROL CODE ROUTINE
E426 6E00        787        JMP      00H,X          ;GO TO SELECTED ROUTINE
E428 16          788 BPT5   TAB
E429 847F        789        AND A    #7FH           ;DROP UNUSED HIGH BIT
E42B 817F        790        CMP A    #7FH           ;CHECK IF CODE IS DEL CODE
E42D 2711        791        BEQ      $+19           ;Z=1 IF IS DEL CODE
E42F 16          792        TAB
E430 C460        793        AND B    #60H
```

```
E432 C160        794        CMP B    #60H          ;CHECK IF CODE IS IN USABLE CHARACTER SET
E434 2703        795        BEQ      *+5           ;Z=1 IF NOT USABLE CHARACTER
E436 7EF4CA      796        JMP      VALCHR        ;VALID CHARACTER ROUTINE
E439 B68015      797        LDA A    RAM+15H
E43C B7804E      798        STA A    PBD
E43F 3B          799        RTI
E440 7EF0DC      800        JMP      DEL
                 801
                 802
                 803 ;************ PIA-B INTERUPT ROUTINE ******************************************
E443 B68015      804 PINTB  LDA A    RAM+15H
E446 B7804F      805        STA A    PBD
E449 3B          806        RTI
                 807
                 808
                 809 ;************ CONTROL CODE ROUTINE INDEX ******************************************
E44A EA97        810 CODE0  FDB      NUL
E44C EAA1        811 CODE1  FDB      SOH           ;CONTROL A -- AUTO INCREMENT START
E44E EAD2        812 CODE2  FDB      STX           ;CONTROL B -- FIXED FIELD(SCREENED PART OF PLATE) ENTRY CODE
E450 EAE1        813 CODE3  FDB      ETX           ;CONTROL C -- CLEAR TAB
E452 EB1D        814 CODE4  FDB      EOT           ;CONTROL D -- DECREMENT AUTO INCREMENT NUMBER
E454 EB6A        815 CODE5  FDB      ENQ           ;CONTROL E -- SET ENRTY MODE
E456 EB75        816 CODE6  FDB      ACK           ;CONTROL F -- END AUTO INCREMENT ENTRY
E458 EB8C        817 CODE7  FDB      BEL           ;CONTROL G -- NON-DESTRUCTIVE HOME
E45A EB8F        818 CODE8  FDB      BS            ;CONTROL H -- BACKSPACE TABLE(CURSOR LEFT)
E45C EC14        819 CODE9  FDB      HT            ;CONTROL I -- FORWARD TABLE(CURSOR RIGHT)
E45E EC89        820 CODE10 FDB      LF            ;CONTROL J -- LINE FEED HOLDER(CURSOR DOWN)
E460 ECCD        821 CODE11 FDB      VT            ;CONTROL K -- HOLDER DOWN(CURSOR UP)
E462 ECB3        822 CODE12 FDB      FF            ;CONTROL L -- HOME(INDEX MOTORS), CLEAR BUFFER, AND CLEAR SCREEN MEMORY
E464 EE5D        823 CODE13 FDB      CR            ;CONTROL M -- CARRIAGE RETURN
E466 EF2A        824 CODE14 FDB      SO            ;CONTROL N --
E468 EF34        825 CODE15 FDB      SI            ;CONTROL O --
E46A EF3E        826 CODE16 FDB      DLE           ;CONTROL P --
E46C EF4B        827 CODE17 FDB      DC1           ;CONTROL Q --
E46E EF52        828 CODE18 FDB      DC2           ;CONTROL R -- REQUEST DISK DIRECTORY
E470 EF6C        829 CODE19 FDB      DC3           ;CONTROL S -- SET TAB
E472 EF88        830 CODE20 FDB      DC4           ;CONTROL T -- TAB
E474 EFC1        831 CODE21 FDB      NAK           ;CONTROL U --
E476 F01C        832 CODE22 FDB      SYN           ;CONTROL V -- VARIABLE FIELD(PRINTABLE DATA) ENTRY MODE
E478 F037        833 CODE23 FDB      ETB           ;CONTROL W -- REQUEST FOR SWITCH SETTINGS
E47A F051        834 CODE24 FDB      CAN           ;CONTROL X -- SWITCH SETTINGS TRANSMISSION COMMAND CODE
E47C F084        835 CODE25 FDB      EM            ;CONTROL Y -- RESET TO NORMAL TYPE/PRINT MODE
E47E F098        836 CODE26 FDB      SUB           ;CONTROL Z -- ABORT PRINT
E480 F0B1        837 CODE27 FDB      ESC           ;ESC KEY --
E482 F0B4        838 CODE28 FDB      FS            ;CONTROL/SHIFT L --
E484 F0BE        839 CODE29 FDB      GS            ;CONTROL/SHIFT M -- PRINT FINISHED CODE
E486 F0C8        840 CODE30 FDB      RS            ;CONTROL/SHIFT N --
E488 F0D2        841 CODE31 FDB      US            ;CONTROL/SHIFT O --
                 842
                 843
                 844 ;************ CHARACTER POSITION ON WHEEL TABLE ************************************
E48A FF          845 LETPOS FCB      0FFH          ;SPACE
```

```
E48B 00        846    FCB    00H        ;!
E48C 00        847    FCB    00H        ;"
E48D 00        848    FCB    00H        ;#
E48E 00        849    FCB    00H        ;$
E48F 00        850    FCB    00H        ;%
E490 1B        851    FCB    1BH        ;&
E491 00        852    FCB    00H        ;APPOSTROFEE
E492 00        853    FCB    00H        ;(
E493 00        854    FCB    00H        ;)
E494 00        855    FCB    00H        ;*
E495 00        856    FCB    00H        ;+
E496 00        857    FCB    00H        ;,
E497 27        858    FCB    27H        ;-
E498 26        859    FCB    26H        ;.
E499 28        860    FCB    28H        ;/
E49A 25        861    FCB    25H        ;0
E49B 1C        862    FCB    1CH        ;1
E49C 1D        863    FCB    1DH        ;2
E49D 1E        864    FCB    1EH        ;3
E49E 1F        865    FCB    1FH        ;4
E49F 20        866    FCB    20H        ;5
E4A0 21        867    FCB    21H        ;6
E4A1 22        868    FCB    22H        ;7
E4A2 23        869    FCB    23H        ;8
E4A3 24        870    FCB    24H        ;9
E4A4 00        871    FCB    00H        ;:
E4A5 00        872    FCB    00H        ;;
E4A6 00        873    FCB    00H        ;<
E4A7 00        874    FCB    00H        ;=
E4A8 00        875    FCB    00H        ;>
E4A9 00        876    FCB    00H        ;?
E4AA 00        877    FCB    00H        ;@
E4AB 01        878    FCB    01H        ;A
E4AC 02        879    FCB    02H        ;B
E4AD 03        880    FCB    03H        ;C
E4AE 04        881    FCB    04H        ;D
E4AF 05        882    FCB    05H        ;E
E4B0 06        883    FCB    06H        ;F
E4B1 07        884    FCB    07H        ;G
E4B2 08        885    FCB    08H        ;H
E4B3 09        886    FCB    09H        ;I
E4B4 0A        887    FCB    0AH        ;J
E4B5 0B        888    FCB    0BH        ;K
E4B6 0C        889    FCB    0CH        ;L
E4B7 0D        890    FCB    0DH        ;M
E4B8 0E        891    FCB    0EH        ;N
E4B9 0F        892    FCB    0FH        ;O
E4BA 10        893    FCB    10H        ;P
E4BB 11        894    FCB    11H        ;Q
E4BC 12        895    FCB    12H        ;R
E4BD 13        896    FCB    13H        ;S
E4BE 14        897    FCB    14H        ;T
```

```
E4BF 15          898          FCB     15H          ;U
E4C0 16          899          FCB     16H          ;V
E4C1 17          900          FCB     17H          ;W
E4C2 18          901          FCB     18H          ;X
E4C3 19          902          FCB     19H          ;Y
E4C4 1A          903          FCB     1AH          ;Z
E4C5 00          904          FCB     00H          ;[
E4C6 00          905          FCB     00H          ;\
E4C7 00          906          FCB     00H          ;]
E4C8 00          907          FCB     00H          ;^
E4C9 00          908          FCB     00H          ;UNDERLINE
                 909
                 910
                 911 ;************ VALID CHARACTER ROUTINE ***********************************************
E4CA F68013      912 VALCHR LDA B    MAXCE        ;B=MAXIMUM CHARACTERS ENTERED FLAG
E4CD 2707        913          BEQ     $+9          ;Z=1 IF FLAG NOT SET THUS ENTRY PERMITTED
E4CF B68015      914          LDA A   RAM+15H
E4D2 B7804E      915          STA A   PB0
E4D5 38          916          RTI
E4D6 F68007      917          LDA B   RAM+7        ;B=MODE FLAG
E4D9 C102        918          CMP B   #02H         ;CHECK IF IN PRINT MODE
E4DB 2607        919          BNE     $+9          ;Z=0 IF NOT IN PRINT MODE
E4DD B68015      920          LDA A   RAM+15H
E4E0 B7804E      921          STA A   PB0
E4E3 38          922          RTI
E4E4 F68014      923          LDA B   RAM+14H      ;B=LAST CHARACTER POSITION FLAG
E4E7 2707        924          BEQ     $+9          ;Z=1 IF FLAG NOT SET THUS NOT AT END POSITION
E4E9 B68015      925          LDA A   RAM+15H
E4EC B7804E      926          STA A   PB0
E4EF 38          927          RTI
E4F0 BDE5DA      928          JSR     LGLCHR       ;CHECK IF CHARACTER IS ON WHEEL
E4F3 7D8029      929          TST     INCFLG       ;CHECK IF AUTO INCREMENT ENTRY FLAG SET
E4F6 2720        930          BEQ     BPT80        ;Z=1 IF FLAG NOT SET
E4F8 37          931          PSH B
E4F9 16          932          TAB
E4FA C4F0        933          AND B   #0F0H
E4FC C11F        934          CMP B   #1FH         ;CHECK IF KEY CODE IS GREATER THAN LOWER LIMIT
E4FE 2203        935          BHI     $+5          ;Z=1 IF POSSIBLE NUMBER
E500 33          936          PUL B
E501 5F          937          CLR B                ;KEY NOT A NUMBER THUS INVALID ENTRY
E502 39          938          RTS
E503 16          939          TAB
E504 C15A        940          CMP B   #5AH         ;CHECK IF KEY CODE IS LESS THAN UPPER LIMIT
E506 2303        941          BLS     $+5          ;IF VALID NUMBER
E508 33          942 BPT50    PUL B
E509 5F          943          CLR B
E50A 39          944          RTS
E50B F68028      945          LDA B   INCNUM       ;B=NUMBER OF DIGITS IN AUTO INCREMENT NUMBER
E50E C140        946          CMP B   #40H         ;CHECK IF AT MAX OF 64 DIGITS
E510 2602        947          BNE     $+4          ;Z=0 IF NOT AT MAX
E512 20F4        948          BRA     BPT50
E514 7C8028      949          INC     INCNUM       ;UPDATE # OF DIGITS IN AUTO INCREMENT NUMBER
```

```
E517 33          950          PUL B
E518 5D          951 RPT80    TST B
E519 2607        952          BNE      $+9          ;Z=0 IF ON WHEEL
E51B B68015      953          LDA A    RAM+15H
E51E B7B04E      954          STA A    PB0
E521 3B          955          RTI
E522 FE800A      956          LDX      NCE          ;INDEX=ADDRESS OF NEXT CHARACTER ENTRY
E525 F68020      957          LDA B    FLDFLG       ;B=FIELD TYPE FLAG
E528 2711        958          BEQ      RPT31        ;Z=1 IF IN VARIABLE MODE
E52A F68003      959          LDA B    SB1          ;B=PC SWITCH BANK #1 SETTINGS
E52D C404        960          AND B    #04H         ;CHECK IF DUPLEX SWITCH IS ON
E52F 2605        961          BNE      $+7          ;Z=0 IF SWITCH IS ON
E531 C610        962          LDA B    #10H         ;REVERSE VIDEO CONTROL CODE
E533 BDE77E      963          JSR      OT232
E536 16          964          TAB
E537 8A80        965          ORA A    #80H         ;SET REVERSE BIT     NAM  BIT  TO SKIP PAINT
E539 2001        966          BRA      $+3
E53B 16          967 RPT31    TAB
E53C A700        968          STA A    00H,X        ;STORE CHARACTER
E53E B68003      969          LDA A    SB1          ;A=PC SWITCH BANK #1
E541 8407        970          AND A    #07H         ;ISOLATE HOLDER OPTION, CRT OPTION, AND DUPLEX SWITCH SETTINGS
E543 8103        971          CMP A    #03H         ;CHECK IF CRT AND HOLDER OPTIONS ACTIVE WHILE DUPLEX IS OFF
E545 2603        972          BNE      $+5          ;Z=0 IF SWITCH IS ON
E547 BDE77E      973          JSR      OT232        ;TRANSMIT TO CRT
E54A 08          974          INX
E54B FC801C      975          CPX      RAM+1CH      ;CHECK IF MAXIMUM CHARACTERS ENTERED
E54E 2605        976          BNE      $+7          ;Z=0 IF NOT AT MAX
E550 8601        977          LDA A    #01H
E552 B78013      978          STA A    MAXCE        ;SET MAXIMUM CHARACTERS ENTERED FLAG
E555 FF800A      979          STX      NCE
E558 B68003      980          LDA A    SB1          ;PC SWITCH BANK #1 SETTINGS
E55B 8401        981          AND A    #01H         ;CHECK IF HOLDER OPTION IS ACTIVE
E55D 2622        982          BNE      RPT24        ;Z=1 IF HOLDER OPTION ACTIVE
E55F B68009      983          LDA A    NCE+1
E562 8040        984          SUB A    #40H
E564 818011      985          CMP A    TEV
E567 2605        986          BNE      RPT49
E569 8601        987          LDA A    #01H
E56B B78014      988          STA A    RAM+14H      ;SET LAST CHARACTER POSITION FLAG
E56E F68007      989 RPT49    LDA B    RAM+7        ;B=MODE FLAG
E571 2607        990          BNE      RPT19        ;Z=0 IF IN DATA ENTRY OR PRINT MODES
E573 FE800C      991          LDX      NUM2P        ;INDEX=NUMBER OF CHARACTERS TO PRINT
E576 08          992          INX
E577 FF800C      993          STX      NUM2P
E57A B68015      994 RPT19    LDA A    RAM+15H
E57D B7B04E      995          STA A    PB0
E580 3B          996          RTI
E581 FE800A      997 RPT24    LDX      NCE
E584 FF8016      998          STX      RAM+16H
E587 B68017      999          LDA A    RAM+17H
E58A 0C         1000          CLC
E58B 8040       1001          SUB A    #40H
```

```
E58D F68019      1002          LDA B    CYP            ;B=CURSOR Y POSITION VALUE
E590 F08022      1003          SUB B    CURTOP         ;SUBTRACT CURSOR TOP MARGIN VALUE FROM Y POSITION VALUE
E593 5C          1004          INC B                   ;TO GET RELATIVE LINE POSITION
E594 B78017      1005 BPT32    STA A    RAM+17H
E597 B68016      1006          LDA A    RAM+16H
E59A 8200        1007          SBC A    #00H
E59C B78016      1008          STA A    RAM+16H
E59F 5A          1009          DEC B
E5A0 270C        1010          BEQ      BPT33
E5A2 37          1011          PSH B
E5A3 0C          1012          CLC
E5A4 B68017      1013          LDA A    RAM+17H
E5A7 F68011      1014          LDA B    TEV
E5AA 10          1015          SBA                     ;SUBTRACT LINES WORTH OF CHARACTERS
E5AB 33          1016          PUL B
E5AC 20E6        1017          BRA      BPT32
E5AE B68017      1018 BPT33    LDA A    RAM+17H
E5B1 B18011      1019          CMP A    TEV            ;CHECK IF AT END OF TABLE
E5B4 271A        1020          BEQ      BPT48          ;Z=1 IF AT END OF TABLE
E5B6 B68021      1021          LDA A    CURRHT         ;A=CURSOR RIGHT MARGIN VALUE
E5B9 B18018      1022          CMP A    CXP            ;CHECK IF AT RIGHT MARGIN
E5BC 2705        1023          BEQ      *+7            ;Z=1 IF AT RIGHT MARGIN
E5BE 7C8018      1024          INC      CXP            ;UPDATE CURSOR X POSITION
E5C1 2006        1025          BRA      *+8
E5C3 7C8024      1026          INC      SRNSRT
E5C6 BDE780      1027          JSR      LDSRN
E5C9 8601        1028          LDA A    #01H
E5CB B78033      1029          STA A    RAM+33H        ;A=CHARACTER ENTERED FLAG
E5CE 209C        1030          BRA      BPT49
E5D0 8601        1031 BPT48    LDA A    #01H
E5D2 B78014      1032          STA A    RAM+14H        ;SET LAST CHARACTER POSITION FLAG
E5D5 7C8018      1033          INC      CXP
E5D8 2094        1034          BRA      BPT49
                 1035
                 1036
                 1037 ;************ CHECK IF SELECTED CODE CORRESPONDS TO CHARACTER ON WHEEL *************
E5DA CDEA0       1038 LGLCHR   LDX      WLETPOS        ;INDEX=ADDRESS OF ASCII TO WHEEL POSITION CODE CONVERSION TABLE
E5DD C620        1039          LDA B    #20H
E5DF 11          1040          CBA
E5E0 2704        1041          BEQ      *+6            ;Z=1 IF COMPARE THUS CHARACTER IS ON WHEEL
E5E2 08          1042          INX
E5E3 5C          1043          INC B
E5E4 20F9        1044          BRA      *-5
E5E6 E600        1045          LDA B    00H,X          ;B=WHEEL CHARACTER POSITION CODE
E5E8 39          1046          RTS
                 1047
                 1048
                 1049 ;************ DETERMINE # CHARACTER POSITIONS TO MOVE AND DIRECTION ****************
E5E9 8DE5DA      1050 DIRDET   JSR      LGLCHR
E5EC 5D          1051          TST B
E5ED 2605        1052          BNE      *+7            ;Z=0 IF VALID WHEEL CHARACTER
E5EF 32          1053          PUL A
```

```
E5F0 32          1054        PUL A
E5F1 7EE0C2      1055        JMP      PNTCHK
E5F4 F1800F      1056        CMP B    WPOS          ;COMPARE DESIRED AND PRESENT WHEEL POSITION
E5F7 2601        1057        BNE      $+3           ;Z=IF NO COMPARE
E5F9 39          1058        RTS
E5FA B6800E      1059        LDA A    WPOS
E5FD F7800F      1060        STA B    WPOS
E600 11          1061        CBA
E601 2223        1062        BHI      BPT9
E603 37          1063        PSH B
E604 16          1064        TAB
E605 32          1065        PUL A
E606 10          1066        SBA
E607 8114        1067        CMP A    #14H
E609 2312        1068        BLS      BPT10
E60B 8014        1069        SUB A    #14H
E60D C614        1070        LDA B    #14H
E60F 5A          1071        DEC B
E610 4A          1072        DEC A
E611 26FC        1073        BNE      $-2
E613 17          1074        TBA
E614 BDE646      1075        JSR      DETSTP
E617 37          1076        PSH B
E618 C601        1077        LDA B    #01H
E61A 7EE650      1078        JMP      MOTGO
E61D BDE646      1079 BPT10  JSR      DETSTP
E620 37          1080        PSH B
E621 C6FF        1081        LDA B    #0FFH
E623 7EE650      1082        JMP      MOTGO
E626 10          1083 BPT9   SBA
E627 8114        1084        CMP A    #14H
E629 2312        1085        BLS      BPT12
E62B 8014        1086        SUB A    #14H
E62D C614        1087        LDA B    #14H
E62F 5A          1088        DEC B
E630 4A          1089        DEC A
E631 26FC        1090        BNE      $-2
E633 17          1091        TBA
E634 BDE646      1092        JSR      DETSTP
E637 37          1093        PSH B
E638 C6FF        1094        LDA B    #0FFH
E63A 7EE650      1095        JMP      MOTGO
E63D BDE646      1096 BPT12  JSR      DETSTP
E640 37          1097        PSH B
E641 C601        1098        LDA B    #01H
E643 7EE650      1099        JMP      MOTGO
                 1100
                 1101
                 1102 ;************ DETERMINE NUMBER OF MOTOR STEPS TO GET TO NEW POSITION ***************
E646 C600        1103 DETSTP LDA B    #00H
E648 CB05        1104        ADD B    #05H
E64A 4A          1105        DEC A
```

```
E64B 26FB        1106          BNE       $-3
E64D 39          1107          RTS
                 1108
                 1109 ;************ ROTATE MOTOR ROUTINE ***********************************************
E64E 37          1110 BPT11    PSH B
E64F 16          1111          TAB
E650 CE8000      1112 MOT60    LDX       #RAM+0
E653 BDE286      1113          JSR       MOVMOT
E656 B78001      1114          STA A     MOT1
E659 CE0160      1115          LDX       #0160H
E65C 09          1116          DEX
E65D 26FD        1117          BNE       $-1
E65F 17          1118          TBA
E660 33          1119          PUL B
E661 5A          1120          DEC B
E662 26EA        1121          BNE       BPT11
E664 39          1122          RTS
                 1123
                 1124
                 1125 ;************ MOVE TABLE ROUTINE ***************************************************
E665 B6800F      1126 MOVTAB   LDA A     TPOS              ;A=TABLE POSITION
E668 81FF        1127          CMP B     #0FFH             ;CHECK FOR CW MOTION CODE(FORWARD)
E66A 260E        1128          BNE       BPT15             ;Z=0 IF NOT CW CODE
E66C 4A          1129          DEC A
E66D B18011      1130          CMP A     TEV               ;CHECK IF AT RIGHT MARGIN
E670 2601        1131          BNE       BPT13             ;Z=0 IF NOT AT MARGIN
E672 39          1132          RTS
E673 4C          1133 BPT13    INC A
E674 4C          1134          INC A
E675 B7800F      1135          STA A     TPOS
E678 2009        1136          BRA       BPT16
E67A 8101        1137 BPT15    CMP A     #01H              ;CHECK IF AT LEFT MARGIN
E67C 2601        1138          BNE       $+3               ;Z=0 IF NOT AT MARGIN
E67E 39          1139          RTS
E67F 4A          1140          DEC A
E680 B7800F      1141          STA A     TPOS
E683 CE16A7      1142 BPT16    LDX       #SPCHAR           ;INDEX=ADDRESS OF STEPS PER CHARACTER TABLE
E686 B68005      1143          LDA A     RAM+5             ;8-X MOTION SWITCH SETTING
E689 4D          1144          TST A
E68A 2704        1145          BEQ       $+6
E68C 08          1146          INX
E68D 4A          1147          DEC A
E68E 20F9        1148          BRA       $-5
E690 A600        1149          LDA A     00H,X             ;A=NUMBER OF STEPS PER CHARACTER POSITION
E692 36          1150 BPT17    PSH A
E693 CE8001      1151          LDX       #RAM+1
E696 BDE286      1152          JSR       MOVMOT
E699 B78000      1153          STA A     MOT2
E69C CE0700      1154          LDX       #0700H
E69F 09          1155          DEX
E6A0 26FD        1156          BNE       $-1
E6A2 32          1157          PUL A
```

```
E6A3 4A          1158          DEC A
E6A4 26EC        1159          BNE      BPT17
E6A6 39          1160          RTS
                 1161
                 1162
                 1163 ;************ STEPS PER CHARACTER TABLE ****************************************
E6A7 02          1164 SPCHAR   FCB      02H
E6A8 03          1165          FCB      03H
E6A9 04          1166          FCB      04H
E6AA 05          1167          FCB      05H
E6AB 06          1168          FCB      06H
E6AC 07          1169          FCB      07H
E6AD 08          1170          FCB      08H
E6AE 09          1171          FCB      09H
                 1172
                 1173
                 1174 ;************ MOVE HOLDER ROUTINE ***********************************************
E6AF B68010      1175 MOVHLD   LDA A    HPOS          ;A=HOLDER POSITION
E6B2 81FF        1176          CMP B    #0FFH         ;CHECK FOR CCW MOTION CODE(UP)
E6B4 260C        1177          BNE      BPT7          ;Z=0 IF NOT CCW CODE
E6B6 B18012      1178          CMP A    HFV           ;CHECK IF AT BOTTOM
E6B9 2601        1179          BNE      $+3           ;Z=0 IF NOT AT BOTTOM
E6BB 39          1180          RTS
E6BC 4C          1181          INC A
E6BD B78010      1182          STA A    HPOS
E6C0 2000        1183          BRA      BPT8
E6C2 8101        1184 BPT7     CMP B    #01H          ;CW MOTION CODE(DOWN)
E6C4 26FE        1185          BNE      $-0           ;ERROR TRAP-DIRECTION NOT SPECIFIED UPON ENTERING THIS ROUTINE
E6C6 8101        1186          CMP A    #01H          ;CHECK IF AT TOP
E6C8 2601        1187          BNE      $+3           ;Z=0 IF NOT AT TOP
E6CA 39          1188          RTS
E6CB 4A          1189          DEC A
E6CC B78010      1190          STA A    HPOS
E6CF CEE6F3      1191 BPT8     LDX      #SPLINE       ;INDEX=ADDRESS OF STEPS PER LINE TABLE
E6D2 B68006      1192          LDA A    RAM+6         ;B=Y MOTION SWITCH SETTING
E6D5 4D          1193          TST A
E6D6 2704        1194          BEQ      $+6
E6D8 08          1195          INX
E6D9 4A          1196          DEC A
E6DA 20F9        1197          BRA      $-5
E6DC A600        1198          LDA A    00H,X         ;A=NUMBER OF STEPS PER LINE
E6DE 36          1199 BPT18    PSH A
E6DF CE8002      1200          LDX      #RAM+2
E6E2 BDF286      1201          JSR      MOVMOT
E6E5 B78003      1202          STA A    MOT3
E6E8 CF0600      1203          LDX      #0600H
E6EB 09          1204          DEX
E6EC 26FD        1205          BNE      $-1
E6EE 32          1206          PUL A
E6EF 4A          1207          DEC A
E6F0 26EC        1208          BNE      BPT18
E6F2 39          1209          RTS
```

Motion STOP routine

```
                1210
                1211
                1212 ;************ STEPS PER LINE TABLE ***********************************************
E6F3 02         1213 SPLCNE FCB     02H
E6F4 03         1214        FCB     03H
E6F5 04         1215        FCB     04H
E6F6 05         1216        FCB     05H
E6F7 06         1217        FCB     06H
E6F8 07         1218        FCB     07H
E6F9 08         1219        FCB     08H
E6FA 09         1220        FCB     09H
                1221
                1222
                1223 ;************ INITIATE PRINT SEQUENCE ********************************************
E6FB B6804D     1224 PRNT   LDA A   PAC             ;A=PIA-A CONTROL REG
E6FE 84F7       1225        AND A   #0F7H           ;ENERGIZE SOLENOID
E700 B7804D     1226        STA A   PAC
E703 CE1C00     1227        LDX     #1C00H          ;ON TIME VALUE
E706 09         1228        DEX
E707 26FD       1229        BNE     $-1
E709 B6804D     1230        LDA A   PAC             ;A=PIA-A CONTROL REG
E70C 8A08       1231        ORA A   #08H            ;DE-ENERGIZE SOLENOID
E70E B7804D     1232        STA A   PAC
E711 39         1233        RTS
                1234
                1235
                1236 ;************ WHEEL MOTION SETTLING TIME DELAY ************************************
E712 CE0100     1237 TIM1   LDX     #0100H
E715 09         1238        DEX
E716 26FD       1239        BNE     $-1
E718 39         1240        RTS
                1241
                1242
                1243 ;************ PRINT STROKE DELAY TO ASSURE GOOD IMPRINT ***************************
E719 CE5000     1244 TIM2   LDX     #5000H
E71C 09         1245        DEX
E71D 26FD       1246        BNE     $-1
E71F 39         1247        RTS
                1248
                1249
                1250
                1251 ;************ CURSOR LIMIT DETERMINATION ROUTINE **********************************
E720 F68011     1252 CURLIM LDA B   TSV             ;B=TABLE END VALUE(# OF CHARACTERS ON LINE)
E723 54         1253        LSR B                   ;DIVIDE BY TWO
E724 8610       1254        LDA A   #10H            ;A=SCREEN CENTER VALUE
E726 10         1255        SBA                     ;CHECK IF PLATE SIZE LESS THAN FULL SCREEN
E727 2E04       1256        BGT     $+6             ;IF NOT FULL SCREEN
E729 8603       1257        LDA A   #03H            ;THREE COLUMN HEADER ADJUSTMENT VALUE
E72B 2003       1258        BRA     $+5
E72D C603       1259        LDA B   #03H            ;THREE COLUMN HEADER ADJUSTMENT VALUE
E72F 19         1260        ABA
E730 B78020     1261        STA A   CURLFT          ;SET CURSOR LEFT MARGIN
```

```
E733 F68011     1262        LDA B    TEV          ;B=TABLE END VALUE(# OF CHARACTERS ON LINE)
E736 1B         1263        ABA                   ;ADD # OF CHARACTERS TO STARTING POSITION TO GET RIGHT MARGIN
E737 8142       1264        CMP A    #42H         ;CHECK IF GREATER THAN SCREEN WIDTH
E739 2302       1265        BLS      $+4          ;IF LESS OR SAME AS SCREEN WIDTH
E73B 8642       1266        LDA A    #42H         ;A=MAXIMUM SCREEN WIDTH VALUE
E73D B78021     1267        STA A    CURRHT       ;SET RIGHT CURSOR MARGIN
E740 F68012     1268        LDA B    HEV          ;B=HOLDER END VALUE (# OF LINES)
E743 54         1269        LSR B                 ;DIVIDE BY TWO
E744 8608       1270        LDA A    #08H         ;A=VERTICAL SCREEN CENTER
E746 10         1271        SBA                   ;CHECK IF PLATE LESS THAN FULL SCREEN
E747 2E04       1272        BGT      $+6          ;IF NOT FULL SCREEN
E749 8602       1273        LDA A    #02H         ;A=VERTICAL HEADER STARTING VALUE
E74B 2003       1274        BRA      $+5
E74D C602       1275        LDA B    #02H         ;TWO ROW HEADER ADJUSTMENT VALUE
E74F 1B         1276        ABA
E750 B78022     1277        STA A    CURTOP       ;SET CURSOR TOP LINE LIMIT
E753 F68012     1278        LDA B    HEV          ;B=HOLDER END VALUE (# OF LINES)
E756 1B         1279        ABA                   ;ADD # OF LINES TO TOP VALUE TO GET BOTTOM LIMIT
E757 8111       1280        CMP A    #11H         ;CHECK IF OVER MAXIMUM SCREEN HEIGHT
E759 2302       1281        BLS      $+4          ;IF LESS OR SAME AS MAX HEIGHT
E75B 8611       1282        LDA A    #11H         ;A=MAX HEIGHT VALUE
E75D B78023     1283        STA A    CURBOT       ;SET CURSOR BOTTOM LINE LIMIT
E760 B68020     1284        LDA A    CURLFT
E763 B78018     1285        STA A    CXP
E766 B68022     1286        LDA A    CURTOP
E769 B78019     1287        STA A    CYP
E76C 4F         1288        CLR A
E76D B78024     1289        STA A    SKNSRT
E770 B78025     1290        STA A    SRMLIN
E773 B68003     1291        LDA A    SB1          ;A=PC SWITCH BANK #1 SETTINGS
E776 8404       1292        AND A    #04H         ;CHECK IF DUPLEX SWITCH IS ON
E778 2701       1293        BEQ      $+3          ;Z=1 IF SWITCH IS OFF
E77A 39         1294        RTS
E77B 7EE7B0     1295        JMP      LDSRN        ;LOAD SCREEN RAM
                1296
                1297
                1298 ;************ OUTPUT TO RS232 PORT ********************************************
E77E 36         1299 OT232  PSH A
E77F B69000     1300        LDA A    RS232S       ;A=RS232 STATUS REG
E782 8402       1301        AND A    #02H         ;CHECK IF TRANSMIT BUFFER EMPTY
E784 27F9       1302        BEQ      $-5          ;Z=1 IF NOT EMPTY
E786 F79001     1303        STA B    RS232D       ;LOAD TRANSMIT BUFFER WITH DATA IN B
E789 32         1304        PUL A
E78A 39         1305        RTS
                1306
                1307
                1308 ;************ SET DIM ATTRIBUTE ROUTINE ***************************************
E78B C611       1309 DIM    LDA B    #11H         ;DIM CODE
E78D 7EE77E     1310        JMP      OT232
                1311
                1312
                1313 ;************ SET BRIGHT ATTRIBUTE ROUTINE ************************************
```

```
E790 C60E        BRIGHT LDA B    #0EH          ;BRIGHT CODE
E792 7EE77E              JMP    OT232
                 ;************ CLEAR SCREEN ***********************************************
E795 F68003      CLRSRN LDA B    S91           ;B=PC SWITCH BANK #1 SETTINGS
E798 C407                AND B  #07H          ;ISOLATE OPTION SWITCHES
E79A C102                CMP B  #02H
E79C 2201                BHI    CLR1
E79E 39                  RTS
E79F C60F        CLR1   LDA B   #0FH          ;SET NORMAL VIDEO MODE
E7A1 BDE77E              JSR    OT232
E7A4 C60C                LDA B  #0CH          ;CLEAR SCREEN CODE
E7A6 BDE77E              JSR    OT232
E7A9 CE4000              LDX    #4000H
E7AC 09                  DEX
E7AD 26FD                BNE    $-1
E7AF 39                  RTS
                 ;************ LOAD CRT SCREEN RAM ****************************************
E7B0 7F8033      LDSRN  CLR     RAM+33H       ;CLEAR CHARACTER ENTERED FLAG
E7B3 7F8034              CLR    RAM+34H       ;CLEAR CONTROL CODE COMMAND FLAG
E7B6 F68003              LDA B  S91           ;B=PC SWITCH BANK #1 SETTINGS
E7B9 C407                AND B  #07H          ;ISOLATE OPTION SETTINGS
E7BB C103                CMP B  #03H          ;CHECK IF CRT AND HOLDER OPTIONS ACTIVE
E7BD 2701                BEQ    $+3           ;Z=1 IF OPTIONS ACTIVE
E7BF 39                  RTS
E7C0 FE8000              LDX    NUM2P
E7C3 2703                BEQ    $+5
E7C5 7EE978              JMP    NPT97
E7C8 0F                  SEI
E7C9 C60C                LDA B  #0CH          ;CLEAR SCREEN COMMAND
E7CB BDE77E              JSR    OT232
E7CE CE3000              LDX    #3000H
E7D1 09                  DEX
E7D2 26FD                BNE    $-1
E7D4 C606                LDA B  #06H          ;LOAD CURSOR CONTROL CODE
E7D6 BDE77E              JSR    OT232
E7D9 F68020              LDA B  CURLFT
E7DC 5A                  DEC B
E7DD BDE77E              JSR    OT232
E7E0 F68022              LDA B  CURTOP
E7E3 BDE77E              JSR    OT232
E7E6 0F                  CLI
E7E7 CE8040              LDX    #8040H        ;INDEX=STARTING ADDRESS OF ENTERED DATA STORAGE
E7EA B68024              LDA A  SRNSRT        ;A=HORIZONTAL OFFSET VALUE
E7ED 2704                BEQ    $+6           ;Z=1 IF NO OFFSET REQUIRED
E7EF 08                  INX
E7F0 4A                  DEC A
E7F1 26FC                BNE    $-2
E7F3 B68025              LDA A  SRNLIN        ;A=VERTICAL OFFSET VALUE
```

```
E7F6 270A        1366        BEQ      $+12        ;Z=1 IF NO OFFSET REQUIRED
E7F8 F68011      1367        LDA B    TEV         ;B=# OF CHARACTERS PER LINE ON THE PLATE
E7FB C8          1368        INX                  ;UPDATE STARTING ADDRESS OF BUFFER TO SCREEN TRANSFER
E7FC 5A          1369        DEC B
E7FD 26FC        1370        BNE      $-2         ;Z=0 IF FULL LINE NOT ADDED
E7FF 4A          1371        DEC A
E800 26F6        1372        BNE      $-8         ;Z=0 IF FULL OFFSET NOT FINISHED
E802 868023      1373        LDA A    CURBOT      ;A=BOTTOM LINE LIMIT VALUE
E805 B68022      1374        SUB A    CURTOP      ;SUBTRACT TOP LIMIT FROM BOTTOM LIMIT TO GET # OF LINES ON PLATE
E808 4C          1375        INC A                ;ADD 1 TO GET NUMBER OF LINES TO CHANGE
E809 FF8026      1376        STX      DATAD
E80C B78032      1377 BPT38  STA A    RAM+32H     ;SAVE LINE NUMBER
E80F B68011      1378        LDA A    TEV         ;A=TABLE END VALUE
E812 8140        1379        CMP A    #40H
E814 2302        1380        BLS      $+4
E816 8640        1381        LDA A    #40H
E818 C620        1382        LDA B    #20H        ;TRANSMIT SPACE TO CLEAR DATA COLUMN #2
E81A BDE77E      1383        JSR      OT232
E81D B78031      1384 BPT6   STA A    RAM+31H     ;SAVE CHARACTER NUMBER
E820 868033      1385        LDA A    RAM+33H     ;A=CHARACTER ENTERED FLAG
E823 2703        1386        BEQ      $+5         ;Z=1 IF NO CHARACTER ENTERED
E825 7EE978      1387        JMP      BPT97
E828 868034      1388        LDA A    RAM+34H     ;A=CONTROL CODE COMMAND FLAG
E829 2703        1389        BEQ      $+5         ;Z=1 IF NO CHARACTER ENTERED
E82D 7EE978      1390        JMP      BPT97
E830 A600        1391        LDA A    00H,X       ;A=ENTERED DATA BYTE
E832 16          1392        TAB
E833 2A0D        1393        BPL      $+15        ;N=0 IF REVERSE BIT NOT SET
E835 C610        1394        LDA B    #10H        ;REVERSE VIDEO CODE
E837 BDE77E      1395        JSR      OT232
E83A 16          1396        TAB
E83B C47F        1397        AND B    #7FH        ;STRIP OFF REVERSE BIT
E83D BDE77E      1398        JSR      OT232
E840 C60F        1399        LDA B    #0FH        ;NORMAL VIDEO CODE
E842 BDE77E      1400        JSR      OT232       ;TO CRT SCREEN RAM
E845 08          1401        INX
E846 868031      1402        LDA A    RAM+31H     ;CHARACTER NUMBER
E849 4A          1403        DEC A
E84A 26D1        1404        BNE      BPT6        ;Z=0 IF FULL LINE OF SCREEN RAM NOT TRANSFERED
E84C 0C          1405        CLC
E84D B68027      1406        LDA A    DATAD+1     ;A=LOW BYTE OF RETREIVED DATA ADDRESS
E850 BB8011      1407        ADD A    TEV         ;ADD FULL LINE OF PLATE CHARACTERS
E853 B78027      1408        STA A    DATAD+1
E856 868026      1409        LDA A    DATAD
E859 8900        1410        ADC A    #00H
E85B B78026      1411        STA A    DATAD
E85E FE8026      1412        LDX      DATAD
E861 C606        1413        LDA B    #06H        ;B=LOAD CURSOR CONTROL CODE
E863 0F          1414        SEI
E864 BDE77E      1415        JSR      OT232
E867 F68020      1416        LDA B    CURLFT      ;B=CURSOR LEFT MARGIN
E86A 5A          1417        DEC B
```

```
E868 BDE77E      1418        JSR      OT232
E86B F68032      1419        LDA A    RAM+32H          ;RETREIVE # OF LINES TO TRANSFER TO SCREEN
E871 4A          1420        DEC A
E872 16          1421        TAB
E873 F68023      1422        LDA A    CURBOT           ;A=BOTTOM MARGIN VALUE
E876 10          1423        SBA
E877 4C          1424        INC A
E878 36          1425        PSH A
E879 17          1426        TBA
E87A 33          1427        PUL B
E87B BDE77E      1428        JSR      OT232
E87E 0E          1429        CLI
E87F 4D          1430        TST A
E880 268A        1431        BNE      EPT38            ;Z=0 IF ALL LINES NOT TRANSFERED TO CRT
                 1432
                 1433
                 1434 ;************ DRAW BORDER HEADERS ON CRT SCREEN ***********************************
E882 F68003      1435 DRAWHD LDA B    S01              ;B=PC SWITCH BANK #1 SETTINGS
E885 C407        1436        AND B    #07H             ;ISOLATE OPTION SETTINGS
E887 C103        1437        CMP B    #03H             ;CHECK IF CRT AND HOLDER OPTIONS ACTIVE
E889 2703        1438        BEQ      $+5              ;Z=1 IF SWITCH IS OFF
E88B 7E8970      1439        JMP      EPT97
E88E C606        1440        LDA B    #06H             ;LOAD CURSOR POSITION CODE
E890 0F          1441        SEI
E891 BDE77E      1442        JSR      OT232
E894 F68020      1443        LDA B    CURLFT           ;B=CURSOR LEFT MARGIN
E897 BDE77E      1444        JSR      OT232
E89A F68022      1445        LDA B    CURTOP           ;B=CURSOR TOP MARGIN
E89D 5A          1446        DEC B
E89E BDE77E      1447        JSR      OT232
E8A1 0E          1448        CLI
E8A2 F68021      1449        LDA A    CURRHT           ;A=CURSOR RIGHT MARGIN
E8A5 4C          1450        INC A
E8A6 F68020      1451        LDA B    CURLFT           ;B=CURSOR LEFT MARGIN
E8A9 10          1452        SBA                       ;SUBTRACT LEFT FROM RIGHT TO GET # OF CHARS ON SCREEN LINE
E8AA C620        1453        LDA B    #20H
E8AC BDE77E      1454        JSR      OT232
E8AF 4A          1455        DEC A
E8B0 26FA        1456        BNE      $-4
E8B2 C606        1457        LDA B    #06H             ;B=CURSOR POSITION LOAD CONTROL CODE
E8B4 0F          1458        SEI
E8B5 BDE77E      1459        JSR      OT232
E8B8 F68020      1460        LDA B    CURLFT           ;B=CURSOR X POSITION VALUE
E8BB BDE77E      1461        JSR      OT232
E8BE F68022      1462        LDA B    CURTOP           ;B=CURSOR Y POSITION VALUE
E8C1 5A          1463        DEC B
E8C2 5A          1464        DEC B
E8C3 BDE77E      1465        JSR      OT232
E8C6 0E          1466        CLI
E8C7 BDE78B      1467        JSR      DIM              ;SET DIM ATTRIBUTE ON
E8CA F68024      1468        LDA B    SRNSRT           ;SCREEN OFFSET VALUE
E8CD 8600        1469        LDA A    #00H
```

```
E8CF C108        1470 BPT47  CMP B   #08H        ;CHECK IF HORIZONTAL OFFSET IS 8 OR LESS
E8D1 2317        1471        BLS     BPT36
E8D3 C109        1472        CMP B   #09H        ;CHECK IF HORIZONTAL OFFSET 9
E8D5 260E        1473        BNE     BPT46
E8D7 B7802C      1474        STA A   RAM+2CH
E8DA B68011      1475        LDA A   TEV
E8DD 8140        1476        CMP A   #40H
E8DF 2302        1477        BLS     $+4
E8E1 8640        1478        LDA A   #40H
E8E3 201E        1479        BRA     BPT34
E8E5 4C          1480 BPT46  INC A
E8E6 C00A        1481        SUB B   #0AH
E8E8 20E5        1482        BRA     BPT47
E8EA B7802C      1483 BPT36  STA A   RAM+2CH
E8ED CB31        1484        ADD B   #31H        ;CONVERT TO ASCII CODE
E8EF B68011      1485        LDA A   TEV
E8F2 8140        1486        CMP A   #40H
E8F4 2302        1487        BLS     $+4
E8F6 8640        1488        LDA A   #40H
E8F8 BDE77E      1489 AGAIN  JSR     OT232
E8FB 4A          1490        DEC A
E8FC 2731        1491        BEQ     COLUMN      ;Z=1 IF TOP HEADER FINISHED
E8FE 5C          1492        INC B
E8FF C13A        1493        CMP B   #3AH        ;CHECK IF PAST NUMBER NINE
E901 26F5        1494        BNE     AGAIN       ;Z=0 IF NOT PAST NINE
E903 C60A        1495 BPT34  LDA B   #0AH        ;B=LINE FEED CONTROL CODE
E905 BDE77E      1496        JSR     OT232
E908 BDE790      1497        JSR     BRIGHT      ;SET BRIGHT ATTRIBUTE
E90B 7C802C      1498        INC     RAM+2CH
E90E F6802C      1499        LDA B   RAM+2CH
E911 CB30        1500        ADD B   #30H        ;CONVERT TO ASCII CODE
E913 BDE77E      1501        JSR     OT232
E916 C608        1502        LDA B   #08H        ;BACKSPACE CURSOR CONTROL CODE
E918 BDE77E      1503        JSR     OT232
E91B C609        1504        LDA B   #09H        ;UP CURSOR CONTROL CODE
E91D BDE77E      1505        JSR     OT232
E920 C630        1506        LDA B   #30H        ;ASCII "0" CODE
E922 BDE77E      1507        JSR     OT232
E925 BDE7BB      1508        JSR     DIM         ;SET DIM ATTRIBUTE
E928 4A          1509        DEC A
E929 2704        1510        BEQ     COLUMN      ;Z=1 IF TOP HEADER FINISHED
E92B C631        1511        LDA B   #31H        ;ASCII "1" CODE
E92D 20C9        1512        BRA     AGAIN
E92F C606        1513 COLUMN LDA B   #06H        ;POSITION CURSOR CONTROL CODE
E931 0F          1514        SEI
E932 BDE77E      1515        JSR     OT232
E935 F68020      1516        LDA B   CURLFT      ;B=CURSOR LEFT LIMIT
E938 C003        1517        SUB B   #03H
E93A BDE77E      1518        JSR     OT232
E93D F68022      1519        LDA B   CURTOP      ;B=CURSOR TOP LINE LIMIT
E940 BDE77E      1520        JSR     OT232
E943 0E          1521        CLI
```

```
E944 B6B012      1522          LDA A   NEV        ;A=NUMBER OF LINES IN HEADER
E947 8110        1523          CMP A   #10H       ;COMPARE # OF LINES WITH MAX LINES ON SCREEN
E949 2302        1524          BLS     *+4
E94B 8610        1525          LDA A   #10H       ;A=MAX NUMBER OF LINES
E94D CEE97E      1526          LDX     #LABELS
E950 F68025      1527          LDA B   SRNLIN     ;VERTICAL SCREEN OFFSET
E953 2705        1528          BEQ     NEWLIN
E955 08          1529          INX
E956 08          1530          INX
E957 5A          1531          DEC B
E958 26F9        1532          BNA     *-5
E95A E600        1533 NEWLIN   LDA B   00H,X
E95C BDE77E      1534          JSR     OT232
E95F E601        1535          LDA B   01H,X
E961 BDE77E      1536          JSR     OT232
E964 C608        1537          LDA B   #08H       ;B=CURSOR BACKSPACE CONTROL CODE
E966 BDE77E      1538          JSR     OT232
E969 C608        1539          LDA B   #08H
E96B BDE77E      1540          JSR     OT232
E96E C60A        1541          LDA B   #0AH       ;B=CURSOR LINE FEED CONTROL CODE
E970 BDE77E      1542          JSR     OT232
E973 08          1543          INX
E974 08          1544          INX
E975 4A          1545          DEC A
E976 26E2        1546          BNE     NEWLIN
E978 BDE9CE      1547 EPT97    JSR     POSCUR     ;PUT CURSOR BACK TO POSITION PRIOR TO ENTERING THIS ROUTINE
E97B 7EE790      1548          JMP     BRIGHT     ;SET BRIGHT ATTRIBUTE
                 1549
                 1550
E97E 2031        1551 LABELS   FCB     20H,31H
E980 2032        1552          FCB     20H,32H
E982 2033        1553          FCB     20H,33H
E984 2034        1554          FCB     20H,34H
E986 2035        1555          FCB     20H,35H
E988 2036        1556          FCB     20H,36H
E98A 2037        1557          FCB     20H,37H
E98C 2038        1558          FCB     20H,38H
E98E 2039        1559          FCB     20H,39H
E990 3130        1560          FCB     31H,30H
E992 3131        1561          FCB     31H,31H
E994 3132        1562          FCB     31H,32H
E996 3133        1563          FCB     31H,33H
E998 3134        1564          FCB     31H,34H
E99A 3135        1565          FCB     31H,35H
E99C 3136        1566          FCB     31H,36H
E99E 3137        1567          FCB     31H,37H
E9A0 3138        1568          FCB     31H,38H
E9A2 3139        1569          FCB     31H,39H
E9A4 3230        1570          FCB     32H,30H
E9A6 3231        1571          FCB     32H,31H
E9A8 3232        1572          FCB     32H,32H
E9AA 3233        1573          FCB     32H,33H
E9AC 3234        1574          FCB     32H,34H
```

```
E9AE 3235        1575        FCB      32H,35H
E9B0 3236        1576        FCB      32H,36H
E9B2 3237        1577        FCB      32H,37H
E9B4 3238        1578        FCB      32H,38H
E9B6 3239        1579        FCB      32H,39H
E9B8 3330        1580        FCB      33H,30H
E9BA 3331        1581        FCB      33H,31H
E9BC 3332        1582        FCB      33H,32H
E9BE 3333        1583        FCB      33H,33H
E9C0 3334        1584        FCB      33H,34H
E9C2 3335        1585        FCB      33H,35H
E9C4 3336        1586        FCB      33H,36H
E9C6 3337        1587        FCB      33H,37H
E9C8 3338        1588        FCB      33H,38H
E9CA 3339        1589        FCB      33H,39H
E9CC 3430        1590        FCB      34H,30H
                 1591
                 1592
                 1593 ;************ POSITION CURSOR ************************************************
E9CE C606        1594 POSCUR LDA B    #06H            ;LOAD CURSOR COORDINATES CONTROL CODE
E9D0 0F          1595        SLI
E9D1 BDE77E      1596        JSR      OT232
E9D4 F68018      1597        LDA B    CXP
E9D7 BDE77E      1598        JSR      OT232
E9DA F68019      1599        LDA B    CYP
E9DD BDE77E      1600        JSR      OT232
E9E0 0F          1601        CLI
E9E1 39          1602        RTS
                 1603
                 1604
                 1605 ;************ CLEAR ALL TABS ************************************************
E9E2 CE8036      1606 CLRAT  LDX      #TAB1
E9E5 B68011      1607        LDA A    TEV             ;A=NUMBER OF CHARACTERS ON PLATE LINE
E9E8 A700        1608        STA A    00H,X
E9EA 08          1609        INX
E9EB 8C8040      1610        CPX      #RAM+40H        ;CHECK IF ALL TABS SET TO END OF LINE
E9EE 26F8        1611        BNE      $-6             ;Z=0 IF ALL NOT CLEARED
E9F0 39          1612        RTS
                 1613
                 1614
                 1615 ;************ AUTOMATICALLY INCREMENT SELECTED NUMBER ****************************
E9F1 F68028      1616 AUTINC LDA B    INCNUM          ;B=NUMBER OF DIGITS IN NUMBER
E9F4 2601        1617        BNE      $+3             ;Z=0 IF NUMBER TO BE INCREMENTED
E9F6 39          1618        RTS
E9F7 FE801A      1619        LDX      AUTOAD          ;INDEX=RAM ADDRESS WHERE NUMBER IS STORED
E9FA 5A          1620        DEC B
E9FB 2704        1621        BEQ      $+6
E9FD 08          1622        INX
E9FE 5A          1623        DEC B
E9FF 26FC        1624        BNE      $-2             ;Z=0 IF NOT AT LSB OF NUMBER
EA01 F68028      1625        LDA B    INCNUM          ;B=NUMBER OF DIGITS IN NUMBER
EA04 A600        1626        LDA A    00H,X           ;A=LSB OF NUMBER
```

```
EA06 0C          1627        CLC
EA07 4C          1628        INC A                    ;UPDATE VALUE
EA08 813A        1629        CMP A    #3AH            ;CHECK IF AT MAX NUMBER VALUE OF 9
EA0A 2605        1630        BNE      *+7             ;Z=0 IF NOT MAX NUMBER OF 9
EA0C 8630        1631        LDA A    #30H            ;RESET TO ZERO
EA0E 0D          1632        SEC
EA0F 2001        1633        BRA      *+3
EA11 0C          1634        CLC
EA12 A700        1635        STA A    00H,X           ;RESTORE NEW DIGIT OF NUMBER
EA14 09          1636        DEX
EA15 5A          1637        DEC B
EA16 2706        1638        BEQ      *+8             ;Z=1 IF NUMBER ALL UPDATED
EA18 A600        1639        LDA A    00H,X           ;A=NEXT DIGIT OF NUMBER
EA1A 8000        1640        ADC A    #00H
EA1C 20EA        1641        BRA      *-20
EA1E 39          1642        RTS
                 1643
                 1644
                 1645 ;************ DECREMENT AUTO INCREMENT NUMBER ************************************
EA1F FE801A      1646 DECNUM LDX      AUTOAD          ;INDEX=RAM ADDRESS WHERE NUMBER IS STORED
EA22 5A          1647        DEC B
EA23 2704        1648        BEQ      *+6             ;Z=1 IF NOT AT LEAST SIGNIFICANT DIGIT OF NUMBER
EA25 08          1649        INX
EA26 5A          1650        DEC B
EA27 26FC        1651        BNE      *-2             ;Z=0 IF NOT AT LEAST SIGNIFICANT DIGIT OF NUMBER
EA29 F68020      1652        LDA B    INCNUM          ;B=NUMBER OF DIGITS IN NUMBER
EA2C A600        1653        LDA A    00H,X           ;A=NUMBER DIGIT VALUE
EA2E 0C          1654        CLC
EA2F 4A          1655        DEC A                    ;UPDATE DIGIT VALUE
EA30 812F        1656        CMP A    #2FH            ;CHECK IF AT MIN VALUE
EA32 2605        1657        BNE      *+7             ;Z=0 IF NOT AT MIN VALUE
EA34 8639        1658        LDA A    #39H            ;RELOAD DIGIT VALUE WITH A 9
EA36 0D          1659        SEC
EA37 2001        1660        BRA      *+3
EA39 0C          1661        CLC
EA3A A700        1662        STA A    00H,X           ;STORE NEW VALUE
EA3C 09          1663        DEX
EA3D 5A          1664        DEC B
EA3E 2706        1665        BEQ      *+8             ;Z=1 IF ALL DIGITS UPDATED
EA40 A600        1666        LDA A    00H,X           ;GET NEXT DIGIT VALUE
EA42 8000        1667        SBC A    #00H
EA44 20EA        1668        BRA      *-20
EA46 39          1669        RTS
                 1670
                 1671
                 1672 ;************ INITIALIZE SYSTEM FOR PRINT BACK FEATURE ****************************
EA47 7F8007      1673 PNTRED CLR      RAM+7           ;CLEAR ENTRY MODE FLAG
EA4A BDE1A5      1674        JSR      ZERW
EA4D BDE1D5      1675        JSR      ZERT
EA50 B68003      1676        LDA A    SB1             ;A=PC SWITCH BANK #1 SETTINGS
EA53 8401        1677        AND A    #01H            ;CHECK IF HOLDER OPTION ACTIVE
EA55 2703        1678        BEQ      *+5             ;Z=1 IF HOLDER OPTION NOT ACTIVE
```

```
EA57 BDE236      1679        JSR      ZERH
EA5A 7F8013      1680        CLR      MAXCF          ;CLEAR MAX CHARACTERS ENTERED FLAG
EA5D 7F8014      1681        CLR      RAM+14H        ;CLEAR END OF LINE FLAG
EA60 CE8040      1682        LDX      #8040H
EA63 FF8000      1683        STX      NCTP           ;NEXT CHARACTER TO PRINT ADDRESS INITIALIZED
EA66 B68020      1684        LDA A    CURLFT         ;A=CURSOR LEFT MARGIN VALUE
EA69 B78018      1685        STA A    CXP            ;SET CURSOR TO LEFT MARGIN
EA6C B68022      1686        LDA A    CURTOP         ;A=CURSOR TOP MARGIN
EA6F B78019      1687        STA A    CYP            ;SET CURSOR TO TOP MARGIN
EA72 BDEA91      1688        JSR      CHKDUP         ;CHECK DUPLEX SWITCH
EA75 2603        1689        BNE      $+5            ;Z=0 IF SWITCH IS ON
EA77 BDE9CE      1690        JSR      POSCUR
EA7A 7F8024      1691        CLR      SRNSRT         ;CLEAR HORIZONTAL OFFSET
EA7D 7F8025      1692        CLR      SRNLTN         ;CLEAR VERTICAL OFFSET
EA80 7F802D      1693        CLR      FLDFLG         ;CLEAR FIELD FLAG
EA83 BDEA91      1694        JSR      CHKDUP         ;CHECK DUPLEX SWITCH
EA86 2603        1695        BNE      $+5            ;Z=0 IF SWITCH IS ON
EA88 BDE730      1696        JSR      LDSRN          ;RELOAD SCREEN RAM
EA8B 8602        1697        LDA A    #02H
EA8D B78007      1698        STA A    RAM+7          ;SET PRINT MODE FLAG
EA90 39          1699 RPT57  RTS
                 1700
                 1701
                 1702 ;************ CHECK FULL DUPLEX SWITCH SETTING(b=1 SWITCH ON, b=0 SWITCH OFF)
EA91 F60003      1703 CHKDUP LDA B    SB1            ;B=PC SWITCH BANK #1
EA94 C404        1704        AND B    #04H           ;ISOLATE FULL DUPLEX SWITCH
EA96 39          1705        RTS
                 1706
                 1707
                 1708
                 1709
                 1710
                 1711
                 1712
                 1713
                 1714 ;*****************************************************************************
                 1715 ;                          CONTROL CODE ROUTINES
                 1716 ;*****************************************************************************
                 1717
                 1718
                 1719 ;************                                  ***********************************
EA97 868015      1720 NUL    LDA A    RAM+15H
EA9A B7804F      1721        STA A    PRO
EA9D 7F8034      1722        CLR      RAM+34H
EAA0 3B          1723        RTI
                 1724
                 1725
                 1726 ;************ SELECT AUTO INCREMENT NUMBER--CONTROL A ****************************
EAA1 BDEA91      1727 SOH    JSR      CHKDUP         ;CHECK DUPLEX SWITCH
EAA4 2605        1728        BNE      $+7            ;Z=0 IF SWITCH ON
EAA6 C60F        1729        LDA B    #0FH           ;BLINK CODE
EAA8 BDE77E      1730        JSR      DT232
```

```
EAA8 7F802D      1731        CLR     FLDFLG          ;CLEAR FIELD FLAG
EAAC FE800A      1732        LDX     NCF             ;INDEX=NEXT CHARACTER TO ENTER ADDRESS
EAB1 FF801A      1733        STX     AUTOAD          ;SAVE STARTING RAM ADDRESS OF AUTO INCREMENT NUMBER
EAB4 B68018      1734        LDA A   CXP
EAB7 B7802A      1735        STA A   AINCXP
EABA B68019      1736        LDA A   CYP
EABD B7802B      1737        STA A   AINCYP
EAC0 8601        1738        LDA A   #01H
EAC2 B78029      1739        STA A   INCFLG          ;SET INCREMENT FLAG
EAC5 7F8028      1740        CLR     INCNUM          ;INITIALIZE # OF DIGITS IN AUTO INCREMENT NUMBER
EAC8 B68015      1741        LDA A   RAM+15H
EACB B7804E      1742        STA A   PBD
EACE 7F8034      1743        CLR     RAM+34H
EAD1 3B          1744        RTI
                 1745
                 1746
                 1747 ;************ FIXED FIELD ENTRY ACTIVATION--CONTROL B ******************************
EAD2 8601        1748 STX    LDA A   #01H
EAD4 B7802D      1749        STA A   FLDFLG          ;SET FIELD FLAG TO FIXED MODE
EAD7 B68015      1750        LDA A   RAM+15H
EADA B7804E      1751        STA A   PBD
EADD 7F8034      1752        CLR     RAM+34H
EAE0 3B          1753        RTI
                 1754
                 1755
                 1756 ;************ CLEAR TAB SETTING--CONTROL C ****************************************
EAE1 CE8036      1757 ETX    LDX     #TAB1
EAE4 A660        1758        LDA A   00H,X
EAE6 B68020      1759        ADD A   CURLFT
EAE9 4A          1760        DEC A
EAEA B18018      1761        CMP A   CXP             ;CHECK TAB VALUE AGAINST CURSOR X POSITION
EAED 2710        1762        BEQ     $+18
EAEF 08          1763        INX
EAF0 8C8040      1764        CPX     #RAM+40H        ;CHECK IF ALL TABS HAVE BEEN CHECKED
EAF3 26EF        1765        BNE     $-15            ;Z=0 IF ALL NOT CHECKED
EAF5 B68015      1766        LDA A   RAM+15H
EAF8 B7804E      1767        STA A   PBD
EAFB 7F8034      1768        CLR     RAM+34H
EAFE 3B          1769        RTI
EAFF A601        1770        LDA A   01H,X           ;A=NEXT TAB VALUE
EB01 818011      1771        CMP A   TEV             ;CHECK IF TAB CLEARED
EB04 2700        1772        BEQ     $+15            ;Z=1 IF CLEARED
EB06 A700        1773        STA A   00H,X           ;MOVE NEXT VALID TAB UP IN SEQUENCE
EB08 08          1774        INX
EB09 8C803F      1775        CPX     #RAM+3FH        ;CHECK IF ALL TABS CHECKED
EB0C 26F1        1776        BNE     $-13            ;Z=0 IF NOT ALL CHECKED
EB0E B68011      1777        LDA A   TEV             ;A=NUMBER OF CHARACTERS ON PLATE LINE
EB11 A700        1778        STA A   00H,X           ;CLEAR TAB
EB13 B68015      1779        LDA A   RAM+15H
EB16 B7804E      1780        STA A   PBD
EB19 7F8034      1781        CLR     RAM+34H
EB1C 3B          1782        RTI
```

Rev. video flag

```
                1783
                1784
                1785 ;************ DECREMENT DISPLAYED AUTO INCREMENT NUMBER--CONTROL D ************************
EB10 BDEA21     1786 DOT     JSR      CHKDUP          ;CHECK DUPLEX SWITCH
EB20 2636       1787          BNE      BPT53           ;Z=0 IF SWITCH IS ON
EB22 F68028     1788          LDA B    INCNUM          ;B=NUMBER OF DIGITS IN NUMBER
EB25 2736       1789          BEQ      BPT53           ;Z=1 IF AUTO INCREMENT NUMBER FEATURE NOT ACTIVE
EB27 BDEA1F     1790          JSR      DECNUM          ;DECREMENT NUMBER
EB2A F68003     1791          LDA B    SS1             ;B=PC SWITCH BANK #1 SETTINGS
EB2D C407       1792          AND B    #07H            ;ISOLATE OPTION SETTINGS
EB2F C103       1793          CMP B    #03H            ;CHECK IF CRT AND HOLDER OPTIONS ACTIVE
EB31 262D       1794          BNE      BPT53           ;Z=0 IF OPTIONS NOT ACTIVE
EB33 C606       1795          LDA B    #06H            ;LOAD CURSOR CODE
EB35 BDE77E     1796          JSR      OT232
EB38 F6802A     1797          LDA B    AINCXP          ;B=X POSITION OF AUTO INCREMENT NUMBER
EB3B BDE77E     1798          JSR      OT232
EB3E F6802B     1799          LDA B    AINCYP          ;B=Y POSITION OF AUTO INCREMENT NUMBER
EB41 BDE77E     1800          JSR      OT232
EB44 C60F       1801          LDA B    #0FH            ;BLINK CODE
EB46 BDE77E     1802          JSR      OT232
EB49 B68028     1803          LDA A    INCNUM
EB4C FE801A     1804          LDX      AUTOAD          ;STORAGE ADDRESS OF AUTO INCREMENT NUMBER
EB4F E600       1805          LDA B    00H,X           ;AUTO INCREMENT NUMBER DIGIT
EB51 BDF77F     1806          JSR      OT232
EB54 08         1807          INX
EB55 4A         1808          DEC A
EB56 26F7       1809          BNE      *-7
EB58 C60C       1810          LDA B    #0CH            ;NORMAL DISPLAY CODE
EB5A BDE77E     1811          JSR      OT232
EB5D BDE9C0     1812          JSR      POSCUR
EB60 B68015     1813 BPT53    LDA A    RAM+15H
EB63 B7804E     1814          STA A    PPO
EB66 7F8034     1815          CLR      RAM+34H
EB69 3B         1816          RTI
                1817
                1818
                1819 ;************ MULTIPLE ENTRY MODE SELECT--CONTROL E ****************************
EB6A 7F802D     1820 ENQ      CLR      FLDFLG          ;CLEAR FIELD FLAG
EB6D 8601       1821          LDA A    #01H
EB6F B78007     1822          STA A    RAM+7           ;SET ENTRY FLAG
EB72 7EEBC3     1823          JMP      BPT54           ;HOME ROUTINE
                1824
                1825
                1826 ;************ AUTO INCREMENT NUMBER ENTRY COMPLETE--CONTROL F ********************
EB75 BDEA21     1827 ACK      JSR      CHKDUP          ;CHECK DUPLEX SWITCH
EB78 2605       1828          BNE      *+7             ;Z=0 IF SWITCH IS ON
EB7A C60E       1829          LDA B    #0EH            ;NORMAL DISPLAY MODE CODE
EB7C BDE77E     1830          JSR      OT232
EB7F 7F8022     1831          CLR      INCFLG          ;CLEAR INCREMENT FLAG
EB82 B68015     1832          LDA A    RAM+15H
EB85 B7804E     1833          STA A    PPO
EB88 7F8034     1834          CLR      RAM+34H
```

```
E88B 39          1835        RTI
                 1836
                 1837
                 1838 ;************ MOTORS TO HOME POSITION BUT NO DATA DESTROYED--CONTROL G **************
E88C 7EEC03      1839 BEL    JMP       BPT54
                 1840
                 1841
                 1842 ;************ MOVE TABLE BACK ONE CHARACTER--CONTROL H ******************************
E88F B68007      1843 BS     LDA A     RAM+7          ;A=MULTIPLE ENTRY MODE FLAG
E892 8102        1844        CMP A     #02H           ;CHECK IF IN PRINT MODE
E894 260A        1845        BNE       $+12           ;Z=0 IF NOT IN PRINT MODE
E896 B68015      1846        LDA A     RAM+15H
E899 B7804E      1847        STA A     PB0
E89C 7F8034      1848        CLR       RAM+34H
E89F 39          1849        RTI
E8A0 4D          1850        TST A
E8A1 270F        1851        BEQ       BPT52          ;Z=1 IF NOT IN ENTRY MODE
E8A3 F68010      1852        LDA B     CXP            ;B=CURSOR X POSITION
E8A6 F18020      1853        CMP B     CURLFT         ;CHECK IF AT LEFT MARGIN
E8A9 2610        1854        BNE       BPT20          ;Z=0 IF NOT AT MARGIN
E8AB B68024      1855        LDA A     SCNSRT         ;HORIZONTAL SCREEN OFFSET VALUE
E8AE 2618        1856        BNE       BPT20          ;Z=0 IF OFFSET NOT 0
E8B0 2007        1857        BRA       $+9
E8B2 F6804E      1858 BPT52  LDA B     PB0            ;B=PIA-B OUTPUT REG
E8B5 C402        1859        AND B     #02H           ;ISOLATE TABLE SENSOR BIT
E8B7 260A        1860        BNE       $+12           ;Z=0 IF TABLE NOT INDEXED
E8B9 B68015      1861        LDA A     RAM+15H
E8BC B7804E      1862        STA A     PB0
E8BF 7F8034      1863        CLR       RAM+34H
E8C2 39          1864        RTI
E8C3 C601        1865        LDA B     #01H           ;CW MOTION INCREMENTOR
E8C5 BDE665      1866        JSR       MOVTAB
E8C8 FE800A      1867 BPT20  LDX       NCE            ;INDEX=ADDRESS OF NEXT CHARACTER ENTRY
E8CB 09          1868        DEX
E8CC FF800A      1869        STX       NCE
E8CF FF8008      1870        STX       NCTP
E8D2 7F8014      1871        CLR       RAM+14H
E8D5 7F8013      1872        CLR       MAXCE          ;CLEAR MAX CHARACTERS ENTERED FLAG
E8D8 7D0029      1873        TST       INCFLG         ;CHECK IF AUTO INCREMENT FLAG SET
E8DB 2708        1874        BEQ       $+10           ;Z=1 IF FLAG NOT SET
E8DD 7D0028      1875        TST       INCNUM         ;CHECK IF NO DIGITS IN AUTO INCREMENT NUMBER YET
E8E0 2703        1876        BEQ       $+5            ;Z=1 IF NO ENTERED DIGITS
E8E2 7A0028      1877        DEC       INCNUM         ;REDUCE NUMBER OF DIGITS IN AUTO INCREMENT NUMBER
E8E5 B68020      1878        LDA A     CURLFT         ;A=CURSOR LEFT MARGIN VALUE
E8E8 B18018      1879        CMP A     CXP            ;COMPARE CURSOR X POSITION WITH LEFT MARGIN VALUE
E8EB 2715        1880        BEQ       BPT40          ;Z=1 IF SAME VALUE
E8ED 7A8018      1881        DEC       CXP
E8F0 BDEA91      1882        JSR       CHKDUP         ;CHECK DUPLEX SWITCH
E8F3 2603        1883        BNE       $+5            ;Z=0 IF SWITCH IS ON
E8F5 BDE9CE      1884        JSR       POSCUR         ;POSITION CURSOR
E8F8 7F8034      1885 BPT37  CLR       RAM+34H        ;CLEAR CONTROL CODE COMMAND FLAG
E8FB B68015      1886 BPT37A LDA A     RAM+15H
```

```
EBFE B78045        1887          STA A    PB0
EC01 33            1888          RTI
EC02 708024        1889 BPT40    DEC      SRNSRT
EC05 30EA91        1890          JSR      CHKDUP          ;CHECK DUPLEX SWITCH
EC08 26F6          1891          BNE      BPT37           ;Z=0 IF SWITCH IS ON
EC0A 708024        1892          TST      SRNSRT
EC0D 2603          1893          BNE      $+5
EC0F 30E780        1894          JSR      LDSRN
EC12 20E7          1895          BRA      BPT37A
                   1896
                   1897
                   1898 ;************ MOVE TABLE TO LEFT ONE CHARACTER--CONTROL I ************************
EC14 B68007        1899 HT       LDA A    RAM+7           ;A=MULTIPLE ENTRY MODE FLAG
EC17 8102          1900          CMP A    #02H            ;CHECK IF IN PRINT MODE
EC19 260A          1901          BNE      $+12            ;Z=0 IF NOT IN PRINT MODE
EC1B B68015        1902 BPT25    LDA A    RAM+15H
EC1E B78045        1903          STA A    PB0
EC21 7F8034        1904          CLR      RAM+34H
EC24 33            1905          RTI
EC25 F68000        1906          LDA B    TPOS            ;A=TABLE POSITION CODE
EC28 F18011        1907          CMP B    TEV             ;CHECK IF AT END VALUE
EC2B 27F6          1908          BEQ      BPT25           ;Z=1 IF AT END VALUE
EC2D 4D            1909          TST A
EC2E 2607          1910          BNE      BPT21           ;Z=0 IF IN ENTRY MODE
EC30 C6FF          1911          LDA B    #0FFH           ;CCW MOTION INCREMENTOR
EC32 BDE665        1912          JSR      MOVTAB
EC35 2005          1913          BRA      $+7
EC37 B68014        1914 BPT21    LDA A    RAM+14H         ;A=END OF LINE FLAG
EC3A 260F          1915          BNE      BPT25           ;Z=0 IF AT END OF LINE
EC3C FE800A        1916          LDX      NCE             ;INDEX=ADDRESS OF NEXT CHARACTER ENTRY
EC3F 08            1917          INX
EC40 FF800A        1918          STX      NCE
EC43 FF8008        1919          STX      NCTP
EC46 BC801C        1920          CPX      RAM+1CH         ;CHECK IF AT END OF PAGE
EC49 2605          1921          BNE      $+7             ;Z=0 IF NOT AT END OF PAGE
EC4B 8601          1922          LDA A    #01H
EC4D B78013        1923          STA A    MAXCE           ;SET MAX CHARACTERS ENTERED FLAG
EC50 B68021        1924          LDA A    CURRHT          ;A=CURSOR RIGHT MARGIN VALUE
EC53 B18010        1925          CMP A    CXP             ;COMPARE X POSITION WITH RIGHT MARGIN VALUE
EC56 2727          1926          BEQ      BPT41           ;Z=1 IF SAME VALUE
EC58 7C8010        1927          INC      CXP             ;MOVE CURSOR ONE POSITION TO THE RIGHT
EC5B 30EA91        1928          JSR      CHKDUP          ;CHECK DUPLEX SWITCH
EC5E 2603          1929          BNE      $+5             ;Z=0 IF SWITCH IS ON
EC60 BDE9CE        1930          JSR      POSCUR
EC63 7F8034        1931 BPT55    CLR      RAM+34H         ;CLEAR CONTROL CODE COMMAND FLAG
EC66 B68010        1932 BPT55A   LDA A    CXP             ;A=CURSOR X POSITION
EC69 8003          1933          SUB A    #03H            ;SUBTRACT 4 OF CHARACTERS IN VERTICAL BORDER
EC6B FB8024        1934          ADD A    SRNSRT          ;ADD SCREEN HORIZONTAL OFFSET
EC6E 918011        1935          CMP A    TEV             ;CHECK IF CURSOR AT END OF LINE
EC71 2605          1936          BNE      BPT39           ;Z=0 IF NOT AT END OF LINE
EC73 8601          1937          LDA A    #01H
EC75 B78014        1938          STA A    RAM+14H         ;SET END OF LINE FLAG
```

```
EC78 B68015      BPT39  LDA A   RAM+15H
EC7B B7804E             STA A   PIO
EC7E 3B                 RTI
EC7F 7C8024      BPT41  INC     SRNSRT
EC82 20EA21             JSR     CHKDUP          ;CHECK DUPLEX SWITCH
EC85 26DC               BNE     BPT55           ;Z=0 IF SWITCH IS ON
EC87 2000               BRA     BPT55A
                 ;************ MOVE HOLDER UP ONE LINE--CONTROL J ********************************
EC89 B68033      LF     LDA A   S01             ;A=B SELECTION PC SWITCH SETTINGS
EC8C 8401               AND A   #01H            ;CHECK IF HOLDER OPTION ACTIVE
EC8E 2603               BNE     $+13            ;Z=0 IF OPTION ACTIVE
EC90 B68015             LDA A   RAM+15H
EC93 B7804E             STA A   PIO
EC96 7F8034             CLR     RAM+34H
EC99 0E                 CLI
EC9A 3B                 RTI
EC9B F68007             LDA A   RAM+7           ;A=MULTIPULE ENTRY MODE FLAG
EC9E 8102               CMP A   #02H            ;CHECK IF IN PRINT MODE
ECA0 2601               BNE     $+13            ;Z=0 IF NOT IN PRINT MODE
ECA2 B68015             LDA A   RAM+15H
ECA5 B7804E             STA A   PIO
ECA8 7F8034             CLR     RAM+34H
ECAB 0E                 CLI
ECAC 3B                 RTI
ECAD 4D                 TST A
ECAE 261A               BNE     BPT22           ;Z=0 IF IN ENTRY MODE
ECB0 B68010             LDA A   HPOS            ;A=HOLDER POSITION
ECB3 B18012             CMP A   HEV             ;CHECK IF AT LAST LINE OF PLATE
ECB6 2603               BNE     $+13
ECB8 B68015             LDA A   RAM+15H
ECBB B7804E             STA A   PIO
ECBE 7F8034             CLR     RAM+34H
ECC1 0E                 CLI
ECC2 3B                 RTI
ECC3 C6FF               LDA B   #0FFH           ;CCW MOTION INCREMENTOR
ECC5 8DE6AF             JSR     MOVHLD
ECC8 2000               BRA     BPT56
ECCA B68012      BPT22  LDA A   HEV             ;A=# OF LINES ON PLATE
ECCD 4C                 INC A
ECCE F68019             LDA B   CYP             ;B=CURSOR Y POSITION
ECD1 FB8025             ADD B   SRNLIN          ;ADD VERTICAL OFFSET VALUE
ECD4 11                 CBA                     ;CHECK IF END OF PLATE
ECD5 273E               BEQ     BPT42           ;Z=1 IF AT END OF PLATE
ECD7 B68011      BPT56  LDA A   TEV             ;A=TABLE END VALUE
ECDA 0C                 CLC
ECDB BB800B             ADD A   NCE+1           ;ADD ONE LINES WORTH OF CHARACTERS TO PRESENT ADDRESS
ECDE B7800B             STA A   NCE+1
ECE1 B6800A             LDA A   NCE
ECE4 8900               ADC A   #00H
ECE6 B7800A             STA A   NCE
```

```
ECE9 FE000A      1991        LDX     NCE
ECEC BC801C      1992        CPX     RAM+1CH        ;CHECK IF AT MAX CHARACTERS ENTERED POINT
ECEF 2605        1993        BNE     $+7            ;Z=0 IF NOT AT MAX POINT
ECF1 8601        1994        LDA A   #01H
ECF3 B78013      1995        STA A   MAXCE          ;SET MAX CHARACTERS ENTERED FLAG
ECF6 FE8008      1996        LDX     NCTP
ECF9 08          1997        INX
ECFA 9C000A      1998        CPX     NCE
ECFD 26FA        1999        BNE     $-4
ECFF FF8008      2000        STX     NCTP
ED02 B68023      2001        LDA A   CURBOT         ;A=CURSOR BOTTOM MARGIN VALUE
ED05 B18019      2002        CMP A   CYP            ;COMPARE CURSOR Y POSITION WITH MARGIN VALUE
ED08 2716        2003        BEQ     BPT43          ;Z=1 IF SAME VALUE
ED0A 7C8019      2004        INC     CYP            ;MOVE CURSOR ONE LINE DOWN
ED0D BDFA91      2005        JSR     CHKDUP         ;CHECK DUPLEX SWITCH
ED10 2603        2006        BNE     $+5            ;Z=0 IF SWITCH IS ON
ED12 BDFVCE      2007        JSR     POSCUR
ED15 7F8034      2008 BPT42  CLR     RAM+34H
ED18 B68015      2009 BPT42A LDA A   RAM+15H
ED1B B7B04E      2010        STA A   P30
ED1E 0E          2011        CLI
ED1F 3B          2012        RTI
ED20 7C8025      2013 BPT43  INC     SRNLIN         ;INCREASE LINE OFFSET VALUE
ED23 BDF780      2014        JSR     LDSRN
ED26 BDFA91      2015        JSR     CHKDUP         ;CHECK DUPLEX SWITCH
ED29 26EA        2016        BNE     BPT42          ;Z=0 IF SWITCH IS ON
ED2B 20EF        2017        BRA     BPT42A
                 2018
                 2019
                 2020 ;************ MOVE HOLDER DOWN ONE LINE--CONTROL K ********************************
ED2D B68003      2021 VT     LDA A   SS1            ;A=0 SELECTION PC SWITCH SETTINGS
ED30 8401        2022        AND A   #01H           ;CHECK IF HOLDER OPTION ACTIVE
ED32 260A        2023        BNE     $+12           ;Z=0 IF OPTION ACTIVE
ED34 B68015      2024        LDA A   RAM+15H
ED37 B7B04E      2025        STA A   P30
ED3A 7F8034      2026        CLR     RAM+34H
ED3D 3B          2027        RTI
ED3E B68007      2028        LDA A   RAM+7          ;A=ENTRY MODE FLAG
ED41 8102        2029        CMP A   #02H           ;CHECK IF IN PRINT MODE
ED43 260A        2030        BNE     $+12           ;Z=0 IF NOT IN PRINT MODE
ED45 B68015      2031        LDA A   RAM+15H
ED48 B7B04E      2032        STA A   P30
ED4B 7F8034      2033        CLR     RAM+34H
ED4E 3B          2034        RTI
ED4F 40          2035        TST A
ED50 2616        2036        BNE     BPT23          ;Z=0 IF IN ENTRY MODE
ED52 B68010      2037        LDA A   HPOS           ;A=HOLDER POSITION
ED55 8101        2038        CMP A   #01H           ;CHECK IF HOLDER ON FIRST LINE OF PLATE
ED57 260A        2039        BNE     $+12           ;Z=0 IF NOT ON FIRST LINE
ED59 B68015      2040        LDA A   RAM+15H
ED5C B7B04E      2041        STA A   P30
ED5F 7F8034      2042        CLR     RAM+34H
```

```
ED62 3B          2043          RTI
ED63 C661        2044          LDA B    #61H          ;CW MOTION INCREMENTOR
ED65 BDE6AF      2045          JSR      MOVHLD
ED68 F68011      2046 RPT23    LDA B    TEV           ;B=TABLE END VALUE
ED6B 0C          2047          CLC
ED6C B68008      2048          LDA A    NCE+1
ED6F 10          2049          SBA                    ;SUBTRACT ONE LINES WORTH OF CHARACTERS TO PRESENT ADDRESS
ED70 B78008      2050          STA A    NCE+1
ED73 B68008      2051          LDA A    NCE
ED76 8200        2052          SBC A    #00H
ED78 B78008      2053          STA A    NCE
ED7B FE8008      2054          LDX      NCE
ED7E FF8008      2055          STX      NCTP
ED81 7F8013      2056          CLR      MAXCE
ED84 B68022      2057          LDA A    CURTOP        ;A=CURSOR TOP MARGIN VALUE
ED87 918019      2058          CMP A    CYP           ;COMPARE CURSOR Y POSITION WITH TOP MARGIN VALUE
ED8A 2715        2059          BEQ      RPT45         ;Z=1 IF SAME VALUE
ED8C 7A8019      2060          DEC      CYP           ;MOVE CURSOR UP ONE LINE
ED8F BDEA91      2061          JSR      CHKDUP        ;CHECK DUPLEX SWITCH
ED92 2603        2062          BNE      $+5           ;Z=0 IF SWITCH IS ON
ED94 BDF9CE      2063          JSR      POSCUR
ED97 7F8034      2064 RPT44    CLR      RAM+34H       ;CLEAR CONTROL CODE COMMAND FLAG
ED9A B68015      2065 RPT44A   LDA A    RAM+15H
ED9D B7804E      2066          STA A    PSO
EDA0 3B          2067          RTI
EDA1 7A8025      2068 RPT45    DEC      SRNLIN        ;MOVE SCREEN DATA DOWN ONE LINE
EDA4 BDEA91      2069          JSR      CHKDUP        ;CHECK DUPLEX SWITCH
EDA7 26EB        2070          BNE      RPT44         ;Z=0 IF SWITCH IS ON
EDA9 708025      2071          TST      SRNLIN
EDAC 2603        2072          BNE      $+5
EDAE BDF780      2073          JSR      LOSRN
EDB1 20F7        2074          BRA      RPT44A
                 2075
                 2076
                 2077 ;************ CLEAR BUFFER AND SCREEN MEMORY THEN INDEX TABLE, WHEEL, & HOLDER--C L*
EDB3 BDE197      2078 FF       JSR      CLRBUF        ;SET BUFFER TO ALL SPACES
EDB6 7F8035      2079          CLR      RAM+35H       ;RESET SWITCH SETTINGS DETERMINATION SEQUENCE
EDB9 B68003      2080          LDA A    SB1           ;A=PC SWITCH BANK #1
EDBC 8404        2081          AND A    #04H          ;CHECK IF DUPLEX SWITCH IS ON
EDBE 2603        2082          BNE      $+5           ;Z=0 IF SWITCH IS ON
EDC0 BDE79D      2083          JSR      CLRSRN        ;CLEAR SCREEN MEMORY
EDC3 7F8030      2084 RPT54    CLR      ABORT         ;RESET ABORT FLAG
EDC6 B68007      2085          LDA A    RAM+7         ;A=ENTRY MODE FLAG
EDC9 8102        2086          CMP A    #02H          ;CHECK IF IN PRINT MODE
EDCB 27CA        2087          BEQ      RPT44         ;Z=1 IF IN PRINT MODE
EDCD 4D          2088          TST A                  ;CHECK IF IN ENTRY MODE
EDCE 2610        2089          BNE      $+18          ;Z=0 IF IN ENTRY MODE
EDD0 BDE1D5      2090          JSR      ZERT
EDD3 BDE1A5      2091          JSR      ZERW
EDD6 B68003      2092          LDA A    SB1           ;A=B SELECTION PC SWITCH SETTINGS
EDD9 8401        2093          AND A    #01H          ;ISOLATE HOLDER OPTION BIT
EDDB 2703        2094          BEQ      $+5           ;Z=1 IF OPTION NOT ACTIVE
```

```
EE0D BDE236     2095          JSR     7ERH
EE10 7F8013     2096          CLR     MAXCF        ;CLEAR MAX CHARACTERS ENTERED FLAG
EE13 7F8014     2097          CLR     RAM+14H      ;CLEAR LAST CARACTER POSITION FLAG
EE16 CE8040     2098          LDX     #8040H       ;INDEX=ENTERED CHARACTERS STARTING MEMORY ADDRESS
EE19 FF8008     2099          STX     NCTP         ;INITIALIZE NEXT CHARACTER TO PRINT POINTER
EE1C FF800A     2100          STX     NCE          ;INITIALIZE POINTER OF NEXT CHARACTER TO BE ENTERED
EE1F B68020     2101          LDA A   CURLFT       ;A-CURSOR LEFT MARGIN VALUE
EE22 B78018     2102          STA A   CXP          ;SET CURSOR X POSITION TO LEFT MARGIN
EE25 B68022     2103          LDA A   CURTOP       ;A-CURSOR TOP MARGIN VALUE
EE28 B78019     2104          STA A   CYP          ;SET CURSOR Y POSITION TO TOP MARGIN
EE2B 80EA91     2105          JSR     CHKDUP       ;CHECK DUPLEX SWITCH
EE2E 2603       2106          BNE     *+5          ;Z=0 IF SWITCH IS ON
EE30 80E9CE     2107          JSR     POSCUR       ;POSITION CURSOR ROUTINE
EE33 BDEA91     2108          JSR     CHKDUP       ;CHECK DUPLEX SWITCH
EE36 2705       2109          BEQ     *+7          ;Z=1 IF SWITCH IS OFF
EE38 C61B       2110          LDA B   #1BH         ;PRINT FINISHED CODE
EE3A 80E77E     2111          JSR     OT232
EE3D 7F8024     2112          CLR     SRNSRT       ;CLEAR SCREEN CHARACTER OFFSET VALUE
EE40 7F8025     2113          CLR     SRNLIN       ;CLEAR SCREEN LINE OFFSET VALUE
EE43 BDEA91     2114          JSR     CHKDUP       ;CHECK DUPLEX SWITCH
EE46 2633       2115          BNE     BPT51        ;Z=0 IF SWITCH IS ON
EE48 BDE7B6     2116          JSR     LDSRN        ;RELOAD SCREEN DATA
EE4B B68020     2117          LDA A   INCNUM       ;B=# OF DIGITS IN AUTO INCREMENT NUMBER
EE4E 272F       2118          BEQ     BPT69        ;Z=1 IF AUTO INCREMENT NOT ACTIVE
EE20 F68003     2119          LDA B   S31          ;B=PC SWITCH BANK #1 SETTINGS
EE23 C407       2120          AND B   #07H         ;ISOLATE OPTION SETTINGS
EE25 C103       2121          CMP B   #03H         ;CHECK IF CRT AND HOLDER OPTIONS ACTIVE
EE27 262A       2122          BNE     BPT51        ;Z=0 IF OPTIONS NOT ACTIVE
EE29 C606       2123          LDA B   #06H         ;LOAD CURSOR CODE
EE2B BDE77E     2124          JSR     OT232
EE2E F6802A     2125          LDA B   AINCXP       ;B=X POSITION OF AUTO INCREMENT NUMBER
EE31 80E77E     2126          JSR     OT232
EE34 F6802B     2127          LDA B   AINCYP       ;B=Y POSITION OF AUTO INCREMENT NUMBER
EE37 80E77E     2128          JSR     OT232
EE3A C60F       2129          LDA B   #0FH         ;BLINK CODE
EE3C 80E77E     2130          JSR     OT232
EE3F FE8016     2131          LDX     AUTOAD       ;STORAGE ADDRESS OF AUTO INCREMENT NUMBER
EE42 E600       2132          LDA B   00H,X        ;AUTO INCREMENT NUMBER DIGIT
EE44 BDE77E     2133          JSR     OT232
EE47 08         2134          INX
EE48 4A         2135          DEC A
EE49 26F7       2136          BNE     *-7
EE4B C60F       2137 BPT69    LDA B   #0FH         ;NORMAL DISPLAY CODE
EE4D 80E77E     2138          JSR     OT232
EE50 BDE082     2139          JSR     DRAWHD       ;DRAW BORDER HEADERS
EE53 B68015     2140 BPT51    LDA A   RAM+15H
EE56 B7F04E     2141          STA A   PRO
EE59 7F8034     2142          CLR     RAM+34H
EE5C 3B         2143          RTI
                2144
                2145
```

```
                2146 ;************ INDEX TABLE--RETURN OR CONTROL M ************************************
EE50 B68007     2147 CR      LDA A   RAM+7          ;A=MULTIPULE ENTRY MODE FLAG
EE60 8102       2148         CMP A   #02H           ;CHECK IF IN PRINT MODE
EE62 260A       2149         BNE     $+12           ;Z=0 IF NOT IN PRINT MODE
EE64 B68015     2150         LDA A   RAM+15H
EE67 B7B04E     2151         STA A   PBO
EE6A 7F8034     2152         CLR     RAM+34H
EE6D 3B         2153         RTI
EE6E F68003     2154         LDA B   SR1            ;B=SWITCH BANK #1 SETTINGS
EE71 C401       2155         AND B   #01H           ;CHECK IF HOLDER OPTION ACTIVE
EE73 2701       2156         BEQ     BPT68          ;Z=1 IF OPTION NOT ACTIVE
EE75 F68013     2157         LDA B   MAXCE          ;B=MAX CHARACTERS ENTERED FLAG
EE78 270A       2158         BEQ     $+12           ;Z=1 IF FLAG NOT SET
EE7A B68015     2159         LDA A   RAM+15H
EE7D B7B04F     2160         STA A   PBO
EE80 7F8034     2161         CLR     RAM+34H
EE83 3B         2162         RTI
EE84 0F         2163 BPT68   SEI
EE85 36         2164         PSH A
EE86 F68018     2165         LDA B   CXP            ;B=CURSOR X POSITION
EE89 F08020     2166         SUB B   CURLFT         ;SUBTRACT # OF CHARACTERS IN LEFT MARGIN
EE8C FB8024     2167         ADD B   SRNSRT         ;ADD HORIZONTAL OFFSET VALUE
EE8F F10011     2168         CMP B   TEV            ;CHECK IF AT RIGHT MARGIN
EE92 2710       2169         BEQ     BPT26          ;Z=1 IF AT RIGHT MARGIN
EE94 5C         2170         INC B
EE95 FE800A     2171         LDX     NCE            ;INDEX=ADDRESS OF NEXT CHARACTER ENTRY
EE98 08         2172         INX
EE99 FF800A     2173         STX     NCE
EE9C F10011     2174         CMP B   TEV            ;CHECK IF CURSOR AT END OF LINE
EE9F 2703       2175         BEQ     BPT26          ;Z=1 IF AT END OF LINE
EEA1 5C         2176         INC B
EEA2 26F4       2177         BRA     $-10
EEA4 0C         2178 BPT26   CLC
EEA5 B68009     2179         LDA A   NLE+1
EEA8 10         2180         SBA
EEA9 B78009     2181         STA A   NLE+1
EEAC B6800A     2182         LDA A   NCE
EEAF 8200       2183         SBC A   #00H
EEB1 B7800A     2184         STA A   NCE
EEB4 FE800A     2185         LDX     NCE
EEB7 FF8008     2186         STX     NCTP
EEBA 32         2187         PUL A
EEBB 4D         2188         TST A                  ;CHECK IF IN ENTRY MODE
EEBC 2724       2189         BEQ     BPT40          ;Z=1 IF IN NORMAL MODE
EEBE F68020     2190         LDA B   CURLFT         ;B=CURSOR LEFT MARGIN
EEC1 F78018     2191         STA B   CXP
EEC4 B68024     2192         LDA A   SRNSRT
EEC7 2701       2193         BEQ     $+16           ;Z=1 IF NO OFFSET THUS NO NEED TO RELOAD SCREEN
EEC9 7F8024     2194         CLR     SRNSRT         ;RESET HORIZONTAL OFFSET VALUE
EECC BDEA91     2195         JSR     CHKDUP         ;CHECK DUPLEX SWITCH
EECF 2606       2196         BNE     $+8            ;Z=0 IF SWITCH IS ON
EED1 BDF7B0     2197         JSR     LDSRN          ;RELOAD SCREEN RAM
EED4 80E9CE     2198         JSR     POSCUR         ;POSITION CURSOR
```

```
EED7 B601        2199          LDA A    #01H
EED9 B7800F      2200          STA A    TPOS          ;TABLE POSITION REINITIALIZED
EEDC 7F8014      2201          CLR      RAM+14H
EEDF 7EEC87      2202          JMP      LF
EEE2 BDE1D5      2203 RPT30    JSR      ZERT
EEE5 BDE1A5      2204          JSR      ZERW
EEE8 B68003      2205          LDA A    SB1           ;CHECK IF HOLDER OPTION ACTIVE
EEEB 8401        2206          AND A    #01H          ;ISOLATE OPTION BIT
EEED 2616        2207          BNE      RPT81         ;Z=0 IF OPTION ACTIVE
EEEF CE8040      2208          LDX      #8040H
EEF2 FF8008      2209          STX      NCTP
EEF5 FF800A      2210          STX      NCE
EEF8 7F8014      2211          CLR      RAM+14H
EEFB B68015      2212          LDA A    RAM+15H
EEFE B7E04E      2213          STA A    PEO
EF01 7F8034      2214          CLR      RAM+34H
EF04 3B          2215          RTI
EF05 B68020      2216 RPT81    LDA A    CURLFT        ;A=CURSOR LEFT MARGIN VALUE
EF08 B78018      2217          STA A    CXP           ;SET CURSOR TO LEFT MARGIN
EF0B B68924      2218          LDA A    SRHSRT
EF0E 270E        2219          BEQ      *+16          ;Z=1 IF NO OFFSET THEN NO NEED TO RELOAD SCREEN
EF10 7F8024      2220          CLR      SRNSRT        ;RESET HORIZONTAL OFFSET VALUE
EF13 BDFA91      2221          JSR      CHKDUP        ;CHECK DUPLEX SWITCH
EF16 2606        2222          BNE      *+8           ;Z=0 IF SWITCH IS ON
EF18 BDE7B0      2223          JSR      LISRH         ;RELOAD SCREEN RAM
EF1B BDE9DE      2224          JSR      POSCUR        ;POSITION CURSOR
EF1E 7F8014      2225          CLR      RAM+14H
EF21 B68015      2226          LDA A    RAM+15H
EF24 B7E04E      2227          STA A    PEO
EF27 7EEC87      2228          JMP      LF
                 2229
                 2230
                 2231 ;************                    ************************************
EF2A B68015      2232 SO       LDA A    RAM+15H
EF2D B7E04E      2233          STA A    PEO
EF30 7F8034      2234          CLR      RAM+34H
EF33 3B          2235          RTI
                 2236
                 2237
                 2238 ;************                    ************************************
EF34 B68015      2239 SE       LDA A    RAM+15H
EF37 B7E04E      2240          STA A    PEO
EF3A 7F8034      2241          CLR      RAM+34H
EF3D 3B          2242          RTI
                 2243
                 2244
                 2245 ;************                    ************************************
EF3E B68015      2246 DLE      LDA A    RAM+15H
EF41 B7E04E      2247          STA A    PEO
EF44 7F8034      2248          CLR      RAM+34H
EF47 3B          2249          RTI
                 2250
                 2251
```

```
                 ;************                                        ************************************
EF48 B68015      DC1     LDA A   RAM+15H
EF4B B7804E              STA A   PBD
EF4E 7F8034              CLR     RAM+34H
EF51 3B                  RTI

                 ;************ REQUEST DISK DIRECTORY--CONTROL R ************************************
EF52 B68015      DC2     LDA A   RAM+15H         ;JUST RETURN SINCE NO INTERNAL ACTION NEEDED
EF55 B7804E              STA A   PBD
EF58 7F8034              CLR     RAM+34H
EF5B 3B                  RTI

                 ;************ SET TAB ROUTINE--CONTROL S ************************************************
EF5C B68018      DC3     LDA A   CXP             ;A=CURSOR X POSITION
EF5F B08020              SUB A   CURLFT          ;SUBTRACT # OF CHARACTERS IF LEFT MARGIN
EF62 4C                  INC A
EF63 CE8036              LDX     #TAB1           ;INDEX=RAM ADDRESS OF TAB #1 VALUE
EF66 E600                LDA B   00H,X           ;B=TAB VALUE
EF68 11                  CBA                     ;CHECK IF POSITION AND TAB VALUE SAME
EF69 2310                BLS     $+18            ;IF TAB VALUE GREATER THAN X POSITION
EF6B 08                  INX
EF6C 8C8040              CPX     #RAM+40H        ;CHECK IF ALL TABS CHECKED
EF6F 26F5                BNE     $-9             ;Z=0 IF ALL NOT CHECKED
EF71 B6800F              LDA A   RAM+15
EF74 B7804E              STA A   PBD
EF77 7F8034              CLR     RAM+34H
EF7A 3B                  RTI
EF7B A700                STA A   00H,X           ;STORE NEW TAB VALUE
EF7D 17                  TBA                     ;OLD TAB VALUE SWITCHED FROM B TO A
EF7E E601                LDA B   01H,X           ;B=NEXT TAB VALUE
EF80 08                  INX
EF81 8C8040              CPX     #RAM+40H        ;CHECK IF ALL TABS CHECKED
EF84 26F5                BNE     $-9             ;Z=0 IF ALL NOT CHECKED
EF86 20EC                BRA     $-18

                 ;************ MOVE TO NEXT TAB VALUE--CONTROL T ************************************
EF88 CE8036      DC4     LDX     #TAB1
EF8B A600                LDA A   00H,X           ;A=TAB VALUE
EF8D B08020              ADD A   CURLFT
EF90 4A                  DEC A
EF91 B18018              CMP A   CXP             ;CHECK TAB VALUE AGAINST CURSOR X POSITION
EF94 2210                BHI     $+18            ;IF TAB VALUE GREATER THAN X POSITION
EF96 08                  INX
EF97 8C8040              CPX     #RAM+40H        ;CHECK IF ALL TABS CHECKED
EF9A 26EF                BNE     $-15            ;Z=0 IF ALL NOT CHECKED
EF9C B68015              LDA A   RAM+15H
EF9F B7804E              STA A   PBD
EFA2 7F8034              CLR     RAM+34H
EFA5 3B                  RTI
```

```
EFA6 FE800A      2304        LDX     NCE             ;INDEX=NEXT CHARACTER ENTERED ADDRESS
EFA9 5F          2305        CLR B
EFAA 7C8018      2306        INC     CXP
EFAD 08          2307        INX
EFAE 5C          2308        INC B
EFAF B18018      2309        CMP A   CXP             ;CHECK IF CURSOR X POSITION NOW THAT OF TAB VALUE
EFB2 26F6        2310        BNE     $-8             ;Z=0 IF NOT YET AT TAB VALUE
EFB4 FF800A      2311        STX     NCE
EFB7 17          2312        TBA
EFB8 36          2313        PSH A
EFB9 C6FF        2314        LDA B   #0FFH           ;FORWARD TABLE MOTION CODE
EFBB BDE665      2315        JSR     MOVTAB          ;MOVE TABLE
EFBE 32          2316        PUL A
EFBF 4A          2317        DEC A
EFC0 26F6        2318        BNE     $-8             ;Z=0 IF TABLE NOT MOVED TO TAB POSITION
EFC2 BDE9CE      2319        JSR     POSCUR          ;POSITION CURSOR
EFC5 B68015      2320        LDA A   RAM+15H
EFC8 B7B04E      2321        STA A   PB0
EFCB 7F8034      2322        CLR     RAM+34H
EFCE 39          2323        RTI
                 2324
                 2325
                 2326 ;************ INCREMENT AUTO INCREMENT NUMBER--CONTROL U ************************
EFCF BDFA91      2327 NAK    JSR     CHKDUP          ;CHECK DUPLEX SWITCH
EFD2 263E        2328        BNE     BPT82           ;Z=0 IF SWITCH IS ON
EFD4 F68028      2329        LDA B   INCNUM          ;B=NUMBER OF DIGITS IN NUMBER
EFD7 2739        2330        BEQ     BPT82           ;Z=1 IF AUTO INCREMENT NUMBER FEATURE NOT ACTIVE
EFD9 BDE9F1      2331        JSR     AUTOINC         ;INCREMENT NUMBER
EFDC F6B003      2332        LDA B   SB1             ;B=PC SWITCH BANK #1 SETTINGS
EFDF C407        2333        AND B   #07H            ;ISOLATE OPTION SETTINGS
EFE1 C103        2334        CMP B   #03H            ;CHECK IF CRT AND HOLDER OPTIONS ACTIVE
EFE3 262D        2335        BNE     BPT82           ;Z=0 IF OPTIONS NOT ACTIVE
EFE5 C606        2336        LDA B   #06H            ;LOAD CURSOR CODE
EFE7 BDE77E      2337        JSR     OT232
EFEA F6802A      2338        LDA B   AINCXP          ;B=X POSITION OF AUTO INCREMENT NUMBER
EFED BDE77E      2339        JSR     OT232
EFF0 F6802B      2340        LDA B   AINCYP          ;B=Y POSITION OF AUTO INCREMENT NUMBER
EFF3 BDE77E      2341        JSR     OT232
EFF6 C60F        2342        LDA B   #0FH            ;BLINK CODE
EFF8 BDE77E      2343        JSR     OT232
EFFB B68028      2344        LDA A   INCNUM
EFFE FE801A      2345        LDX     AUTOAD          ;STORAGE ADDRESS OF AUTO INCREMENT NUMBER
F001 E600        2346        LDA B   00H,X           ;AUTO INCREMENT NUMBER DIGIT
F003 BDE77E      2347        JSR     OT232
F006 08          2348        INX
F007 4A          2349        DEC A
F008 26F7        2350        BNE     $-7
F00A C60F        2351        LDA B   #0FH            ;NORMAL DISPLAY CODE
F00C BDE77E      2352        JSR     OT232
F00F BDE9CE      2353        JSR     POSCUR
F012 B68015      2354 BPT82  LDA A   RAM+15H
F015 B7B04E      2355        STA A   PB0
```

```
F018 7F8034      2356        CLR      RAM+34H
F01B 3B          2357        RTI
                 2358
                 2359
                 2360 ;************ VARIABLE FIELD ENTRY MODE ACTIVATION--CONTROL V ********************
F01C 7F8020      2361 SYN    CLR      FLDFLG          ;CLEAR FIELD FLAG
F01F F68003      2362        LDA B    SB1             ;B=PC SWITCH BANK #1 SETTINGS
F022 C407        2363        AND B    #07H            ;ISOLATE OPTION SETTINGS
F024 C103        2364        CMP B    #03H            ;CHECK IF CKT AND HULIFR OPTIONS ACTIVE
F026 2603        2365        BNE      *+7             ;Z=0 IF SWITCH IS ON
F028 C601        2366        LDA B    #01H            ;SET TO NORMAL VIDEO MODE
F02A BDF72E      2367        JSR      OT232
F02D B68015      2368        LDA A    RAM+15H
F030 B7904E      2369        STA A    PB0
F033 7F8034      2370        CLR      RAM+34H
F036 3B          2371        RTI
                 2372
                 2373
                 2374 ;************ REQUEST FOR SWITCH SETTINGS--CONTROL W ******************************
F037 BDEA71      2375 ETB    JSR      CHKDUP          ;CHECK IF IN DUPLEX MODE
F03A 2701        2376        BEQ      *+13            ;Z=1 IF SWITCH OFF
F03C 86FF        2377        LDA A    #0FFH
F03E B78005      2378        STA A    RAM+5           ;ERASE X SWITCH SETTING VALUES
F041 B78006      2379        STA A    RAM+6           ;ERASE Y SWITCH SETTING VALUES
F044 BDE2A7      2380        JSR      NVSWIT          ;READ SWITCH SETTINGS
F047 B68015      2381        LDA A    RAM+15H
F04A B7904E      2382        STA A    PB0
F04D 7F8034      2383        CLR      RAM+34H
F050 3B          2384        RTI
                 2385
                 2386
                 2387
                 2388 ;************ RECEIVE FINAL X AND Y MOTION VALUES--CONTROL X ************************
F051 0F          2389 CAN    SEI
F052 B69000      2390        LDA A    RS232S          ;A=ACIA STATUS REG
F055 8401        2391        AND A    #01H            ;CHECK IF NEXT CHARACTER RECEIVED YET
F057 260B        2392        BNE      BPT29           ;Z=0 IF NEW CHARACTER IN ACIA
F059 B6904C      2393        LDA A    PA0             ;CLEAR PIA-A INTERUPT FLAG
F05C B6B04E      2394        LDA A    PB0             ;CLEAR PIA-B INTERUPT FLAG
F05F 20F0        2395        BRA      CAN
F061 B69001      2396 BPT29  LDA A    RS232I          ;A=RECEIVED DATA BYTE
F064 0E          2397        CLI
F065 16          2398        TAB
F066 8407        2399        AND A    #07H            ;ISOLATE FINAL X MOTION SETTING
F068 B78028      2400        STA A    RAM+28H
F06B 54          2401        LSR B
F06C 54          2402        LSR B
F06D 54          2403        LSR B
F06E 54          2404        LSR B
F06F C407        2405        AND B    #07H            ;ISOLATE FINAL Y MOTION SETTING
F071 F78029      2406        STA B    RAM+29H
F074 BDE31C      2407        JSR      BPT20
```

```
F077 B68015      2408          LDA A    RAM+15H
F07A B7B04E      2409          STA A    PRO
F07D 7F8035      2410          CLR      RAM+35H          ;RESET SWITCH SETTINGS DETERMINATION SEQUENCE FLAG
F080 7F8034      2411          CLR      RAM+34H          ;RESET RECEIVED CONTROL CODE FLAG
F083 3B          2412          RTI
                 2413
                 2414
                 2415 ;************ RESET TO NORMAL OPERATION--CONTROL Y ********************************
F084 BDE197      2416 EM       JSR      CLRBUF           ;CLEAR BUFFER MEMORY
F087 BDEA91      2417          JSR      CHKDUP           ;CHECK DUPLEX SWITCH
F08A 2603        2418          BNE      *+5              ;Z=0 IF SWITCH IS ON
F08C BDE795      2419          JSR      CLRSRN           ;CLEAR SCREEN MEMORY
F08F 7F8020      2420          CLR      FLDFLG           ;CLEAR FIELD FLAG
F092 7F8007      2421          CLR      RAM+7            ;CLEAR ENTRY FLAG
F095 7EEDC3      2422          JMP      BRTS4            ;HOME ROUTINE
                 2423
                 2424
                 2425 ;************ ABORT PRINT OPERATION--CONTROL Z ************************************
F098 B68007      2426 BUS      LDA A    RAM+7            ;A=MODE FLAG
F09B 8102        2427          CMP A    #02H             ;CHECK IF IN PRINT MODE
F09D 2608        2428          BNE      *+10             ;Z=0 IF NOT-IN PRINT MODE
F09F 8601        2429          LDA A    #01H
F0A1 B78030      2430          STA A    ABORT            ;SET ABORT FLAG
F0A4 7F8007      2431          CLR      RAM+7            ;RESET MODE-FLAG TO NORMAL STATUS
F0A7 B68015      2432          LDA A    RAM+15H
F0AA B7B04E      2433          STA A    PRO
F0AD 7F8034      2434          CLR      RAM+34H
F0B0 3B          2435          RTI
                 2436
                 2437
                 2438 ;************                                  ************************************
F0B1 7EEBBF      2439 ESC      JMP      BS
                 2440
                 2441
                 2442 ;************                                  ************************************
F0B4 B68015      2443 FS       LDA A    RAM+15H
F0B7 B7B04E      2444          STA A    PRO
F0BA 7F8034      2445          CLR      RAM+34H
F0BD 3B          2446          RTI
                 2447
                 2448
                 2449 ;************                                  ************************************
F0BE B68015      2450 GS       LDA A    RAM+15H
F0C1 B7B04E      2451          STA A    PRO
F0C4 7F8034      2452          CLR      RAM+34H
F0C7 3B          2453          RTI
                 2454
                 2455
                 2456 ;************                                  ************************************
F0C8 B68015      2457 RS       LDA A    RAM+15H
F0CB B7B04E      2458          STA A    PRO
F0CE 7F8034      2459          CLR      RAM+34H
```

```
F0D1 3B          2460          RTI
                 2461
                 2462
                 2463 ;************                                    ************************** ******
F0D2 B6801S      2464 DS       LDA A    RAM+15H
F0D5 B7B04L      2465          STA A    PRO
F0D8 7F8034      2466          CLR      RAM+34H
F0DB 3B          2467          RTI
                 2468
                 2469
                 2470 ;************ PRINT PLATE FROM STORED DATA--CONTROL F ****************************
F0DC BDEA47      2471 DSL      JSR      PNTRED          ;PREPARE FOR PRINT BACK
F0DF BDCA91      2472          JSR      CHKDUP          ;CHECK DUPLEX SWITCH
F0E2 2703        2473          BEQ      BPT62           ;Z=1 IF SWITCH IS OFF
F0E4 7EF198      2474          JMP      BPT70
F0E7 5F          2475 BPT62    CLR B
F0E8 FE8008      2476 BPT64    LDX      NCTP
F0EB B68030      2477          LDA A    ABORT           ;CHECK IF ABORT FLAG IS SET
F0EE 2703        2478          BEQ      $+5             ;Z=1 IF FLAG NOT SET
F0F0 7EEDC3      2479          JMP      BPT54
F0F3 A600        2480          LDA A    00H,X           ;A=DATA BYTE
F0F5 08          2481          INX
F0F6 FF8008      2482          STX      NCTP            ;SAVE NEXT DATA BYTE ADDRESS
F0F9 4D          2483          TST A
F0FA 2602        2484          BNE      $+4             ;N=0 IF NOT UNPRINTABLE FIXED FIELD DATA BYTE
F0FC 8620        2485          LDA A    #20H
F0FE 8120        2486          CMP A    #20H            ;CHECK IF DATA BYTE IS A SPACE CODE
F100 2646        2487          BNE      BPT63           ;Z=0 IF NOT SPACE CODE
F102 B6800F      2488          LDA A    TPOS            ;A=TABLE POSITION VALUE
F105 13          2489          ABA
F106 B18011      2490          CMP A    TEV             ;CHECK IF AT END OF TABLE
F109 2703        2491          BEQ      $+5             ;Z=1 IF END OF LINE
F10B 5C          2492          INC B
F10C 200A        2493          BRA      BPT64
F10E B68003      2494          LDA A    SB1             ;A=PC SWITCH BANK #1 SETTINGS
F111 8401        2495          AND A    #01H            ;CHECK IF HOLDER OPTION ACTIVE
F113 2708        2496          BEQ      BPT67           ;Z=1 IF NOT ACTIVE
F115 F68010      2497          LDA B    HPOS
F118 F18012      2498          CMP B    HEV             ;CHECK IF HOLDER ON BOTTOM LINE
F11B 2602        2499          BNE      BPT65           ;Z=0 IF NOT ON LAST LINE
F11D 7F8007      2500 BPT67    CLR      RAM+7
F120 BDE9F1      2501          JSR      AUTINC          ;TO AUTO INCREMENT NUMBER UPDATE
F123 7EEDC3      2502          JMP      BPT54
F126 B6800F      2503 BPT65    LDA A    TPOS            ;A=TABLE POSITION CODE
F129 8101        2504          CMP A    #01H            ;CHECK IF AT LEFT MARGIN
F12B 2703        2505          BEQ      $+5             ;Z=1 IF AT LEFT MARGIN
F12D BDF1D5      2506          JSR      ZERT
F130 FE8008      2507          LDX      NCTP
F133 A600        2508          LDA A    00H,X
F135 8120        2509          CMP A    #20H
F137 2608        2510          BNE      $+10            ;Z=0 IF NOT SPACE CHARACTER
F139 08          2511          INX
```

```
F13A BC8010     2512          CPX     RAM+1CH     ;CHECK IF ALL RAM FOR THIS SCREEN SIZE HAS BEEN CHECKED
F13D 26F4       2513          BNE     $-11        ;Z=0 IF NOT ALL CHECKED
F13F 20DC       2514          BRA     BPT67
F141 C6FF       2515          LDA B   #0FFH
F143 BDE6AF     2516          JSR     MOVHLD
F146 209F       2517          BRA     BPT62
F148 5D         2518 BPT63    TST B
F149 270D       2519          BEQ     BPT66       ;Z=1 IF NO TABLE SPACING NEEDED
F14B 36         2520          PSH A
F14C 17         2521          TBA
F14D 36         2522          PSH A
F14E C6FF       2523          LDA B   #0FFH       ;FORWARD TABLE MOTION CODE
F150 8DE665     2524          JSR     MOVTAB
F153 32         2525          PUL A
F154 4A         2526          DEC A
F155 26F6       2527          BNE     $-8
F157 32         2528          PUL A
F158 BDE5E9     2529 BPT66    JSR     DIRDET      ;DETERMINE WHEEL ROTATION DIRECTION AND DISTANCE
F15B 8DF712     2530          JSR     TIM1
F15E BDE6FD     2531          JSR     PRNT
F161 8DE719     2532          JSR     TIM2
F164 C6FF       2533          LDA B   #0FFH
F166 8DE665     2534          JSR     MOVTAB
F169 B69011     2535          LDA A   TEV         ;A=TABLE END VALUE
F16C 4C         2536          INC A
F16D B18001     2537          CMP A   TPOS        ;CHECK IF AT END OF LINE
F170 2703       2538          BEQ     $+5         ;Z=1 IF AT END OF LINE
F172 7EF0E7     2539          JMP     BPT62
F175 B68003     2540          LDA A   SW1         ;A=PC SWITCH BANK #1 SETTINGS
F178 8401       2541          AND A   #01H        ;CHECK IF HOLDER OPTION ACTIVE
F17A 2708       2542          BEQ     BPT66       ;Z=1 IF NOT ACTIVE
F17C B68010     2543          LDA A   HPOS        ;A=HOLDER POSITION
F17F B18012     2544          CMP A   HEV         ;CHECK IF AT END OF PLATE
F182 2609       2545          BNE     BPT61       ;Z=0 IF NOT AT END OF PLATE
F184 7F8007     2546 BPT66    CLR     RAM+7       ;CLEAR PRINT MODE FLAG
F187 BDE9F1     2547          JSR     AUTINC      ;TO AUTO INCREMENT NUMBER UPDATE
F18A 7EEDC3     2548          JMP     BPTS4       ;HOME ROUTINE
F18D BDE1D5     2549 BPT61    JSR     ZERT
F190 C6FF       2550          LDA B   #0FFH
F192 BDE6AF     2551          JSR     MOVHLD
F195 7EF0E7     2552          JMP     BPT62
F198 0F         2553 BPT70    SEI
F199 B69000     2554 BPT71    LDA A   RS232S      ;A=ACIA STATUS REG
F19C 8401       2555          AND A   #01H        ;CHECK IF CHARACTER RECEIVED
F19E 27F9       2556          BEQ     $-5         ;Z=1 IF NO RECEIVED CHARACTER
F1A0 B69001     2557          LDA A   RS232I      ;A=RECEIVED CHARACTER
F1A3 815F       2558          CMP A   #5FH        ;CHECK UPPER LIMIT OF VALID CHARACTER RANGE
F1A5 2303       2559          BLS     $+5         ;IF VALID
F1A7 7EF1C6     2560          JMP     RECERR      ;RECEIVED CHARACTER ERROR
F1AA 811F       2561          CMP A   #1FH        ;CHECK LOWER LIMIT OF VALID CHARACTER RANGE
F1AC 2203       2562          BHI     $+5         ;IF ON VALID RANGE
F1AE 7EF1C6     2563          JMP     RECERR
```

```
F1B1 A700        2564        STA A   00H,X          ;STORE RECEIVED DATA BYTE
F1B3 08          2565        INX
F1B4 BC801C      2566        CPX     RAM+1CH        ;CHECK IF ENTIRE PLATE OF DATA RECEIVED
F1B7 26ED        2567        BNE     BPT71          ;Z=0 IF ALL DATA NOT RECEIVED YET
F1B9 BDF18D      2568        JSR     CLRINT         ;CLEAR ALL PENDING INTERUPTS
F1BC 0E          2569        CLI
F1BD 7EF0F7      2570        JMP     BPT62
F1C0 0E          2571 REDERR CLI
F1C1 C61D        2572        LDA B   #1DH           ;PRINT FINISHED CODE
F1C3 8DE77E      2573        JSR     OT232
F1C6 C6FF        2574        LDA B   #0FFH
F1C8 5A          2575        DEC B
F1C9 26FD        2576        BNE     *-1
F1CB C67F        2577        LDA B   #7FH           ;PRINT STORED DATA CODE
F1CD BDE77E      2578        JSR     OT232
F1D0 B68015      2579        LDA A   RAM+15H
F1D3 B7B04E      2580        STA A   PB0
F1D6 7F8034      2581        CLR     RAM+34H
F1D9 3B          2582        RTI
                 2583
                 2584
                 2585
                 2586
                 2587 ;************ INTERUPT VECTORS ************************************************
                 2588        ORG     0FFF8H
FFF8 E3A3        2589        FDB     IRQ            ;MASKABLE INTERUPT
FFFA EDC3        2590        FDB     BPTS4          ;SOFTWARE INTERUPT
FFFC F000        2591        FDB     PWRUP          ;NON-MASKABLE INTERUPT
FFFE F000        2592        FDB     PWRUP          ;RESET
```

Errors:  0

| LINE# | SYMBOL | TYPE | REFERENCES |
|---|---|---|---|
| 220 | ABORT | A | 348,2084,2430,2477 |
| 1827 | ACK | A | 816 |
| 1489 | AGAIN | A | 1494,1512 |
| 217 | AINCX2 | A | 1735,1797,2125,2338 |
| 218 | AINCYP | A | 1737,1799,2127,2340 |
| 1616 | AUTINC | A | 2331,2501,2547 |
| 206 | AUTOAD | A | 1619,1646,1733,1804,2131,2345 |
| 1839 | BEL | A | 817 |
| 417 | BPT1 | A | 428 |
| 1079 | BPT10 | A | 1068 |
| 1110 | BPT11 | A | 1121 |
| 1096 | BPT12 | A | 1085 |
| 1133 | BPT13 | A | 1131 |
| 364 | BPT14 | A | 352 |
| 1137 | BPT15 | A | 1128 |
| 1142 | BPT16 | A | 1136 |
| 1150 | BPT17 | A | 1159 |
| 1199 | BPT18 | A | 1208 |

| | | | |
|---|---|---|---|
| 994 | BPT19 | A | 990 |
| 465 | BPT2 | A | 454,460 |
| 1867 | BPT20 | A | 1854,1856 |
| 1914 | BPT21 | A | 1910 |
| 1978 | BPT22 | A | 1966 |
| 2046 | BPT23 | A | 2036 |
| 997 | BPT24 | A | 982 |
| 1902 | BPT25 | A | 1908,1915 |
| 2178 | BPT26 | A | 2169,2175 |
| 669 | BPT27 | A | 667,676 |
| 643 | BPT28 | A | 629,2407 |
| 2396 | BPT29 | A | 2392 |
| 512 | BPT3 | A | 478 |
| 2233 | BPT30 | A | 2189 |
| 967 | BPT31 | A | 958 |
| 1005 | BPT32 | A | 1017 |
| 1018 | BPT33 | A | 1010 |
| 1495 | BPT34 | A | 1479 |
| 343 | BPT35 | A | 335,341 |
| 1483 | BPT36 | A | 1471 |
| 1885 | BPT37 | A | 1891 |
| 1886 | BPT37A | A | 1895 |
| 1377 | BPT38 | A | 1431 |
| 1939 | BPT39 | A | 1936 |
| 480 | BPT3A | A | 490,495 |
| 496 | BPT3B | A | 493,505 |
| 549 | BPT4 | A | 525 |
| 1889 | BPT40 | A | 1880 |
| 1942 | BPT41 | A | 1926 |
| 2008 | BPT42 | A | 1983,2016 |
| 2009 | BPT42A | A | 2017 |
| 2013 | BPT43 | A | 2003 |
| 2064 | BPT44 | A | 2070,2087 |
| 2065 | BPT44A | A | 2074 |
| 2068 | BPT45 | A | 2059 |
| 1480 | BPT46 | A | 1473 |
| 1470 | BPT47 | A | 1482 |
| 1031 | BPT48 | A | 1020 |
| 989 | BPT49 | A | 986,1039,1034 |
| 526 | BPT4A | A | 535 |
| 536 | BPT4B | A | 545 |
| 788 | BPT5 | A | 758 |
| 942 | BPT50 | A | 948 |
| 2140 | BPT51 | A | 2115,2122 |
| 1848 | BPT52 | A | 1851 |
| 1813 | BPT53 | A | 1787,1789,1794 |
| 2084 | BPT54 | A | 1823,1839,2422,2477,2502,2548,2590 |
| 1931 | BPT55 | A | 1944 |
| 1932 | BPT55A | A | 1940 |
| 1984 | BPT56 | A | 1977 |
| 1699 | BPT57 | A | -- |
| 769 | BPT58 | A | 762,764 |

```
 617  BPT59      A  588
1384  BPT6       A  1404
2529  BPT60      A  2519
2549  BPT61      A  2545
2473  BPT62      A  2473,2517,2539,2562,2570
2518  BPT63      A  2487
2476  BPT64      A  2493
2503  BPT65      A  2499
2546  BPT66      A  2542
2500  BPT67      A  2496,2514
2163  BPT68      A  2156
2137  BPT69      A  2118
1184  BPT7       A  1177
2553  BPT70      A  2474
2564  BPT71      A  2567
 332  BPT75      A  328
1191  BPT8       A  1183
 951  BPT80      A  930
2216  BPT81      A  2207
2354  BPT82      A  2328,2330,2335
1083  BPT9       A  1062
 373  BPT95      A  370
 369  BPT96      A  347
1547  BPT97      A  1344,1387,1393,1439
 379  BPT98      A  372,377
 378  BPT99      A  375
1314  BRIGHT     A  1497,1548
1843  BS         A  818,2437
2426  BUS        A  836
2389  CAN        A  834,2395
1703  CHKBUP     A  1688,1694,1727,1786,1827,1882,1890,1928,1943,2005,2015,2061,2069,2105,2108,2114,2195,2221,2327,2375,2417
                   2472
1324  CLR1       A  1322
1606  CLRAT      A  692
 440  CLRBUF     A  260,490,2378,2416
 433  CLRINT     A  322,2568
1319  CLRSRN     A  687,2383,2419
 810  CODE0      A  772
 811  CODE1      A
 820  CODE10     A
 821  CODE11     A
 822  CODE12     A
 823  CODE13     A
 824  CODE14     A
 825  CODE15     A
 826  CODE16     A  775
 827  CODE17     A
 828  CODE18     A
 829  CODE19     A
 812  CODE2      A
 830  CODE20     A
 831  CODE21     A
```

| | | | |
|---|---|---|---|
| 832 | CODE22 | A | |
| 833 | CODE23 | A | |
| 834 | CODE24 | A | |
| 835 | CODE25 | A | |
| 836 | CODE26 | A | |
| 837 | CODE27 | A | |
| 838 | CODE28 | A | |
| 839 | CODE29 | A | |
| 813 | CODE3 | A | |
| 840 | CODE30 | A | |
| 841 | CODE31 | A | |
| 814 | CODE4 | A | |
| 815 | CODE5 | A | |
| 816 | CODE6 | A | |
| 817 | CODE7 | A | |
| 818 | CODE8 | A | |
| 819 | CODE9 | A | |
| 1513 | COLUMN | A | 1491,1510 |
| 270 | CONTIN | A | 261 |
| 2147 | CR | A | 823 |
| 210 | CURBOT | A | 1283,1373,1422,2001 |
| 207 | CURLFT | A | 376,1261,1284,1353,1416,1443,1451,1466,1516,1684,1739,1853,1878,2101,2166,2190,2216,2268,2293 |
| 1252 | CURLIM | A | 691 |
| 208 | CURRHT | A | 374,1021,1267,1449,1924 |
| 209 | CURTOP | A | 1003,1277,1286,1356,1374,1445,1462,1519,1686,2057,2103 |
| 204 | CXP | A | 373,1022,1024,1033,1285,1597,1685,1734,1761,1852,1879,1881,1925,1927,1932,2102,2165,2191,2217,2267,2295 2306,2309 |
| 205 | CYP | A | 1002,1287,1599,1687,1736,1980,2002,2004,2058,2066,2104 |
| 213 | DATAD | A | 1376,1406,1408,1409,1411,1412 |
| 2253 | DC1 | A | 827 |
| 2260 | DC2 | A | 828 |
| 2267 | DC3 | A | 829 |
| 2291 | DC4 | A | 830 |
| 1646 | DECNUM | A | 1790 |
| 2471 | DEL | A | 800 |
| 1103 | DETSTP | A | 1075,1079,1092,1096 |
| 1309 | DIM | A | 1467,1508 |
| 1050 | DIRDET | A | 366,2529 |
| 2246 | DLE | A | 826 |
| 1435 | DRAWHD | A | 2139 |
| 2416 | EM | A | 835 |
| 1820 | ENQ | A | 815 |
| 1786 | EOT | A | 814 |
| 2439 | ESC | A | 837 |
| 2375 | ETB | A | 833 |
| 1757 | ETX | A | 813 |
| 2078 | FF | A | 822 |
| 623 | FINSET | A | 613,616 |
| 219 | FLOFLG | A | 957,1693,1731,1747,1820,2361,2420 |
| 2443 | FS | A | 838 |
| 2450 | GS | A | 839 |
| 202 | HEV | A | 660,668,1178,1268,1278,1522,1968,1978,2498,2544 |

```
 709  HEVTAB     A  653
 200  HPOS       A  339,547,1173,1182,1190,1967,2037,2492,2543
1699  HT         A  812
 215  INCFLC     A  929,1739,1831,1873
 214  INCNUM     A  945,949,1616,1625,1652,1740,1708,1803,1875,1877,2117,2329,2344
 720  IRQ        A  2589
 747  KEYBD1     A  733
 755  KEYBD2     A  743,749
1551  LABELS     A  1526
1335  LDSRN      A  378,1027,1295,1696,1894,2014,2073,2116,2197,2223
 845  LETPOS     A  1038
1949  LF         A  820,2202,2228
1038  LOLIMR     A  928,1050
 203  MAXCE      A  917,978,1680,1872,19 ,1995,2056,2096,2157
 190  MOT1       A  300,448,1114
 191  MOT2       A  301,484,499,515,1153
 192  MOT3       A  302,529,539,552,1202
1112  MOTGO      A  1078,1082,1095,1099
1175  MOVBLD     A  1976,2045,2516,2551
 560  MOVMOT     A  467,483,498,514,528,538,551,1113,1152,1201
1126  MOVTAB     A  365,1866,1912,2315,2524,2534
 580  MSEQ       A  569
 587  MVSWIT     A  342,2380
2327  NAK        A  831
 194  NCE        A  312,956,979,983,997,1732,1867,1869,1916,1918,1986,1987,1988,1990,1991,1998,2048,2050,2051,2053,2054,2100
                   2171,2173,2179,2181,2182,2184,2185,2210,2304,2311
 193  NCTP       A  310,351,354,1683,1870,1919,1996,2000,2055,2099,2186,2209,2476,2482,2567
1533  NEWLIN     A  1528,1546
 246  NEXPOS     A  254,259
1720  NUL        A  810
 195  NUR2P      A  314,343,366,368,763,991,994,1342
1299  OT232      A  631,642,731,963,973,1310,1315,1325,1327,1347,1352,1355,1357,1383,1395,1398,1400,1415,1418,1428,1442,1444
                   1447,1454,1459,1461,1465,1489,1496,1501,1503,1505,1507,1515,1518,1520,1534,1536,1538,1540,1542,1596,1598
                   1600,1730,1796,1798,1800,1802,1806,1811,1830,2111,2124,2126,2128,2130,2133,2138,2337,2339,2341,2343,2347
                   2352,2367,2573,2578
 179  PAC        A  231,279,729,1224,1226,1236,1242
 181  PAD        A  264,273
 180  PAD        A  290,433,731,2393
 182  PBC        A  243,277
 184  PBD        A  267,273
 183  PBD        A  281,286,292,296,434,457,476,491,503,523,533,543,591,595,603,607,618,720,723,734,738,753,766,798,805,915
                   921,926,954,995,1721,1742,1751,1767,1780,1814,1833,1847,1858,1862,1867,1903,1940,1953,1961,1971,2010
                   2025,2032,2041,2066,2141,2151,2160,2213,2227,2233,2240,2247,2254,2261,2278,2301,2321,2355,2369,2382,2394
                   2407,2433,2444,2451,2458,2465,2580
 264  PCATST     A  396,407,426
 804  PINTR      A  736
 327  PNTCHK     A  346,380,1055
1673  PNTRED     A  2471
1594  POSCUR     A  1547,1690,1812,1884,1930,2007,2063,2107,2198,2224,2319,2353
1224  PRNT       A  362,2531
 229  PWRUP      A  252,2591,2592
 189  RAM        A  245,258,316,317,332,345,379,466,482,497,513,527,537,550,587,597,600,601,609,611,612,624,632,634,643,652
                   662,667,673,674,677,681,682,683,685,693,721,737,752,760,765,797,804,914,917,920,923,925,953,975,988,989
                   994,998,999,1005,1006,1008,1013,1018,1029,1032,1112,1143,1151,1192,1200,1335,1336,1377,1384,1385,1388
```

```
                    1402,1419,1474,1483,1498,1499,1610,1673,1681,1698,1720,1722,1741,1743,1750,1752,1764,1766,1768,1775,1779
                    1781,1813,1815,1822,1832,1834,1843,1846,1848,1861,1863,1871,1885,1886,1899,1902,1904,1914,1920,1931,1938
                    1939,1952,1954,1957,1960,1962,1970,1972,1992,2008,2009,2024,2026,2028,2031,2033,2040,2042,2064,2065,2079
                    2085,2097,2140,2142,2147,2150,2152,2159,2161,2201,2211,2212,2214,2225,2226,2232,2234,2239,2241,2246,2248
                    2253,2255,2260,2262,2275,2277,2279,2285,2298,2300,2302,2320,2322,2354,2356,2368,2370,2378,2379,2381,2383
                    2400,2406,2408,2410,2411,2421,2426,2431,2432,2434,2443,2445,2450,2452,2457,2459,2464,2466,2500,2512,2546
                    2566,2577,2581
2571  REDERR      A  2560,2563
2407  RS          A  840
 187  RS232C      A  233,271
 186  RS2421      A  435,727,2496,2557
 185  RS2320      A  1303
 188  RS232S      A  724,1300,2390,2454
 743  RSTN        A  728
 196  SB1         A  291,305,336,627,663,686,747,959,969,980,1291,1319,1337,1435,1676,1703,1791,1949,2021,2080,2092,2119,2154
                    2205,2332,2362,2494,2540
 197  SB2         A  294
2239  SI          A  826
2232  SO          A  824
1727  SOH         A  811
1164  SPCHAR      A  1142
1213  SPLINE      A  1191
 212  SRNLIN      A  320,371,1290,1365,1527,1692,1981,2013,2068,2071,2113
 211  SRNSRT      A  312,369,1026,1287,1360,1468,1691,1855,1889,1892,1934,1942,2112,2167,2192,2194,2218,2220
1748  STX         A  812
2361  SYN         A  832
 216  TAD1        A  1606,1757,2270,2291
 384  TEST1       A  265,268
 414  TEST2       A  266,269
 201  TEV         A  651,671,985,1014,1019,1130,1252,1262,1367,1378,1407,1475,1485,1607,1771,1777,1907,1935,1984,2046,2168
                    2174,2493,2535
 698  TEVTAB      A  644
1237  TIM1        A  361,2530
1244  TIM2        A  363,2532
 199  TPOS        A  333,567,1126,1135,1141,1906,2200,2488,2503,2537
2464  US          A  841
 912  VAR CHR     A  796
2021  VT          A  821
 221  WDOGT       A  327,330,626
 198  WPOS        A  463,1056,1059,1060
 523  ZERH        A  308,556,1679,2095
 476  ZERT        A  304,517,1675,2090,2203,2506,2549
 459  ZERW        A  303,1674,2091,2204
 451  ZERW1       A  456
 457  ZERW2       A  452,461
```

Thus there has been disclosed a marking machine control system which is flexible, fast and reliable. The system of the present invention eliminates mechanical components except for those necessary to implement the mechanical functions of the marking machine, thereby minimizing problems associated with such components. Furthermore, the multiple operating modes possible with the control system of the present invention provide desireable flexibility and in many cases significantly increase the operational speed of the marking machine 20.

Figure 18:
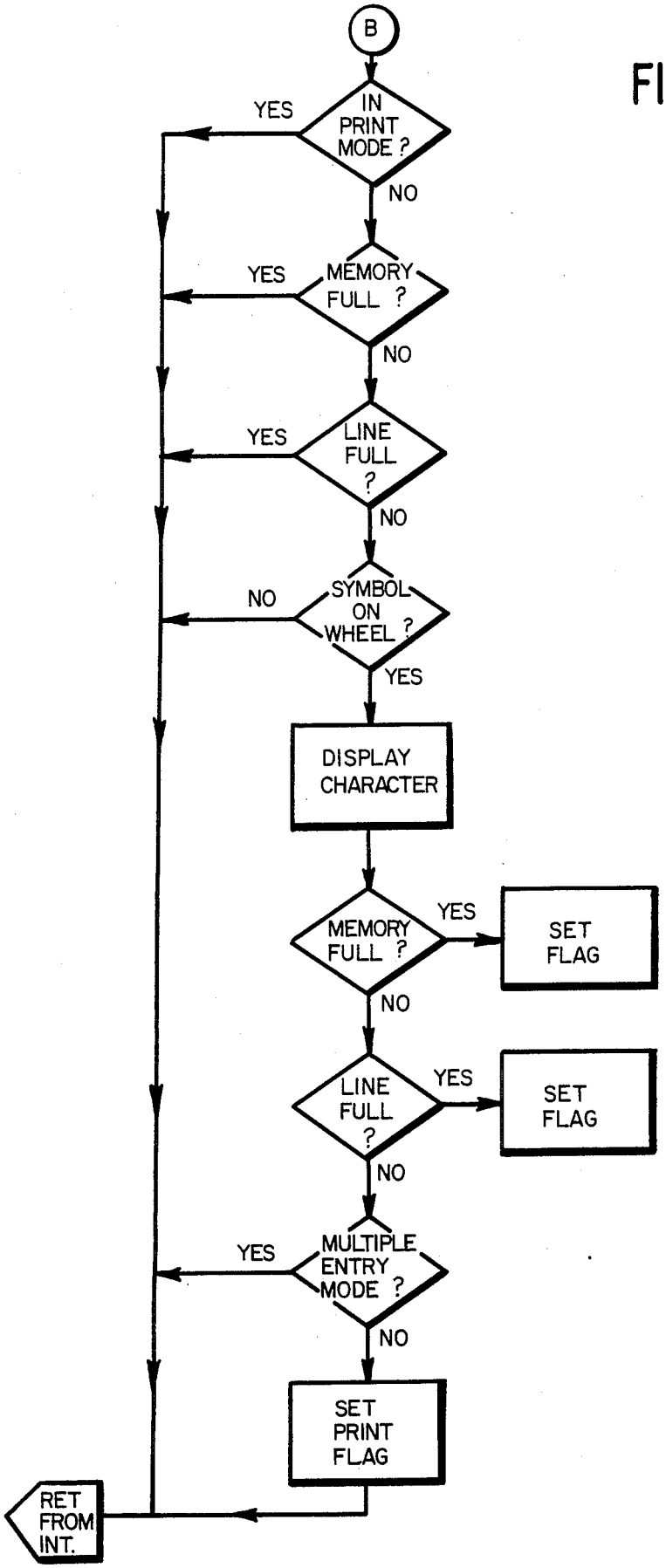

Thus, a control system of the present invention is responsive to a manually actuatable keyboard for selecting alternatively either the marking symbols or control codes for producing an output representative of a selected symbol or the selected control code. A control system includes means responsive to that output for identifying the output as representative of a symbol or control code and for determining whether the selected symbol is a symbol on the marking member. (See, e.g., FIG. 5, the buffer 76, data line 90 PIA 94; flow chart FIG. 17; and the program listing, lines 720–33, 746–800.) The system includes means normally responsive to identification of the output as a symbol to effect initiating energization of the marking member moving means to locate the selected symbol at the marking location and for initiating energization of the marking member displacing means and effect momentary displacement of the marking member and marking of the workpiece. (See, e.g., the flow charts, FIGS. 18 and 19; and the program listing, lines 912–1122, 326–62 and 1223–33.)

The control system further includes means responsive to the end of each energization to energize a table moving means. (See e.g., the flow chart, FIG. 19; and program listing, lines 363–80, 1243–47 and 1125–71.) Furthermore, the system includes means responsive to the setting of the switches to cause the table to be incremented a distance corresponding to the setting of the switches (See, e.g., the circuitry of FIG. 13, switches 204, 205, PIA 294, buffers 289 and the data lines; the flow chart FIG. 19; and the program listing, lines 586–694.); and to control the display format as a function of the switch settings. (See, e.g., program listing, lines 586–694, 1251–1305 and 1318–1591.) The system includes means responsive to the identification of the output as a control code for initiating a plurality of control operations. (See, e.g., FIG. 5, FIG. 17; and the program listing, lines 720–33 and 746–800.)

The control system includes means responsive to the initiation of the control operation for selecting multiple entry modes to inhibit energization of the marking member and for inputting a sequence of data before the marking member is energized. (See, e.g., program listing, lines 719–33, 746–800, 819–23, 2084–2143 and 2470–2582.) As indicated above, the system is capable of responding to initiation of a control operation for enabling multiple print mode and for initiating sequential actuation of the marking member in the multiple print mode. (See, e.g., program listing, lines 746–800, 819–23, 2084–2143 and 2470–2582.)

The display may be altered to display various symbols in different formats (See, e.g., the program listing, lines 719–33, 746–87 and 1747–53.); and the system displays the symbols on the display in positions corresponding to the position at which they are to be marked on a workpiece. (See, e.g., program listing, lines 911–973, 1298–1306.)

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A control system for a marking machine of the type having:

a marking member carrying a plurality of marking symbols, means for moving said marking member to sequentially locate said marking symbols at a marking location, table means for supporting a workpiece at the marking location, means for moving said table means and the workpiece supported thereby past said marking location to position successive portions of said workpiece at said marking location, and means for momentarily displacing said marking member into engagement with a workpiece to effect marking thereof with said selected one of said symbols on said marking member located at said marking location;

said control system comprising:

manually actuatable keyboard means for alternatively selecting one of said marking symbols and one of a plurality of control codes and for producing an output representative of said selected symbol or said selected control code;

means responsive to said output for identifying said output as representative of a symbol or a control code and for determining whether said selected symbol is a symbol on said marking member;

means normally responsive to the identification of said output as a symbol on said marking member for initiating energization of said marking member moving means to move said marking member to locate said selected symbol at said marking location and for initiating energization of said marking member displacing means to effect said momentary displacement of said marking member and the resulting marking of said workpiece;

means responsive to the termination of each energization of said marking member displacing means for energizing said table moving means to increment said table means to position a new portion of said workpiece at said marking location;

manually settable switch means for selecting the distance said table means is to be moved during each of said table increments;

means responsive to the setting of said manually settable switch means for causing said table moving means to increment said table means a distance corresponding to the setting of said switch means; and means responsive to the identification of said output as a control code for initiating one of a plurality of control operations corresponding thereto.

2. A control system as claimed in claim 1 including:

means for determining the shortest distance between the present position of said marking member and the position at which said selected symbol is located and for causing said marking member moving means to move said marking member said shortest distance.

3. A control system as claimed in claim 1 including:

means responsive to the initiation of a control operation when said control code has been identified as a control code selecting a multiple entry mode for inhibiting energization of said marking member moving means and for enabling said output responsive means to respond to a sequence of said outputs before said marking member moving means is energized.

4. A control system as claimed in claim 3 including:

means responsive to the initiation of a control operation when said control code has been identified as a control code for enabling a multiple print mode for enabling said output responsive means to respond to a multiple print control code.

5. A control system as claimed in claim 4 wherein said means for enabling a multiple print mode also terminates said multiple entry mode.

6. A control system as claimed in claim 4 including:

means responsive to the initiation of a control operation when said control code has been identified as a control code for said multiple print mode for initiating sequential actuation of said marking member displacing means.

7. A control system as claimed in claim 1 wherein:

said table moving means is a first table moving means for moving said table means and the workpiece supported thereby in a first direction whereby a line of symbols may be marked on said workpiece;

said marking machine including second table moving means for moving said table means and the workpiece supported thereby in a second direction whereby a plurality of lines of symbols may be marked on said workpiece;

said control system including:

display means for displaying all of the selected symbols prior to energization of said marking member moving means.

8. A control system as claimed in claim 7 wherein:

one of said control codes designates a symbol as a symbol not to be marked on said workpiece; and including means responsive to said designating control code for altering the display of said designated symbol from the display of non-designated symbols.

9. A control system as claimed in claim 7 wherein:

said manually settable switch means is a first manually settable switch means for selecting the distance said table means is to be moved in said first direction during each of said table increments;

said control system including second manually settable switch means for selecting the distance said table means is to be moved in said second direction during each of said table increments; and said switch setting responsive means being responsive to the setting of said first manually settable switch means for causing said first table moving means to increment said table means a distance in said first direction corresponding to the setting of said first switch means for controlling the spacing between adjacent symbols in a line marked on said workpiece and responsive to the setting of said second manually settable switch means for causing said second table moving means to increment said table means a distance in said second direction corresponding to the setting of said second switch means for controlling the spacing between adjacent lines of symbols marked on said workpiece.

10. A control system as claimed in claim 9 including:

means responsive to said manually settable switch means for controlling said display means for altering the display thereof to display a maximum number of symbols in each line as a function of the setting of said first manually settable switch means and to display a maximum number of lines as a function of the setting of said second manually settable switch means, wherein said display means displays the format of all of the symbols to be marked on a workpiece in the positions at which the symbols are to be marked.

11. A control system as claimed in claim 10 including:

memory means;

means for storing information corresponding to the formatted display in said memory means; and means for recalling said stored information from said memory means and displaying said information on said display means.

12. A control system as claimed in claim 11 wherein:

said switch responsive means is responsive to the setting of said switch means in said recalled information.

13. A control system as claimed in claim 1 wherein:

said means for initiating energization of said marking member is normally responsive to the identification of said output as a symbol on said marking member for displaying said symbol in an optical display.

14. A control system for a marking machine of the type having:

a marking member carrying a plurality of marking symbols, means for moving said marking member to sequentially locate said marking symbols at a marking location, table means for supporting a workpiece at the marking location, first means for moving said table means and the workpiece supported thereby in a first direction past said marking location to position successive portions of said workpiece at said marking location, whereby a line a symbols may be marked on said workpiece, second means for moving said table means and the workpiece supported thereby in a second direction whereby a plurality of lines of symbols may be marked on said workpiece, and means for momentarily displacing said marking member into engagement with a workpiece to effect marking thereof with said selected one of said symbols on said marking member located at said marking location;

said control system comprising:

manually actuatable keyboard means for alternatively selecting one of said marking symbols and one of a plurality of control codes and for producing an output representative of said selected symbol or said selected control code;

means responsive to the identification of said output as a control code for initiating one of a plurality of control operations corresponding thereto;

means responsive to said output for identifying said output as representative of a symbol or a control code and for determining whether said selected symbol is a symbol on said marking member;

display means for displaying all of the selected symbols prior to energization of said marking member moving means;

means responsive to the identification of said output as a symbol on said marking member for displaying said symbol on said display means in a position corresponding to the position at which said symbol is to be marked on said workpiece;

first manually settable switch means for selecting the distance said table means is to be moved in said first direction during each of said table increments;

second manually settable switch means for selecting the distance said table means is to be moved in said second direction during each of said table increments;

means responsive to the setting of said first manually settable switch means for causing said first table moving means to increment said table means a distance in said first direction corresponding to the setting of said first switch means for controlling the spacing between adjacent symbols in a line marked on said workpiece and responsive to the setting of said second manually settable switch means for causing said second table moving means to increment said table means a distance in said second direction corresponding to the setting of said second switch means for controlling the spacing between adjacent lines of symbols marked on said workpiece;

means responsive to said manually settable switch means for controlling said display means for altering the display thereof to display a maximum number of symbols in each line as a function of the setting of said first manually settable switch means and to display a maximum number of lines as a function of the setting of said second manually settable switch means, whereby said display means displays the format of all of the symbols to be marked on a workpiece in the positions at which the symbols are to be marked;

memory means;

means for storing information corresponding to the formatted display in said memory means; and means for recalling said stored information from said memory means and displaying said information on said display means;

said switch responsive means is responsive to the setting of said switch means in said recalled information;

means responsive to the initiation of a control operation when said control code has been identified as a control code for enabling a multiple print mode for initiating sequential actuation of said marking member moving means to move said marking member to locate said selected symbol at said marking location and for initiating energization of said marking member displacing means to effect said momentary displacement of said marking member and the resulting marking of said workpiece; and means responsive to the termination of each energization of said marking member displacing means for energizing said table moving means to increment said table means to position a new portion of said workpiece at said marking location.

* * * * *